US007275812B2

(12) United States Patent
Furukawa

(10) Patent No.: US 7,275,812 B2
(45) Date of Patent: Oct. 2, 2007

(54) INK JET HEAD AND RECORDING APPARATUS USING THE SAME

(75) Inventor: Koji Furukawa, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 124 days.

(21) Appl. No.: 10/765,469

(22) Filed: Jan. 28, 2004

(65) Prior Publication Data

US 2004/0183860 A1 Sep. 23, 2004

(30) Foreign Application Priority Data

Jan. 29, 2003 (JP) ..... 2003-020585
Mar. 31, 2003 (JP) ..... 2003-095215

(51) Int. Cl.
*B41J 2/06* (2006.01)

(52) U.S. Cl. ..... 347/55

(58) Field of Classification Search ..... 347/9, 347/55, 54, 103, 111, 112, 120, 123
See application file for complete search history.

(56) References Cited

U.S. PATENT DOCUMENTS 4,502,054 A * 2/1985 Brescia et al. ..... 347/55
4,633,268 A * 12/1986 Miroku ..... 347/76
4,801,955 A * 1/1989 Miura et al. ..... 347/55
5,808,638 A 9/1998 Miki et al.
5,975,684 A * 11/1999 Suetsugu et al. ..... 347/55
6,089,698 A 7/2000 Temple et al.
6,126,274 A 10/2000 Kohyama
6,158,844 A * 12/2000 Murakami et al. ..... 347/55
6,286,938 B1 9/2001 Okano et al.
6,361,147 B1 * 3/2002 Jonsson ..... 347/55
6,908,177 B2 * 6/2005 Suganuma ..... 347/55
2002/0136823 A1 * 9/2002 Miyashita et al. ..... 427/66

FOREIGN PATENT DOCUMENTS

EP 0779 155 A2 6/1997

(Continued)

OTHER PUBLICATIONS

European Patent Office Action dated Apr. 26, 2007.

(Continued)

*Primary Examiner*—Stephen Meier
*Assistant Examiner*—Jason Uhlenhake
(74) *Attorney, Agent, or Firm*—Sughrue Mion, PLLC

(57) ABSTRACT

The ink jet head records an image on a recording medium by ejecting ink containing charged fine particles by means of an electrostatic force, and includes an ink guide, an ink flow path that supplies the ink to the ink guide and an ejection electrode that ejects the supplied ink. The ejection electrode includes a surrounding electrode arranged so as to surround an outer periphery of the ink guide with a spacing, or side-by-side electrodes arranged on both sides of the ink guide so as to oppose each other with a spacing. A ratio between an effective inside diameter of the surrounding electrode or an effective spacing between the side-by-side electrodes, and a distance from the surrounding electrode or the side-by-side electrodes to a tip end of the ink guide protruding on the side of the recording medium is set in a range of 1:0.5 to 1:2 or 1:0.7 to 1:2.8, respectively.

18 Claims, 14 Drawing Sheets

FOREIGN PATENT DOCUMENTS

| | | | |
|---|---|---|---|
| EP | 0844 088 | A2 | 5/1998 |
| EP | 1 386 739 | | 2/2004 |
| EP | 1 424 204 | | 6/2004 |
| JP | 1-222970 | A | 9/1989 |
| JP | 09-207355 | | 8/1997 |
| JP | 9-254372 | A | 9/1997 |
| JP | 10-138493 | A | 5/1998 |
| JP | 10 151 752 | | 6/1998 |
| JP | 11-78026 | A | 3/1999 |
| JP | 2000-233502 | | 8/2000 |
| JP | 2000-255066 | | 9/2000 |
| JP | 2002-273893 | A | 9/2002 |
| WO | WO 02/057086 | A1 | 7/2002 |

OTHER PUBLICATIONS

Japanese Office Action dated Jul. 17, 2007 for JP Patent Application No. 2003-020585.

* cited by examiner

EJECTION ELECTRODE STRUCTURE:
CIRCULAR ELECTRODE HAVING INSIDE DIAMETER OF 200 μm
EJECTION ELECTRODE: +400V, COUNTER ELECTRODE: −1500V,
FLOATING CONDUCTION PLATE: +400V

INK JET HEAD AND RECORDING APPARATUS USING THE SAME

BACKGROUND OF THE INVENTION

1. Field of the Invention

The present invention relates to an ink jet head that ejects ink as ink droplets, and a recording apparatus and a recording method using the ink jet head. More specifically, the present invention relates to an electrostatic ink jet head that controls ejection of ink containing charged fine particles by means of an electrostatic force, an ink jet head where energy required for ink ejection is reduced, and to a recording apparatus and a recording method with which an image is recorded on a recording medium using the ink jet head.

2. Description of the Related Art

An ink jet recording apparatus records an image on a recording medium by ejecting ink containing a colorant from ejection ports as ink droplets, which then fly and impinge on the recording medium. According to an ink droplet ejection method, there are known the ink jet recording apparatuses of an electrostatic system, a bubble system, a thermal system, a piezoelectric system, and the like.

The electrostatic ink jet recording system is a system in which ink containing a charged fine particle component is used and an image corresponding to image data is recorded on a recording medium by controlling ejection of the ink by means of an electrostatic force through application of a predetermined voltage to each ejection electrode of an ink jet head in accordance with the image data. As a recording apparatus adopting this electrostatic ink jet recording system, there are known ink jet recording apparatuses disclosed in JP 10-138493 A, JP 11-078026 A, and JP 09-254372 A, for instance.

FIG. 22 is a conceptual diagram schematically showing an example of an outlined construction of an ink jet head of the ink jet recording apparatus disclosed in JP 10-138493 A described above. An ink jet head 200 shown in FIG. 22 includes a head substrate 202, an ink guide 204, an insulating substrate 206, an ejection electrode 208, a counter electrode 210 supporting a recording medium P, a bias voltage source 212, and a signal voltage source 214. Note that in this drawing, only one individual electrode serving as an ejection means constituting the ink jet head disclosed in JP 10-138493 A is conceptually illustrated.

Here, the ink guide 204 is made of a resin flat plate having a predetermined thickness and including a protrusion-like tip end portion 204*a*, and is arranged on the head substrate 202. Also, in the insulating substrate 206, a through hole 216 is formed at a position corresponding to a position at which the ink guide 204 is arranged. The ink guide 204 passes through the through hole 216 formed in the insulating substrate 206 and its tip end portion 204*a* protrudes upward from the upper surface of the insulating substrate 206 in the drawing, that is, from a surface thereof on a recording medium P side. Also, the head substrate 202 and the insulating substrate 206 are arranged so as to be spaced apart from each other by a predetermined distance, and a flow path 218 of ink Q is formed between these substrates 202 and 206.

Also, the ejection electrode 208 is provided in a ring shape for each individual electrode on the upper surface of the insulating substrate 206 in the drawing so as to surround the through hole 216 formed in the insulating substrate 206. The ejection electrode 208 is connected to the signal voltage source 214 that generates a pulse signal corresponding to ejection data (ejection signal) such as image data or print data, and the signal voltage source 214 is grounded through the bias voltage source 212.

In addition, the counter electrode 210 is arranged at a position opposing the tip end portion 204*a* of the ink guide 204 and is grounded. Also, the recording medium P is arranged on the lower surface of the counter electrode 210 in the drawing, that is, on a surface thereof on an ink guide 204 side, and the counter electrode 210 functions as a platen of the recording medium P.

In the ink jet head 200 constructed in this manner, at the time of recording, ink containing a fine particle component charged to the same polarity as a voltage applied to the ejection electrode 208 is circulated by a not-shown ink circulation mechanism in a predetermined direction (from the right to the left, in the illustrated example) in the ink flow path 218, and a part of the ink Q in the ink flow path 218 is supplied to the tip end portion 204*a* of the ink guide 204 through the through hole 216 in the insulating substrate 206 by capillary action or the like.

Here, a predetermined high voltage (DC voltage of 1.5 kV, for instance) is constantly applied to the ejection electrode 208 by the bias voltage source 212. Under this state, the strength of an electric field in proximity to the tip end portion 204*a* of the ink guide 204 is low and the ink Q supplied to the tip end portion 204*a* of the ink guide 204 will not fly out from the tip end portion 204*a*. In this case, however, a part of the ink Q in the ink flow path 218, in particular, the charged fine particle component moves upward above the upper surface of the insulating substrate 206 in the drawing while passing through the through hole 216 in the insulating substrate 206 and aggregate in the tip end portion 204*a* of the ink guide 204.

On the other hand, when a pulse voltage, e.g., DC voltage of 500 V (ON-time; 0 V: OFF-time) is applied by the signal voltage source 214 to the ejection electrode 208 biased to the high voltage (DC 1.5 kV) by the bias voltage source 212, both of these high voltages are superimposed on each other and 2 kV is applied to the ejection electrode 208, for instance. As a result, the ink Q, in particular, the charged fine particle component in the ink Q further moves upward along the ink guide 204 and aggregate in the tip end portion 204*a*. Then, the ink Q aggregating in the tip end portion 204*a* of the ink guide 204 and containing the charged fine particle component flies out from the tip end portion 204*a* by means of an electrostatic force, is attracted by the grounded counter electrode 210, and adheres on the recording medium P. In this manner, a dot is formed by the charged fine particle component.

By forming dots of the charged fine particle component in this manner while relatively moving the ink jet head 200 and the recording medium P supported on the counter electrode 210, an image corresponding to image data is recorded on the recording medium P.

With this ink jet recording apparatus, the ink Q is guided by the ink guide 204 provided in an ejection port and an ink droplet R flies out from the tip end portion 204*a*, so that it becomes possible to stabilize the flying of the ink droplet R.

Meanwhile, in JP 11-078026 A, an image forming apparatus is disclosed which uses a head obtained by providing a control electrode below the ink flow path 218 in the ink jet head 200 described above. During recording, this control electrode causes the ink Q in the ink flow path 218, in particular, the charged fine particle component in the ink Q to migrate toward the ejection electrode 208 and further toward the tip end portion 204*a* of the ink guide 204. On the other hand, during non-recording, the control electrode causes the ink Q adhering to the ink guide 204 and the charged fine particle component in the ink Q to migrate toward a lower portion of the ink flow path 218.

Also, in JP 09-254372 A, an ink jet head is disclosed in which parallel ejection electrodes (parallel electrodes) provided in a groove-like ink flow path are used in place of the ring-like ejection electrode (circular electrode) disclosed in JP 10-138493 A and JP 11-078026 A.

Further, in JP 2002-273893 A, an ink jet printer nozzle is disclosed in which a pin serving as an ink guide is provided inside an ejection port (nozzle) and, when an ink droplet flies out from the ejection port, a tail portion of the ink droplet is cut by an end portion (protrusion) of the pin. With this construction, an ink meniscus in the ejection port is stabilized at the time of flying of the ink droplet and cutting of the ink droplet.

Also, in JP 01-222970 A, a liquid injection recording head is disclosed in which a rod-like guide is provided inside an ejection port and is subjected to treatment imparting hydrophilic property thereto. With this construction, at the time of ejection of an ink (recording liquid) droplet, the ink droplet is ejected along the rod-like guide, which stabilizes an ejection direction of the ink droplet.

By the way, even when the ink jet heads disclosed in JP 10-138493 A, JP 11-078026 A and JP 09-254372 A described above are used, in the case of a recording apparatus that is required to perform high-definition recording at a high speed, a line head is necessary, which is capable of recording images of one line at a time inevitably. When the definition and recording speed of the recording apparatus are respectively 1200 dpi (dot/inch) and 60 ppm (page/minute), for instance, a line head that is capable of recording an image on a recording medium having a width of 10 inches needs to include as numerous as 12000 individual electrodes, whose number is equal to the number of pixels on one line, and pulse voltage sources, that is, drive circuits whose number is equal to the number of the individual electrodes to be driven.

In this case, in the line head, the individual electrodes and the pulse voltage sources need to be implemented at a physically extremely high density with respect to the line direction. The pulse voltage sources use a high voltage (around 400 to 600 V, for instance), so that when the individual electrodes and the pulse voltage sources are arranged at a high density, there involves a high risk of causing the discharge. Accordingly, it is extremely difficult to cope with both high-density implementation and high-voltage driving. Note that in order to apply pulse voltages to the ejection electrodes, the pulse voltage sources are required to generate the pulse voltages. Here, the ejection electrodes are each a small electrode, so that the amount of a current consumed by ejection itself is small. However, if high pulse voltages are generated by the pulse voltage sources, current consumption is increased. Also, the pulse voltage sources consume currents in order to generate the pulse voltages, so that if high pulse voltages are generated, the current consumption is increased. When the number of individual electrodes is small, the increased current consumption causes little problem. However, when a large number of individual electrodes are used as described above, the increased current consumption causes a problem.

In addition, in the case of the apparatuses disclosed in JP 10-138493 A, JP 2002-273893 A and JP 1-222970 A described above, the ink is pulled out or pushed out through a gap with the ink guide provided in a tight space of the ejection port, so that a large force is required in order to cause ink ejection. That is, it is required to increase the pulse voltages to the ejection electrodes in the case of the electrostatic system, to increase electric power to heating elements in the case of the bubble system or the thermal system, and to increase electric power to piezoelectric elements in the case of the piezoelectric system. Consequently, there arises a problem in that loads on an electric circuit and the like are increased and operation stability is lowered.

Also, at the time of activation of the apparatuses (at the time of start of recording), a long time is taken to supply the ink to the ejection port, so that a delay time from exertion of an ejection force to actual ejection is elongated, during which it is impossible to eject an ink droplet having a predetermined size set for the ejection force. Consequently, there involves a problem in that the dot sizes of first several dots become small and a print failure occurs.

Further, in JP 1-222970 A, the ink guide is made ink-receptive in order to enhance a contact property of the ink to the ink guide, which causes a problem in that the larger ejection force is necessary for ink ejection.

SUMMARY OF THE INVENTION

The present invention has been made in order to solve the above-mentioned problems inherent in the prior art, and has a first object to provide an ink jet head capable of achieving an ejection voltage reduction, widening a selection range for ink guide materials (low dielectric constant material becomes usable, for instance), and widening a selection range for ink guide tip end structures.

It is a second object of the present invention to provide a safe, low-cost, and widely applicable electrostatic ink jet recording apparatus and recording method that are capable of recording an image on a recording medium with stability by using the ink jet head described above which achieves the first object of the present invention.

It is a third object of the present invention to solve the above-mentioned problems inherent in the prior art by providing an ink jet head that is capable of achieving energy saving by reducing an ejection force required to supply ink to an ejection portion and to eject the ink from the ejection portion, shortening a delay time from exertion of an ejection force to ejection of an ink droplet having a correct size, preserving an ink meniscus with stability, and performing precise image recording through stabilized ink ejection, as well as a recording apparatus and a recording method using the ink jet head.

In order to attain the first object described above, the first aspect of the present invention provides an ink jet head for recording an image on a recording medium by ejecting ink containing charged fine particles by means of an electrostatic force, comprising: an ink guide whose tip end portion is directed toward a side of the recording medium; an ink flow path that supplies the ink to the ink guide; and an ejection electrode that comprises a surrounding electrode arranged so as to surround an outer periphery of the ink guide with a predetermined spacing, and ejects the ink guided from the ink flow path to the tip end portion of the ink guide by means of the electrostatic force, wherein a ratio between an effective inside diameter of the surrounding electrode and a distance from the surrounding electrode to a tip end of the ink guide protruding on the side of the recording medium is set in a range of 1:0.5 to 1:2.

Preferably, the ratio between the effective inside diameter of the surrounding electrode and the distance from the surrounding electrode to the tip end of the ink guide is set in a range of 1:0.7 to 1:1.7.

Preferably, the surrounding electrode is a substantially circular electrode, and the effective inside diameter is an average inside diameter, and more preferably, the surrounding electrode is a circular electrode, and the effective inside diameter is an inside diameter.

In order to attain the first object described above, the second aspect of the present invention provides an ink jet head for recording an image on a recording medium by ejecting ink containing charged fine particles by means of an electrostatic force, comprising: an ink guide whose tip end portion is directed toward a side of the recording medium; an ink flow path that supplies the ink to, the ink guide; and an ejection electrode that comprises side-by-side electrodes arranged on both sides of the ink guide so as to oppose each other with a predetermined spacing, and ejects the ink guided from the ink flow path to the tip end portion of the ink guide by means of the electrostatic force, wherein a ratio between an effective spacing between the side-by-side electrodes and a distance from the side-by-side electrodes to a tip end of the ink guide protruding on the side of the recording medium is set in a range of 1:0.7 to 1:2.8.

Preferably, the ratio between the effective spacing between the side-by-side electrodes and the distance from the side-by-side electrodes to the tip end of the ink guide is set in a range of 1:1.0 to 1:2.4.

Preferably, the side-by-side electrodes are substantially parallel electrodes, and the effective spacing is an average electrode spacing, and more preferably, the side-by-side electrodes are parallel electrodes, and the effective spacing is an electrode spacing.

In each aspect, it is preferable that the ink guide is arranged on a head substrate; the ink flow path is formed between the head substrate and an insulating substrate arranged so as to be spaced apart from the head substrate by a predetermined distance; (plural) through holes are formed in the insulating substrate; and the ink guide has the tip end portion protruding on the side of the recording medium from one of the through holes formed in the insulating substrate and guides the ink flowing in the ink flow path from the ink flow path to the tip end portion.

In order to further attain the third object described above in the first and second aspects, it is preferable that a contact angle of a surface of the ink guide in at least a portion existing in the through hole with respect to the ink is set larger than a contact angle of an inner wall surface of the through hole with respect to the ink.

Preferably, the surface of the ink guide in at least the portion existing in the through hole has ink-repellent property.

Preferably, a difference between the contact angle of the surface of the ink guide in at least the portion existing in the through hole with respect to the ink and the contact angle of the inner wall surface of the through hole with respect to the ink is set at not less than 10 degree.

Preferably, the contact angle of the surface of the ink guide in at least the portion existing in the through hole with respect to the ink is set at not less than 20 degree.

Preferably, the ink contains charged fine particles which are dispersed in a solvent, and the ejection electrode is provided on a side of the insulating substrate in the ink flow path.

Preferably, the ink glide in at least the portion existing in the through hole is configured with a ink-repellent member, and the surface of the ink guide in at least the portion existing in the through hole is processed with a ink repellent material. Preferably, the tip end portion of the ink guide protrudes from the insulating substrate. Preferably, the tip end portion of the ink guide has an affinity for the ink.

Preferably, the ejection electrode is arranged on the insulating substrate.

Preferably, the ejection electrode comprises: a first drive electrode arranged closer to a side of the insulating substrate than the ink flow path and a second drive electrode arranged closer to a side of the head substrate than the first drive electrode. Preferably, the first drive electrode is arranged on one surface of the insulating substrate in the side of the recording medium, and the second drive electrode is arranged on another surface of the insulating substrate in the side of the head substrate. Preferably, the second drive electrode is a common electrode to be common among all (plural) first drive electrodes.

Preferably, two or more (plural) individual electrodes each of which comprises the ink guide, the through hole, the first drive electrode and the second drive electrode are arranged in a two-dimensional manner along a first direction and a second direction perpendicular to the first direction, and first drive electrodes of the two or more individual electrodes are wired and connected to each other along the first direction and second drive electrodes of the two or more individual electrodes are wired and connected to each other along the second direction.

It is preferable that the ink jet head further comprises: a floating conduction plate that is provided to be common with respect to all (plural) ejection electrodes, and arranged closer to a side of the head substrate than the ink flow path. It is preferable that the ink jet head further comprises: a guard electrode which is provided between adjacent ejection electrodes and suppresses electric field interferences occurring between the adjacent ejection electrodes. It is preferable that the ink jet head further comprises: a shield electrode that is provided to be common with respect to all (plural) ejection electrodes, and arranged closer to a side of the ink flow path than the ejection electrode.

In order to attain the second object described above, the third aspect of the present invention provides an ink jet recording apparatus, comprising the respective ink jet head described above, wherein the image is recorded on the recording medium using the respective ink jet head described above.

In order to attain the second object described above, the third aspect of the present invention provides an ink jet recording apparatus, comprising: the respective ink jet head described above; means for holding the recording medium; means for relatively moving the ink jet head and the recording medium; means for applying a predetermined bias voltage between the ejection electrode and the recording medium; and means for applying a predetermined ejection voltage to the ejection electrode in accordance with the image to be recorded on the recording medium.

In order to attain the second object described above, the forth aspect of the present invention provides an ink jet recording method for recording an image on a recording medium, comprising: applying a predetermined bias voltage between the recording medium and the ejection electrode of the respective ink jet head described; moving the ink jet head relative to the recording medium; applying a predetermined ejection voltage to the ejection electrode in accordance with the image to be recorded on the recording medium; and ejecting the ink concentrated in a tip end portion of the ink guide of the ink jet head.

The present invention provides a recording method, comprising: ejecting ink in an ink flow path, which is formed between an insulating substrate having at least one through hole and a head substrate provided so as to be spaced apart from the insulating substrate by a predetermined spacing, through the through hole; and thereby recording an image on a recording medium, wherein the ink to be ejected is guided by an ink guide that is inserted into the through hole and has an ink-repellent surface in at least a portion existing in the through hole.

In order to attain the third object described above, the fifth aspect of the present invention provides an ink jet head, comprising: an ejection port plate having at least one ink ejection port; a substrate that is provided so as to be spaced apart from the ejection port plate by a predetermined distance and forms an ink chamber between the substrate and the ejection port plate; a structural member inserted into the ink ejection port; and ink ejection means for ejecting ink, wherein a contact angle of a surface of the structural member in at least a portion existing in the ink ejection port with respect to the ink is set larger than a contact angle of an inner wall surface of the ink ejection port with respect to the ink.

Preferably, the surface of the structural member in at least the portion existing in the ink ejection port is made ink-repellent.

Preferably, a difference between the contact angle of the surface of the structural member in at least the portion existing in the ink ejection port with respect to the ink and the contact angle of the inner wall surface of the ink ejection port with respect to the ink is set at 10° or larger.

Preferably, the contact angle of the surface of the structural member in at least the portion existing in the ink ejection port with respect to the ink is set at 20° or larger.

Preferably, the structural member in at least the portion existing in the ink ejection port is configured with a ink-repellent member, and the surface of the structural member in at least the portion existing in the ink ejection port is processed with a ink repellent material. Preferably, the tip end portion of the structural member protrudes from the ejection port plate. Preferably, the tip end portion of the structural member has an affinity for the ink.

It is preferable that the ink comprises charged fine particles dispersed in a solvent; and the ejection means comprises an ejection electrode provided on a side of the ejection port plate in the ink chamber.

In order to attain the third object described above, the sixth aspect of the present invention provides an ink jet recording apparatus, comprising the ink jet head according to any one of the fifth aspect of the present invention, wherein the image is recorded on the recording medium using the respective ink jet head described above.

In order to attain the third object described above, the sixth aspect of the present invention provides a recording method for recording an image on a recording medium, comprising ejecting ink in an ink chamber, which is formed between an ejection port plate having at least one ink ejection port and a substrate provided so as to be spaced apart from the ejection port plate by a predetermined distance, through the ink ejection port, wherein the ink to be ejected is guided by a structural member that is inserted into the ink ejection port and has an ink-repellent surface in at least a portion existing in the ink ejection port.

DETAILED DESCRIPTION OF THE PREFERRED EMBODIMENTS

An ink jet head according to the present invention, and a recording apparatus and a recording method using the ink jet head will now be described in detail based on preferred embodiments with reference to the accompanying drawings.

First, an electrostatic ink jet head according to first and second aspects of the present invention, an electrostatic ink jet recording apparatus according to a third aspect, and an electrostatic ink jet recording method according to a fourth aspect will be described with reference to FIGS. 1 to 15.

Figure 1:
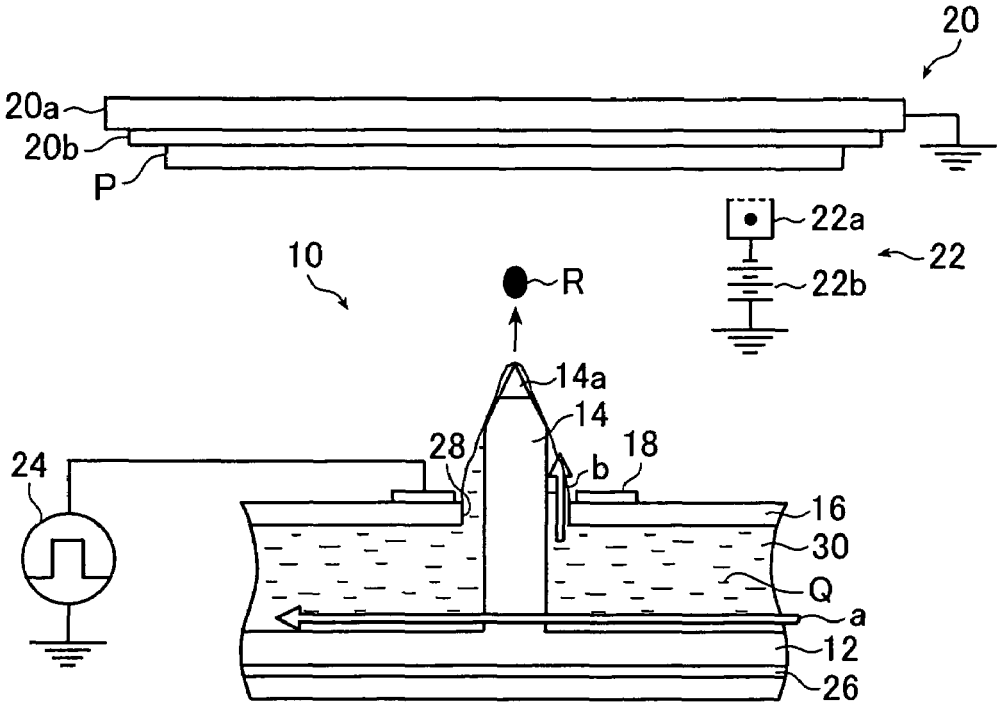
FIG. 1 is a schematic cross-sectional view showing an outlined construction of an embodiment of an electrostatic ink jet head according to the present invention.

FIG. 1 is a schematic cross-sectional view showing an outlined construction of an embodiment of the ink jet head according to the first and second aspects of the present invention.

An ink jet head 10 shown in FIG. 1 is an electrostatic ink jet head and used for recording an image on a recording medium P in accordance with image data by ejecting ink Q containing charged fine particle component like pigments (toner, for instance) by means of an electrostatic force. For that purpose, the ink jet head 10 shown in FIG. 1 includes a head substrate 12, an ink guide 14, an insulating substrate 16, an ejection electrode 18, a counter electrode 20 supporting the recording medium P, an charge unit 22 for charging the recording medium P, a signal voltage source 24, and a floating conduction plate 26.

It should be noted here that in the example shown in FIG. 1, only one individual electrode serving as an ejection means constituting the ink jet head 10 is conceptually illustrated. The number of individual electrodes provided in the ink jet head 10 is not specifically limited so long as at least one individual electrode is provided. Also, no limitation is imposed on physical arrangement and the like of the individual electrodes. For instance, it is also possible to construct a line head by one-dimensionally or two-dimensionally arranging multiple individual electrodes. Also, the ink jet head to which the present invention is applied is applicable to both of monochrome recording and color recording.

In the ink jet head 10 of the illustrated example, the ink guide 14 is made of an insulating resin flat plate having a predetermined thickness and including a protrusion-like tip end portion 14*a*, and is arranged on the head substrate 12 for each individual electrode. Also, a through hole 28 is formed in the insulating substrate 16 at a position corresponding to a position at which the ink guide 14 is arranged. The ink guide 14 passes through the through hole 28 formed in the insulating substrate 16 and its tip end portion 14*a* protrudes upward from the upper surface of the insulating substrate 16 in the drawing, that is, from a surface thereof on the recording medium P side. Note that a slit serving as an ink guide groove that guides the ink Q into the tip end portion 14*a* by capillary action may be formed in a center portion of the ink guide 14 in a vertical direction in the drawing.

It should be noted here that the tip end portion 14*a* side of the ink guide 14 is formed to gradually taper into a substantially triangular shape (or a substantially trapezoidal shape) toward the counter electrode 20 side. Here, it is preferable that a metal has been vapor-deposited on the tip end portion (extreme tip end portion) 14*a* of the ink guide 14 from which the ink Q is to be ejected. Although it is not always necessary to carry out the metal vapor-deposition for the tip end portion 14*a* of the ink guide 14, it is preferable that the metal vapor-deposition is conducted because the effective dielectric constant of the tip end portion 14*a* of the ink guide 14 becomes large as a result of the metal vapor-deposition and an effect of easily generating a strong electric field is obtained. Also, the shape of the ink guide 14 is not specifically limited so long as it is possible to concentrate the ink Q, in particular, the charged fine particle component in the ink Q in the tip end portion 14*a* through the through hole 28 in the insulating substrate 16. For instance, the shape of the tip end portion 14*a* may be changed as appropriate into a shape other than the protrusion, such as a conventionally known shape disclosed in JP 10-138493 A described above or the like.

The head substrate 12 and the insulating substrate 16 are arranged so as to be spaced apart from each other by a predetermined distance and an ink flow path 30 functioning as an ink reservoir (ink chamber) for supplying the ink Q to the ink guide 14 is formed between the head substrate 12 and the insulating substrate 16. Note that the ink Q in the ink flow path 30 contains fine particle component charged to the same polarity as the voltage applied to the ejection electrode 18, and is circulated by a not-shown ink circulation mechanism in a predetermined direction (from the right to the left, in the illustrated example) in the ink flow path 30 at a predetermined speed (ink flow rate of 200 mm/s, for instance) at the time of recording. Hereinafter, a case where color particles in the ink are positively charged will be described as an example.

Figure 2A:
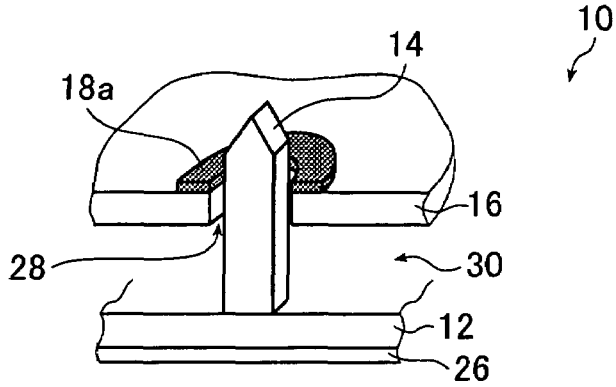
FIG. 2A is a schematic perspective view showing an outlined construction of an embodiment of an individual electrode of the electrostatic ink jet head according to the present invention.

Also, as shown in FIG. 2A, the ejection electrode 18 is arranged in a ring shape, that is, as a circular electrode 18*a* for each individual electrode on the upper surface of the insulating substrate 16 in the drawing, that is, on a surface thereof on a recording medium P side so as to surround the through hole 28 formed in the insulating substrate 16. The ejection electrode 18 is connected to the signal voltage source 24 that generates a pulse signal (predetermined pulse voltage) corresponding to ejection data (ejection signal) such as image data or print data. For instance, the signal voltage source 24 generates a pulse signal of 0 V at a low-voltage level and generates a pulse signal of 400 to 600 V at a high-voltage level.

It should be noted here that the ejection electrode 18 is not limited to the ring-like circular electrode 18*a* shown in FIG. 2A. That is, no specific limitation is imposed on the ejection electrode 18 so long as the electrode is a surrounding electrode arranged so as to surround the outer periphery of the ink guide 14 with a distance or side-by-side electrodes arranged at both sides of the ink guide 14 so as to oppose each other with a distance. In the case of the surrounding electrode, the ejection electrode 18 is preferably a substantially circular electrode, more preferably a circular electrode as shown in FIG. 2A. On the other hand, in the case of the side-by-side electrodes, the ejection electrodes 18 are preferably substantially parallel electrodes, more preferably parallel electrodes 18*b* shown in FIG. 3A. Note that as the side-by-side electrodes, parallel electrodes or substantially parallel electrodes shown in FIGS. 3C and 3D to be described later may be used.

The following description will be made by taking the ring-like circular electrode 18*a* shown in FIG. 2A as a representative example of the surrounding electrode and taking the parallel electrode 18*b* shown in FIG. 3A and the parallel electrodes 34*a* and 34*b* shown in FIG. 3C as a representative example of the side-by-side electrodes.

The counter electrode 20 is arranged at a position opposing the tip end portion 14*a* of the ink guide 14 and includes a grounded electrode substrate 20*a* and an insulation sheet 20*b* arranged on the lower surface of the electrode substrate 20*a* in the drawing, that is, on a surface thereof on the ink guide 14 side. Also, the recording medium P is supported by the lower surface of the counter electrode 20 in the drawing, that is, on a surface thereof on the ink guide 14 side, in other words, on a surface of the insulation sheet 20*b*, and is electrostatically adsorbed on the surface. The counter electrode 20 (insulation sheet 20*b*) functions as a platen of the recording medium P.

Here, at least at the time of recording, the surface of the insulating sheet 20*b* of the counter electrode 20, that is, the recording medium P is charged by the charge unit 22 to a predetermined negative high voltage (−1.5 kV, for instance) having a polarity opposite to the high voltage (pulse voltage) applied to the ejection electrode 18. As a result of the negative charged by the charge unit 22, the recording medium P is constantly biased to the negative high voltage with respect to the ejection electrode 18 and is electrostatically adsorbed on the insulation sheet 20*b* of the counter electrode 20.

Here, the charge unit 22 includes a scorotron charger 22*a* that charges the recording medium P to the negative high voltage and a bias voltage source 22*b* that supplies the negative high voltage to the scorotron charger 22*a*. Note that the charge means of the charge unit 22 used in the present invention is not limited to the scorotron charger 22*a* and it is also possible to use various other discharge means such as a corotron charger, a solid charger, and a discharge needle.

It should be noted here that in the illustrated example, the counter electrode 20 includes the electrode substrate 20*a* and the insulation sheet 20*b*, and the recording medium P is charged to the negative high voltage by the charge unit 22 and is electrostatically adsorbed on the surface of the insulation sheet 20*b*. However, the present invention is not limited to this and the counter electrode 20 may be constructed only using the electrode substrate 20*a*. In this case, the counter electrode 20 (electrode substrate 20*a* itself) is connected to a negative high-voltage bias voltage source and is constantly biased to a negative high voltage, thereby having the recording medium P electrostatically adsorbed on the surface of the counter electrode 20.

Also, the electrostatic adsorption of the recording medium P on the counter electrode 20 and the charge of the recording medium P to the negative high voltage (or the application of the negative bias high voltage to the counter electrode 20) may be performed using different negative high-voltage sources. Further, the supporting of the recording medium P by the counter electrode 20 is not limited to the electrostatic adsorption of the recording medium P and another supporting method or supporting means may be used.

The floating conduction plate 26 is arranged below the ink flow path 30 and is electrically insulated (in high-impedance state). In the illustrated example, the floating conduction plate 26 is arranged inside the head substrate 12, although the present invention is not limited to this and the position of the floating conduction plate 26 may be changed so long as this plate 26 is arranged below the ink flow path 30. For instance, the floating conduction plate 26 may be arranged below the head substrate 12 or arranged inside the head substrate 12 on an upstream side of the ink flow path 30 with respect to the position of the individual electrode.

At the time of recording of an image, the floating conduction plate 26 generates an induced voltage in accordance with the value of a voltage applied to the individual electrode and causes the fine particle component in the ink Q in the ink flow path 30 to migrate to the insulating substrate 16 side and to be concentrated. Consequently, it is required that the floating conduction plate 26 is arranged on the head substrate 12 side with respect to the ink flow path 30. Also, it is preferable that the floating conduction plate 26 is arranged on an upstream side of the ink flow path 30 with respect to the position of the individual electrode. With this floating conduction plate 26, the concentration of the charged fine particle component in an upper layer in the ink flow path 30 is increased. As a result, it becomes possible to increase the concentration of the charged fine particle component in the ink Q passing through the through hole 28 of the insulating substrate 16 to a predetermined level, to cause the charged fine particle component to be concentrated in the tip end portion 14*a* of the ink guide 14, and to maintain the concentration of the charged fine particle component in the ink Q ejected as an ink droplet R at a predetermined level.

Also, the induced voltage generated by the floating conduction plate changes in accordance with the number of operating channels, so that even if a voltage to the floating conduction plate is not controlled, charged particles required for ejection is supplied, which makes it possible to prevent clogging. Note that a power source may be connected to the floating conduction plate and a predetermined voltage may be applied thereto.

Next, another embodiment of the electrostatic ink jet head in which side-by-side electrodes represented by parallel electrodes are used, will be described with reference to FIGS. 3C and 3D.

Figure 3A:
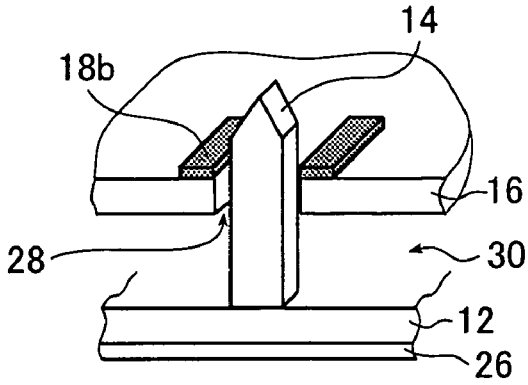
FIG. 3A is a schematic perspective view showing an outlined construction of another embodiment of the individual electrode of the electrostatic ink jet head according to the present invention.
Figure 3B:
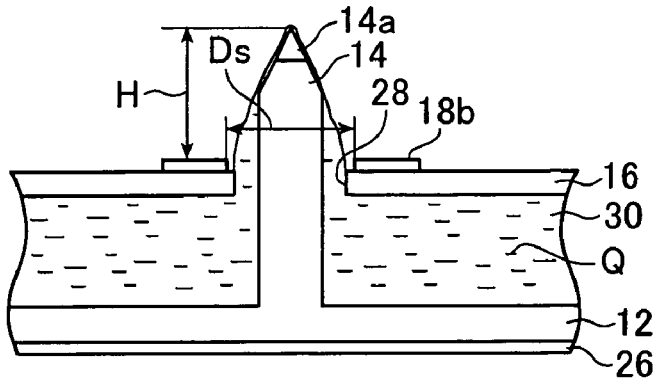
FIG. 3B is a schematic cross-sectional view of FIG. 3A.
Figure 3C:
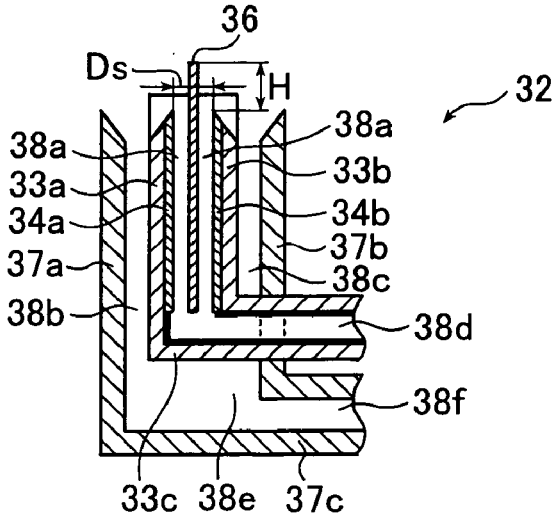
FIG. 3C is a schematic horizontal cross-sectional view showing an outlined construction of still another embodiment of the individual electrode of the electrostatic ink jet head according to the present invention.
Figure 3D:
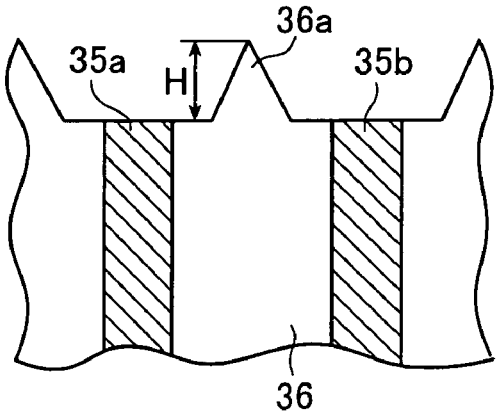
FIG. 3D is a schematic partial vertical cross-sectional view of FIG. 3C.

An electrostatic ink jet head 32 shown in FIGS. 3C and 3D includes insulating supporting substrates 33*a* and 33*b* arranged so as to oppose each other with a predetermined distance, parallel electrodes 34*a* and 34*b* that are respectively supported on the inner surfaces of the insulating supporting substrates 33*a* and 33*b*, partition walls 35*a* and 35*b* arranged on both sides in a direction orthogonal to the direction in which the insulating supporting substrates 33*a* and 33*b* oppose each other, an ink guide 36 supported by the partition walls 35*a* and 35*b* and arranged in parallel between the parallel electrodes 34*a* and 34*b*, outer wall plates 37*a* and 37*b* respectively arranged so as to be spaced apart from the outer surfaces of the insulating supporting substrates 33*a* and 33*b* by a predetermined distance, and an ink flow path 38 including an ink supply path 38*a* formed between the partition walls 35*a* and 35*b*, the parallel electrodes 34*a* and 34*b*, and the insulating supporting substrates 33*a* and 33*b* and ink recovery paths 38*b* and 38*c* formed between the insulating supporting substrates 33*a* and 33*b* and the outer wall plates 37*a* and 37*b*.

End surfaces (lower end surfaces in the drawing) of the insulating supporting substrates 33*a* and 33*b* on one side are connected to an insulating supporting substrate 33*c* and end surfaces (upper end surfaces in the drawing) thereof on the other side are opened. Accordingly, an end surface (lower end surface in the drawing) of the ink supply path 38*a* on one side is closed by the insulating supporting substrate 33*c* and a supply port 38*d* communicating with an external ink circulation path is arranged in proximity to the closed end. Also, end surfaces (lower end surfaces in the drawing) of the outer wall plates 37*a* and 37*b* on one side are connected to an external wall plate 37*c* and are closed, and end surfaces (upper end surfaces in the drawing) thereof on the other side are opened. Accordingly, the ink recovery paths 38*b* and 38*c* communicate with an ink recovery path 38*e* formed between the insulating supporting substrate 33*c* and the outer wall plate 37*c*, and the ink recovery path 38*e* is connected to a recovery port 38*f* communicating with an external ink circulation path.

The ink guide 36 divides the ink supply path 38*a* into two portions and is made of an insulating resin flat plate or film having a predetermined thickness and including a protrusion-like tip end portion 36*a* protruding from the opened ends of the insulating supporting substrates 33*a* and 33*b*, that is, from the opened ends of the parallel electrodes 34*a* and 34*b*, in other words, from the opened end of the ink supply path 38*a*. Also, both sides of ink guide 36 are supported by the partition walls 35*a* and 35*b*. Like the tip end portion 14*a* of the ink guide 14 shown in FIG. 3A, the tip end portion 36*a* of the ink guide 36 gradually tapers into a substantially triangular shape (or a substantially trapezoidal shape) toward a not-shown recording medium side.

After being supplied to the ink supply path 38*a* from the external ink circulation path through the supply port 38*d*, the ink moves toward the opened ends by capillary action or the like in the ink supply path 38*a* divided into two portions by the ink guide 36, and moves upward along the ink guide 36 in the drawing. A part of the ink moved upward aggregates in the tip end portion 36*a* of the ink guide 36 and the charged fine particle component in the ink is concentrated. On the other hand, the remaining ink overflows from the insulating supporting substrates 33*a* and 33*b*, and flows into the ink recovery paths 38*b* and 38*c*, and two streams merge with each other in the ink recovery path 38*e*, and the ink is recovered to the external ink circulation path through the recovery port 38*f*.

The ink in the tip end portion 36*a* of the ink guide 36, in which the charged fine particle component is concentrated, is caused to fly toward the not-shown recording medium as an ink droplet through application of predetermined pulse voltages to the parallel electrodes 34*a* and 34*b*.

Figure 2B:
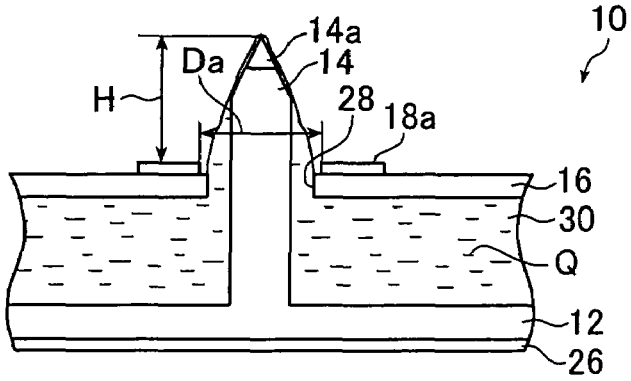
FIG. 2B is a schematic cross-sectional view of FIG. 2A.

By the way, in the present invention, when the ejection electrode 18 is a surrounding electrode represented by the ring-like circular electrode 18*a* shown in FIG. 2A, it is required that, as shown in FIG. 2B, a ratio (Da:H) between an inside diameter Da of the surrounding electrode (circular electrode) 18*a* and a distance from the ejection electrode (surrounding electrode) 18 to the tip end of the ink guide 14 protruding on the recording medium P side, that is, a distance H from the surface of the circular electrode 18*a* to the tip end portion 14*a* of the ink guide 14 is set in a range of 1:0.5 to 1:2, preferably in a range of 1:0.7 to 1:1.7. Here, in the case of a surrounding electrode, such as a substantially circular electrode whose inside diameter is not constant, an effective inside diameter (such as an average inside diameter) that can be regarded as a substantial inside diameter need only be used as the inside diameter Da.

Also, in the present invention, when the side-by-side electrodes represented by the parallel electrodes 18*b* shown in FIG. 3A or the parallel electrodes 34*a* and 34*b* shown in FIGS. 3C and 3D are used as the ejection electrode 18, it is required that, as shown in FIG. 3B or 3C, a ratio (Ds:H) between a distance Ds between the parallel electrodes 18*b* or a distance Ds between the parallel electrodes 34*a* and 34*b* and a distance from the ejection electrode (side-by-side electrodes) 18 to the tip end of the ink guide 14 protruding on the recording medium P side, that is, a distance H from the surface of the parallel electrodes 18*b* or from the opened end surfaces of the parallel electrodes 34*a* and 34*b* to the tip end portion 14*a* of the ink guide 14 is set in a range of 1:0.7 to 1:2.8, preferably in a range of 1:1.0 to 1:2.4. Here, in the case of side-by-side electrodes, such as substantially parallel electrodes with a distance therebetween that is not constant, an effective distance (such as an average distance) that can be regarded as a substantial distance need only be used as the distance Ds.

Here, in the present invention, the inventor of the present invention measured an electric field strength (V/m) at an ejection portion, that is, at the tip end portion 14*a* of the ink guide 14 by changing the distance H between the surface of the ejection electrode 18 and the tip end portion 14*a* of the ink guide 14, that is, a protrusion amount (hereinafter referred to as the "projection amount") H of the tip end portion 14*a* of the ink guide 14 using a real model shown in FIG. 4 where the ink guide 14 is mounted on the floating conduction plate 26, the ejection electrode 18 is arranged around the ink guide 14, and the counter electrode 20 is arranged so as to oppose the tip end portion 14*a* of the ink guide 14. Also, the distance between the floating conduction plate 26 and the ejection electrode 18 and the distance between the ejection electrode 18 and the counter electrode 20 are both set at 500 μm, the floating conduction plate 26 comes into an insulation state (high-impedance state), the counter electrode 20 is applied with a negative high voltage of −1500 V as a bias voltage, and the ejection electrode 18 is applied with an ejection voltage of +400 V. Further, a circular electrode 18*a* having an inside diameter (Da) of 200 μm is used as the ejection electrode 18 and the projection amount H is changed from 75 μm to 250 μm. Note that the application of the negative bias high voltage of −1500 V to the counter electrode 20 is the equivalent of the negative high voltage charge to −1500 V of the recording medium P electrostatically adsorbed on the counter electrode 20.

Figure 5:
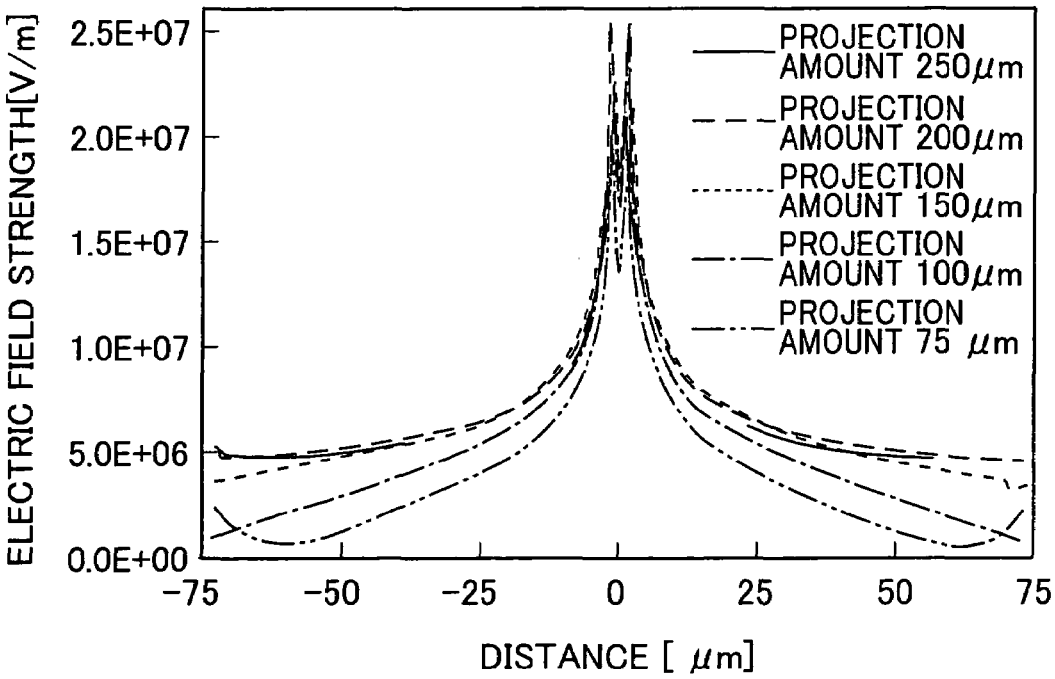
FIG. 5 is a graph showing a relationship between an electric field strength and a distance from a center of a tip end of an ink guide in the real model shown in FIG. 4.

Results of this measurement are shown in FIG. 5.

Here, although not illustrated, the ink guide 14 is produced using ceramic (dielectric constant $\epsilon$=20) so as to have a tip end angle of 45° and a thickness of 75 μm. The horizontal axis in FIG. 5 represents a distance from the center of the tip end portion 14*a* of the ink guide 14 along sloped lines indicated by arrows c shown in FIG. 4.

It can be seen from FIG. 5 that when the projection amount H of the ink guide 14 is set at 200 μm, the electric field strength exceeds $2.5\times10^{+7}$ V/m and becomes maximum. That is, it can be seen from FIG. 5 that it is possible to obtain an optimum projection amount H of the ink guide 14 by changing the projection amount H while setting the inside diameter of the circular electrode 18*a* constant. In the case of the circular electrode 18*a*, when the ratio between the projection amount H and the inside diameter Da is set at around 1.0, the electric field strength becomes maximum.

Figure 4:
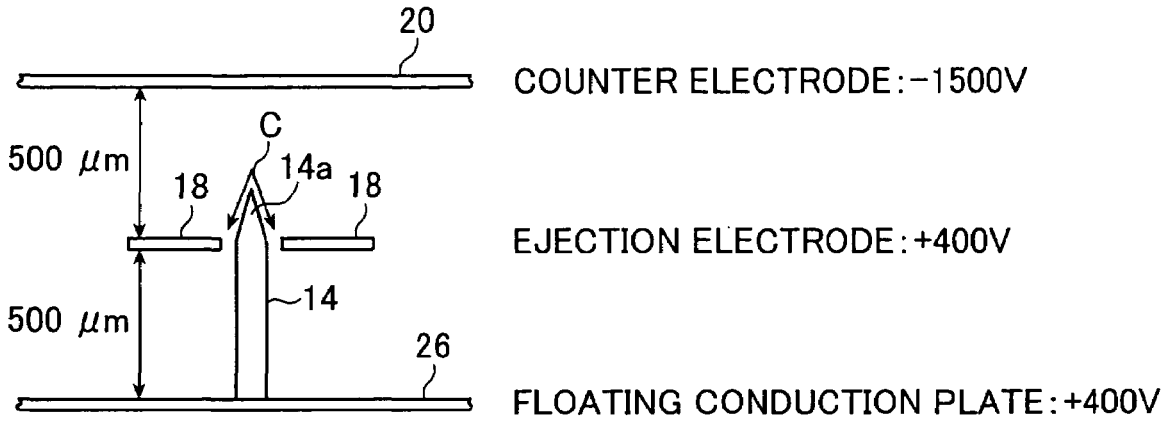
FIG. 4 is a conceptual diagram showing a real model of the individual electrode of the electrostatic ink jet head according to the present invention.

This result indicates that in the case of the circular electrode 18 shown in FIG. 4, if the electric field strength, with which it is possible to perform ink ejection with reliability and stability, is equal to or lower than the maximum electric field strength shown in FIG. 5, it is possible to reduce an application voltage to the circular electrode 18.

Therefore, the inventor of the present invention obtained a pulse voltage (lowest ejection voltage) required to perform ink ejection with reliability and stability for each predetermined projection amount H by changing the pulse voltage (ejection voltage) applied to the circular electrode 18*a* using the same condition as in the case of FIG. 5 except that a circular electrode 18*a* having an inside diameter of 150 μm is used as the ejection electrode 18 and the projection amount H is changed from 50 μm to 330 μm in the ejection structure (individual electrode structure) shown in FIG. 4.

Figure 6A:
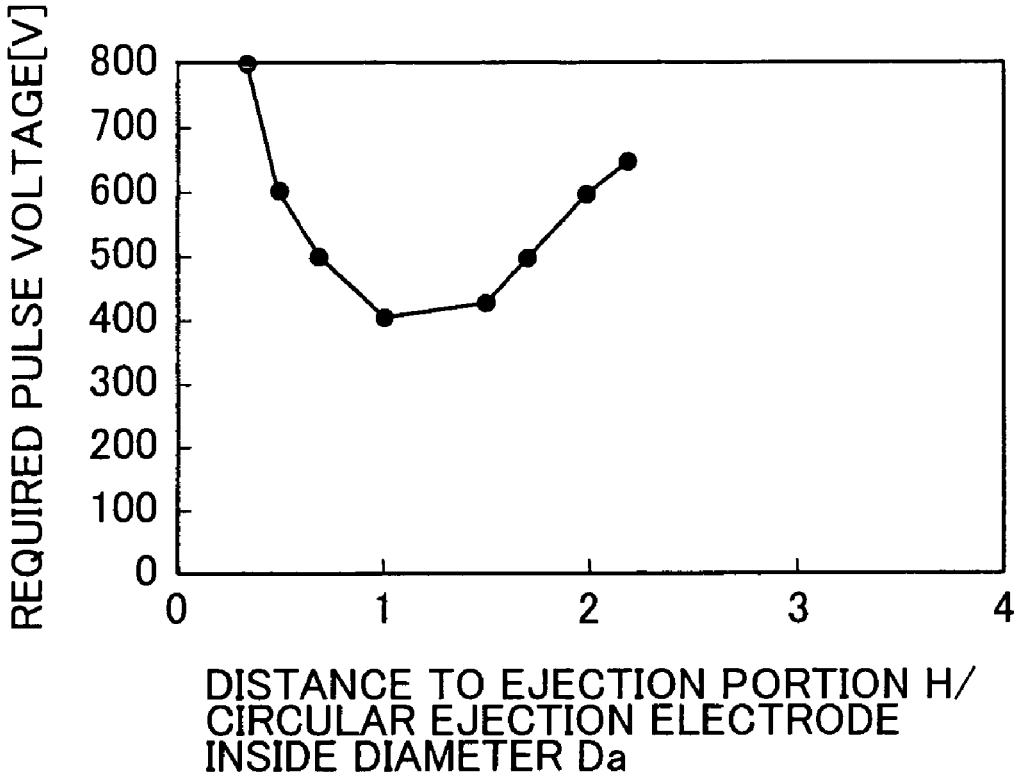
FIG. 6A is a graph showing a relationship between a required pulse voltage and a ratio between a distance to an ejection portion and a circular ejection electrode inside diameter in the real model shown in FIG. 4.

Results of this experiment are shown in FIG. 6A.

It can be seen from FIG. 6A that when the ratio (H/Da) between the distance (projection amount) H to the ejection portion and the circular ejection electrode inside diameter Da is set at 1.0, even if a metallic film or the like is not formed for the tip end portion 14*a* of the ink guide 14, the required pulse voltage is minimized to 400 V. This required pulse voltage is increased when the ratio (H/Da) is decreased or increased from 1.0.

By the way, in the present invention, the ratio (H/Da) between the distance H to the ejection portion and the circular ejection electrode inside diameter Da is set in a range of 0.5 to 2. This is because in the electrostatic ink jet head, when consideration is given to a withstand voltage and the like of a semiconductor device such as an IC constituting a drive circuit that drives each individual electrode, safety, the individual electrode structure, current consumption, and the like, the upper limit of the pulse voltage applicable to the ejection electrode 18 becomes around 600 V. As can be seen from FIG. 6A, unless the voltage value falls within the limited range described above, the required pulse voltage exceeds 600 V. Note that it is preferable that the ratio (H/Da) is set in a range of 0.7 to 1.7. In this case, it becomes possible to further reduce the pulse voltage applied to the ejection electrode 18 to 500 V.

Figure 6B:
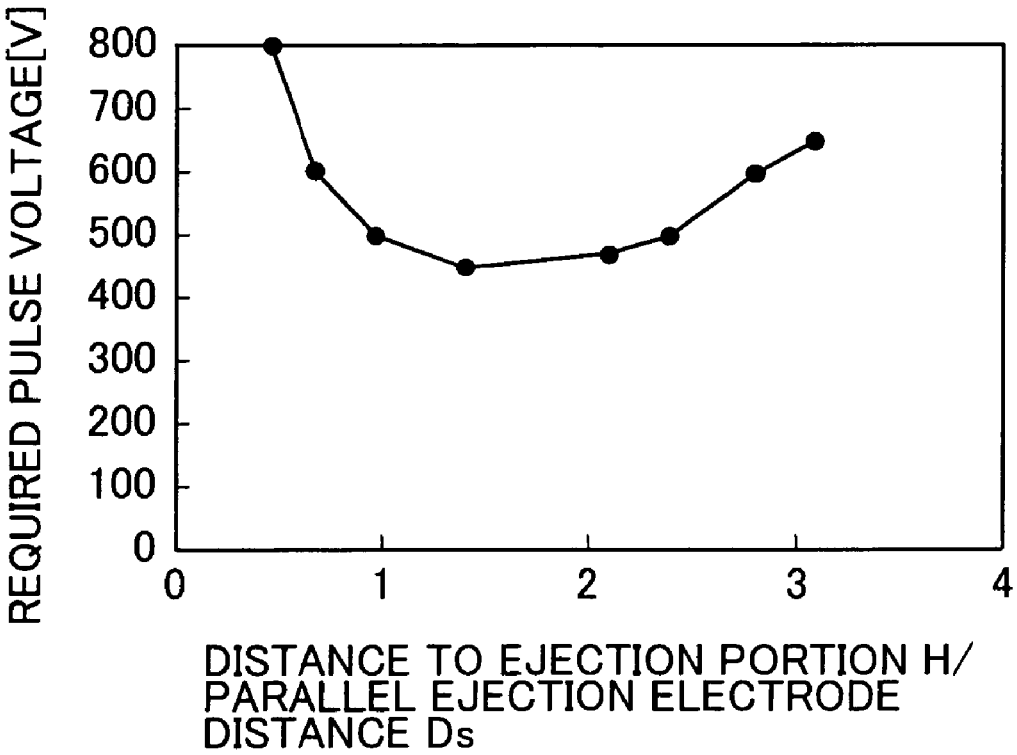
FIG. 6B is a graph showing a relationship between a required pulse voltage and a ratio between the distance to the ejection portion and a parallel ejection electrode distance in the real model shown in FIG. 4.

Also, results obtained by using the parallel electrodes 18*b* as the ejection electrode 18 in place of the circular electrode 18*a* are shown in FIG. 6B.

It can be seen from FIG. 6B that when the ratio (H/Ds) between the distance (projection amount) H to the ejection portion and the parallel ejection electrode distance Ds is set at 1.4, even if a metallic film or the like is not formed for the tip end portion 14*a* of the ink guide 14, the required pulse voltage is minimized to 450 V. This required pulse voltage is increased when the ratio (H/Ds) is decreased or increased.

By the way, in the present invention, the ratio (H/Ds) between the distance H to the ejection portion and the parallel ejection electrode distance Ds is set in a range of 0.7 to 2.8. This is because in the electrostatic ink jet head, when consideration is given to a withstand voltage and the like of a semiconductor device such as an IC constituting a drive circuit that drives each individual electrode, safety, the individual electrode structure, current consumption, and the like, the upper limit of the pulse voltage applicable to the ejection voltage 18 becomes around 600 V. As can be seen from FIG. 6B, when the limit range described above is exceeded, the required pulse voltage exceeds 600 V. Note that it is preferable that the ratio (H/Ds) is set in a range of 1.0 to 2.4. In this case, it becomes possible to further reduce the pulse voltage applied to the ejection electrode 18 to 500 V.

As described above, in the present invention, the ratio between the distance to the ejection portion and the circular ejection electrode inside diameter or the parallel ejection electrode distance is set in the appropriate range described above. As a result, it becomes possible to achieve a reduction in the ejection voltage, to widen the choice of ink guide materials (low dielectric constant material becomes usable, for instance), and to widen the choice of ink guide tip end structures.

The ink jet head according to the present invention is basically constructed in the manner described above. Next, an operation of the ink jet head of the present invention will be described by taking, as a representative example, an operation of the ink jet head 10 shown in FIG. 1.

In the ink jet head 10 shown in FIG. 1, at the time of recording, the ink Q containing the fine particle component charged to the same polarity as that of the voltage applied to the ejection electrode 18 (positive (+), for instance) is circulated by a not-shown ink circulation mechanism including a pump and the like in the ink flow path 30 in a direction of an arrow "a" in FIG. 1, that is, in a direction from the right to the left. When doing so, the recording medium P electrostatically adsorbed on the counter electrode 20 is charged to a reversed polarity, that is, to a negative high voltage (−1500 V, for instance). Also, the floating conduction plate 26 comes into an insulation state (high-impedance state).

Here, when no pulse voltage is applied to the ejection electrode 18 or when the pulse voltage applied to the ejection electrode 18 is set at a low voltage level (0 V), a voltage (potential difference) between the ejection electrode 18 and the counter electrode 20 (recording medium P) becomes equal to a bias voltage (1500 V, for instance) and the electric field strength in proximity to the tip end portion 14*a* of the ink guide 14 becomes low. Consequently, the ink Q will not fly out from the tip end portion 14*a* of the ink guide 14, that is, will not be ejected as the ink droplet R. Under this state, however, a part of the ink Q in the ink flow path 30, in particular, the charged fine particle component contained in the ink Q moves upward in a direction of an arrow "b" in FIG. 1, that is, in a direction from the lower side of the insulating substrate 16 to the upper side thereof while passing through the through hole 28 in the insulating substrate 16 by migration action, capillary action, or the like and is supplied to the tip end portion 14*a* of the ink guide 14.

On the other hand, when a pulse voltage at a high voltage level (400 to 600 V, for instance) is applied to the ejection electrode 18, a voltage (400 to 600 V, for instance) that is equal to the applied pulse voltage is superimposed on the bias voltage (1500 V, for instance). Therefore, the voltage (potential difference) between the ejection electrode 18 and the counter electrode 20 (recording medium P) is increased and becomes 1900 V to 2100 V, and the electric field strength in proximity to the tip end portion 14*a* of the ink guide 14 is also increased. Under this state, the ink Q moved upward along the ink guide 14 to the tip end portion 14*a* above the insulating substrate 16, in particular, the charged fine particle component concentrated in the ink Q flies out from the tip end portion 14*a* of the ink guide 14 as the ink droplet R containing the charged fine particle component by means of an electrostatic force, is attracted by the counter electrode 20 (recording medium P) biased to the negative high voltage (−1500 V, for instance), and adheres on the recording medium P.

Here, in the present invention, the ratio (H/Da) between the projection amount H of the tip end portion 14*a* of the ink guide 14 and the inside diameter Da of the ejection electrode 18 (circular electrode 18*a*) is set in the appropriate range of 0.5 to 2. Also, the ratio (H/Ds) between the projection amount H and the distance Ds between the ejection electrodes 18 (parallel electrodes 18*b*) is set in the appropriate range of 0.7 to 2.8. Therefore, it becomes possible to achieve reliable and stabilized ink ejection even if the pulse voltage applied to the ejection electrode 18 is reduced to around 600 V or lower.

By ejecting the ink in this manner in accordance with image data and forming dots on the recording medium P while relatively moving the ink jet head 10 and the recording medium P supported on the counter electrode 20, an image corresponding to the image data can be recorded on the recording medium P.

It should be noted here that in the ink jet head 10 described above, the ejection electrode 18, such as the circular electrode 18*a* or the parallel electrodes 18*b*, forming a single-layered electrode structure is arranged on the upper surface of the insulating substrate 16 in the drawing. However, the present invention is not limited to this and a two-layered electrode structure may be adopted in which ejection electrodes 18 are arranged on the upper surface and the lower surface of the insulating substrate 16.

Figure 7A:
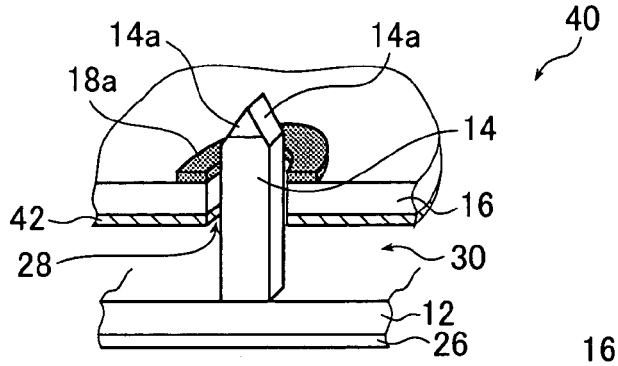
FIG. 7A is a schematic perspective view showing an outlined construction of another embodiment of the individual electrode of the electrostatic ink jet head according to the present invention.

FIG. 7A shows the outline of an electrostatic ink jet head 40 according to another embodiment of the present invention where a two-layered electrode structure is formed by ejection electrodes.

The ink jet head 40 shown in FIG. 7A has the same construction as the ink jet head 10 shown in FIG. 2A except that a second drive electrode 42 is provided on the lower surface of an insulating substrate 16 in the drawing. Therefore, the same construction elements are given the same reference numerals and are not described in this embodiment. That is, differences will be mainly described in this embodiment.

In the ink jet head 40 shown in FIG. 7A, an ejection electrode 18 has a two-layered electrode structure where a circular electrode (hereinafter referred to as the "first drive electrode") 18*a* is arranged on the upper surface of the insulating substrate 16 in the drawing and the second drive electrode 42 is arranged on the lower surface of the insulating substrate 16. Here, the first drive electrode 18*a* is provided in a ring shape for each individual electrode on the upper surface of the insulating substrate 16 so as to surround a through hole 28 formed in the insulating substrate 16. On the other hand, the second drive electrode 42 is provided in a sheet manner so as to be common among all individual electrodes on the lower surface of the insulating substrate 16 except for each region in which the through hole 28 is formed in the insulating substrate 16. Also, the second drive electrode 42 is constantly biased to a high voltage at the time of recording.

Figure 7B:
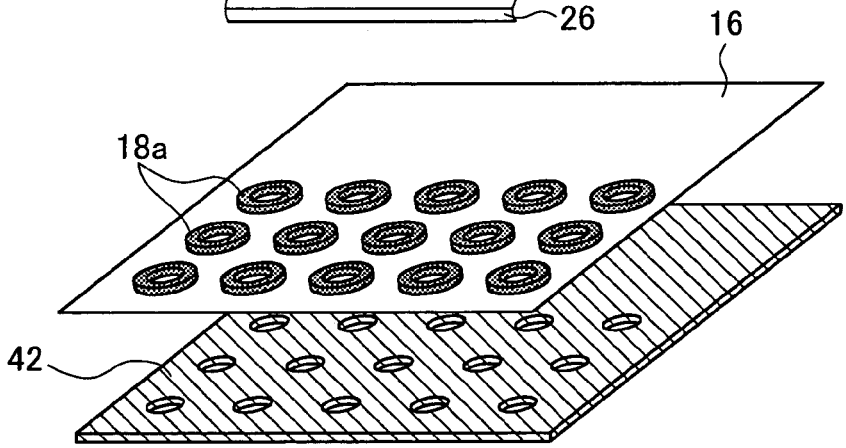
FIG. 7B is a schematic perspective view showing an embodiment of arrangement of first and second drive electrodes used as the individual electrode shown in FIG. 7A.

When the ink jet head 40 includes 15 individual electrodes as shown in FIG. 7B, for instance, there are formed three rows of the individual electrodes, with each row including five individual electrodes. In the ink jet head 40, ink ejection/non-ejection is controlled by the first and second drive electrodes 18*a* and 42. Note that the ink jet head 40 of the prevent invention uses the two-layered electrode structure formed by the first and second drive electrodes 18*a* and 42, although the present invention is not limited to this and there may be used any other electrode structure having two or more layers of drive electrodes.

Next, there will be described arrangement of the first and second drive electrodes 18*a* and 42. The first drive electrode 18*a* needs to be arranged closer to the insulating substrate 16 side than the ink flow path 30. On the other hand, the second drive electrode 42 needs to be arranged closer to the head substrate 12 side than the first drive electrode 18*a*. When the first drive electrode 18*a* is arranged on the upper surface of the insulating substrate 16 in the drawing, for instance, the second drive electrode 42 may be arranged on the lower surface of the insulating substrate 16 or inside the head substrate 12. When the second drive electrode 42 is arranged inside the head substrate 12, it is preferable that a floating conduction plate 26 is arranged inside the head substrate 12 on an upstream side of an ink flow path 30.

In the ink jet head 40 of this embodiment including the ejection electrode 18 having the two-layered electrode structure described above, the second drive electrode 42 is constantly biased to a predetermined positive voltage (600 V, for instance) and the first drive electrode 18*a* is switched between a ground state and a high-impedance state in accordance with image data, for instance. As a result, ejection/non-ejection of the ink Q (ink droplet R) containing the fine particle component, such as pigments, charged to the same polarity as the high-voltage level applied to the second drive electrode 42 can be controlled. That is, in the ejection head 40, when the first drive electrode 18*a* is set under the ground state, the electric field strength in proximity to the tip end portion 14*a* of the ink guide 14 remains low and ejection of the ink Q from the tip end portion 14*a* of the ink guide 14 is not performed. On the other hand, when the first drive electrode 18*a* is set under the high-impedance state, the electric field strength in proximity to the tip end portion 14*a* of the ink guide 14 is increased and the ink Q concentrated in the tip end portion 14*a* of the ink guide 14 flies out from the tip end portion 14*a* by means of an electrostatic force. When doing so, it is also possible to further concentrate the ink Q by selecting the condition.

In this embodiment, like in the case of the embodiment described above, the ratio between the inside diameter (Da) of the first drive electrode 18*a* and the projection amount (H) of the ink guide 14 is set so as to fall within the aforementioned appropriate limit range of the present invention, so that even if the bias voltage applied to the second drive electrode 42 is reduced to around 600 V or lower, it is possible to achieve reliable and stabilized ink ejection. Note that the ratio between the projection amount (H) of the ink guide 14 and the inside diameter of the through hole of the second drive electrode 42 may also be set so as to fall within the appropriate limit range of the present invention.

With the construction of this embodiment, switching to a high voltage is not performed at the time of image recording, so that no large electric power is consumed for the switching. Consequently, even in the case of an ink jet head that is required to perform high-definition recording at a high speed, it becomes possible to significantly reduce power consumption. Also, even when the individual electrodes and drive circuits are implemented at a physically extremely high density, there is hardly any risk of discharge. As a result, there is provided an advantage that it is possible to cope with both high-density implementation and high-voltage driving with safety.

It should be noted here that in the ink jet head 40 described above, the sheet-like second drive electrode 42 that is common among all individual electrodes is used. However, the present invention is not limited to this and a circular electrode may be provided as the second drive electrode for each individual electrode.

Further, when the first drive electrode and the second drive electrode of each individual electrode are each a circular electrode, a control method may be used with which a pulse voltage applied to the first drive electrode is also applied to the second drive electrode. In this case, an electric line of force from the first drive electrode and an electric line of force from the second drive electrode are added to each other and the electric field strength in the tip end portion of the ink guide is increased, so that it becomes possible to reduce the value of the pulse voltage applied to each drive electrode as compared with the case of the single-layered drive electrode.

Figure 8A:
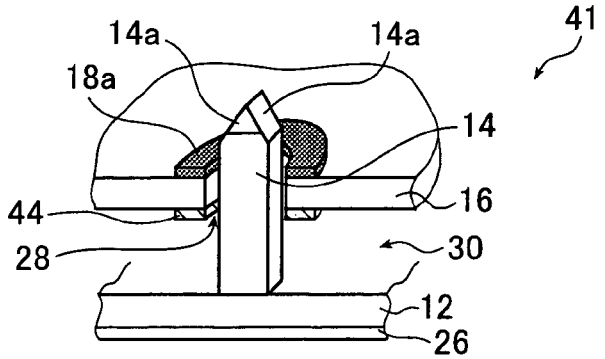
FIG. 8A is a schematic perspective view showing an outlined construction of another embodiment of the individual electrode of the electrostatic ink jet head according to the present invention.

FIG. 8A shows the outline of an ink jet head 41 according to still another embodiment of the present invention which includes ejection electrodes of another two-layered electrode structure.

The electrostatic ink jet head 41 shown in FIG. 8A has the same construction as the ink jet head 40 shown in FIG. 7A except that a second drive electrode 44 that is a circular electrode is provided for each individual electrode on the lower surface of the insulating substrate 16 in the drawing in place of the sheet-like second drive electrode 42 that is common among all individual electrodes. Therefore, the same construction elements are given the same reference numerals and the description thereof is omitted in this embodiment. That is, differences will be mainly described in this embodiment.

Figure 8B:
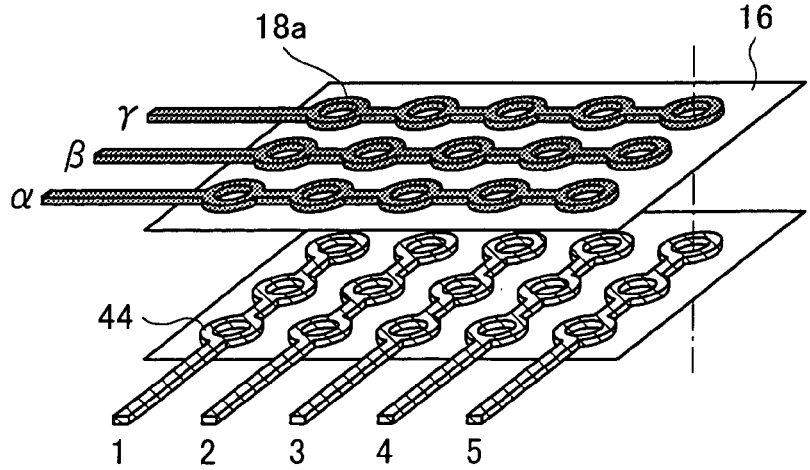
FIG. 8B is a schematic perspective view showing arrangement of first and second drive electrodes used as the individual electrode shown in FIG. 8A.

In the ink jet head 41 shown in FIG. 8A, an ejection electrode 18 has a two-layered electrode structure where a first drive electrode 18*a* that is a circular electrode is arranged on the upper surface of an insulating substrate 16 in the drawing and the second drive electrode 44 that is also a circular electrode is arranged on the lower surface of the insulating substrate 16. Here, the first drive electrode 18*a* is provided in a ring shape for each individual electrode so as to surround a through hole 28 formed in the insulating substrate 16, with multiple first drive electrodes 18*a* being connected to each other in a row direction (main scanning direction) as shown in FIG. 8B. Also, the second drive electrode 44 is provided in a ring shape for each individual electrode so as to surround the through hole 28 formed in the insulating substrate 16, with multiple second drive electrodes 44 being connected to each other in a column direction (sub-scanning direction) as shown in FIG. 8B.

In this embodiment, at the time of recording, only one first drive electrode 18*a* is set at a high-voltage level or under a high-impedance state (ON state) and all of the other first drive electrodes 18*a* are driven to a ground level (ground state: OFF state). Also, all second drive electrodes 44 are driven to a high-voltage level or a ground level in accordance with the image data. Note that as a modification, the first and second drive electrodes 18*a* and 44 may be driven in a reversed manner.

As described above, the first and second drive electrodes 18*a* and 44 are arranged in a matrix manner so as to form the two-layered electrode structure. By the first and second drive electrodes 18*a* and 44, ink ejection/non-ejection at respective individual electrodes is controlled. That is, when the first drive electrodes 18*a* are set at the high-voltage level or under a floating state and the second drive electrodes 44 are set at the high-voltage level, the ink will be ejected. When one of the first drive electrodes 18*a* and the second drive electrodes 44 are set at the ground level, the ink will not be ejected.

FIG. 8B is a conceptual diagram showing an exemplary arrangement of the first and second drive electrodes 18*a* and 44. As shown in this drawing, when the ink jet head 41 includes 15 individual electrodes, for instance, five individual electrodes (1, 2, 3, 4, and 5) are arranged on each row in the main scanning direction and three individual electrodes (α, β, and γ) are arranged on each column in the sub-scanning direction. At the time of recording, the five first drive electrodes 18*a* arranged on the same row are simultaneously driven to the same voltage level. In the same manner, the three second drive electrodes 44 arranged on the same column are simultaneously driven to the same voltage level.

Accordingly, in the ink jet head 41 of this embodiment, it is possible to arrange plural individual electrodes in a two-dimensional manner with respect to the row direction and the column direction.

In the case of the ink jet head shown in FIG. 8B, for instance, the five individual electrodes (first drive electrodes 18*a*) on the row α are arranged at predetermined intervals with respect to the row direction. The same applies to the row β and the row γ. Also, the five individual electrodes on the row β are spaced apart from the row α by a predetermined distance in the column direction and are respectively arranged between the five individual electrodes on the row α and the five individual electrodes on the row γ with respect to the row direction. In the same manner, the five individual electrodes on the row γ are spaced apart from the row β by a predetermined distance in the column direction and are respectively arranged between the five drive electrodes on the row β and the five drive electrodes on the row α with respect to the row direction.

In this manner, the individual electrodes (first drive electrodes 18*a*) on each row are arranged so as to be displaced from the individual electrodes on other rows in the row direction. With this arrangement, one line to be recorded on the recording medium P is divided into three groups in the row direction.

That is, one line to be recorded on the recording medium P is divided into multiple groups, whose number is equal to the number of rows of the first drive electrodes 18*a* with respect to the row direction and sequential recording is performed in a time-division manner. In the case of the example shown in FIG. 8B, for instance, sequential recording is performed for the rows α, β, and γ of the first drive electrodes 18*a*, thereby recording one line of an image on the recording medium P. In this case, as described above, one line to be recorded on the recording medium P is divided into three groups in the row direction and sequential recording is performed in a time-division manner.

Accordingly, in a matrix drive system adopted in this embodiment, division-recording is performed with respect to the row direction, so that the recording speed is lowered in accordance with an increase in the number of rows of the first drive electrodes 18*a*. However, it becomes possible to reduce the number of drivers of a drive circuit, which provides an advantage that it is possible to reduce an implementation area. Also, in this embodiment, it is also possible to appropriately determine the recording speed and the number of drivers as necessary, so that there is provided an advantage that it is possible to obtain a recording speed and an implementation area of the drive circuit that are optimum for the system.

It should be noted here that in the ink jet head 41 of this embodiment, there is used the two-layered electrode structure formed by the first and second drive electrodes 18*a* and 44. However, the present invention is not limited to this and there may be used any other electrode structure having two or more layers of drive electrodes.

In the ink jet head 41 of this embodiment having the ejection electrodes of the two-layered electrode structure described above, the second drive electrodes 44 constantly receive application of a predetermined voltage (600 V, for instance) and the first drive electrodes 18*a* are switched between a ground state and a high-impedance state in accordance with image data, for instance. As a result, ejection/non-ejection of the ink Q (ink droplet R) containing the fine particle component such as pigments charged to the same polarity as the high-voltage level applied to the second drive electrodes 42 can be controlled. That is, in the ink jet head 41, when the first drive electrode 18*a* is set under the ground state, the electric field strength in proximity to the tip end portion 14*a* of the ink guide 14 becomes low and the ink Q will not fly out from the tip end portion 14*a* of the ink guide 14. On the other hand, when the first drive electrode 18*a* is set under the high-impedance state, the electric field strength in proximity to the tip end portion 14*a* of the ink guide 14 is increased and the ink Q concentrated in the tip end portion 14*a* of the ink guide 14 flies out from the tip end portion 14*a* by means of an electrostatic force.

It should be noted here that an operation for switching the first drive electrode 18*a* between the ground level and the high voltage level in accordance with image data is performed in substantially the same manner. As described above, in the ink jet head 41 of this embodiment, when one of the first drive electrodes 18*a* and the second drive electrodes 44 are set at the ground level, the ink will not be ejected and only when the first drive electrodes 18*a* are set under the high-impedance state or at the high-voltage level and the second drive electrodes 44 are set at the high-voltage level, the ink will be ejected.

That is, in the ink jet head 41 of this embodiment, it is important that clearly different two states of the electric field strength are obtained at the time of ejection and non-ejection of the ink. Accordingly, related parameters, such as arrangement (positional relationship) of the first and second drive electrodes 18*a* and 44, the levels of the high voltages applied to the first and second drive electrodes 18*a* and 44, the bias voltage of the counter electrode 20 (or the charge voltage of the recording medium), the thickness of the insulating substrate 16, and the shape of the ink guide 14, need only be determined as appropriate.

In this embodiment, like in the embodiments described above, the ratio between the inside diameter (Da) of the first drive electrodes 18*a* and the projection amount (H) of the ink guide 14 is set so as to fall within the aforementioned appropriate limit range of the present invention, so that even if the bias voltage applied to the second drive electrodes 44 is reduced to around 600 V or lower, it is possible to achieve reliable and stabilized ink ejection. Note that the ratio between the projection amount (H) of the ink guide 14 and the inside diameter of the second drive electrodes 44 may also be set so as to fall within the appropriate limit range of the present invention.

With the construction of this embodiment, no large electric power is consumed for switching because it is possible to switch the first drive electrodes between the high-impedance state and the ground level. Therefore, according to this embodiment, it becomes possible to significantly reduce power consumption even in the case of an ink jet head that is required to perform high-definition recording at a high speed.

Also, according to this embodiment, the individual electrodes are arranged in a two-dimensional manner and are matrix-driven, so that it becomes possible to significantly reduce the number of row drivers for driving multiple individual electrodes in the row direction and the number of column drivers for driving multiple individual electrodes in the column direction. Consequently, according to this embodiment, it becomes possible to significantly reduce the implementation area and power consumption of a circuit for driving the two-dimensionally arranged individual electrodes. In addition, according to this embodiment, it is possible to arrange the individual electrodes while maintaining relatively large margins therebetween, so that it becomes possible to significantly reduce a risk of discharge between the individual electrodes and to cope with both of high-density implementation and high-voltage driving with safety.

It should be noted here that in the case of an ink jet head, such as the ink jet heads 40 and 41 described above, that uses ejection electrodes having a two-layered electrode structure formed by the first and second drive electrodes 18*a* and 42 or 44, when the individual electrodes are arranged at a high density, an electric field interference may occur between adjacent individual electrodes. Therefore, it is preferable that a guard electrode is provided between the first drive electrodes of adjacent individual electrodes and the electric lines of force to adjacent ink guides 14 are shielded by the guard electrode. The guard electrode is effective not only for the two-layered electrode structure but also for the single-layered structure described above.

Figure 9:
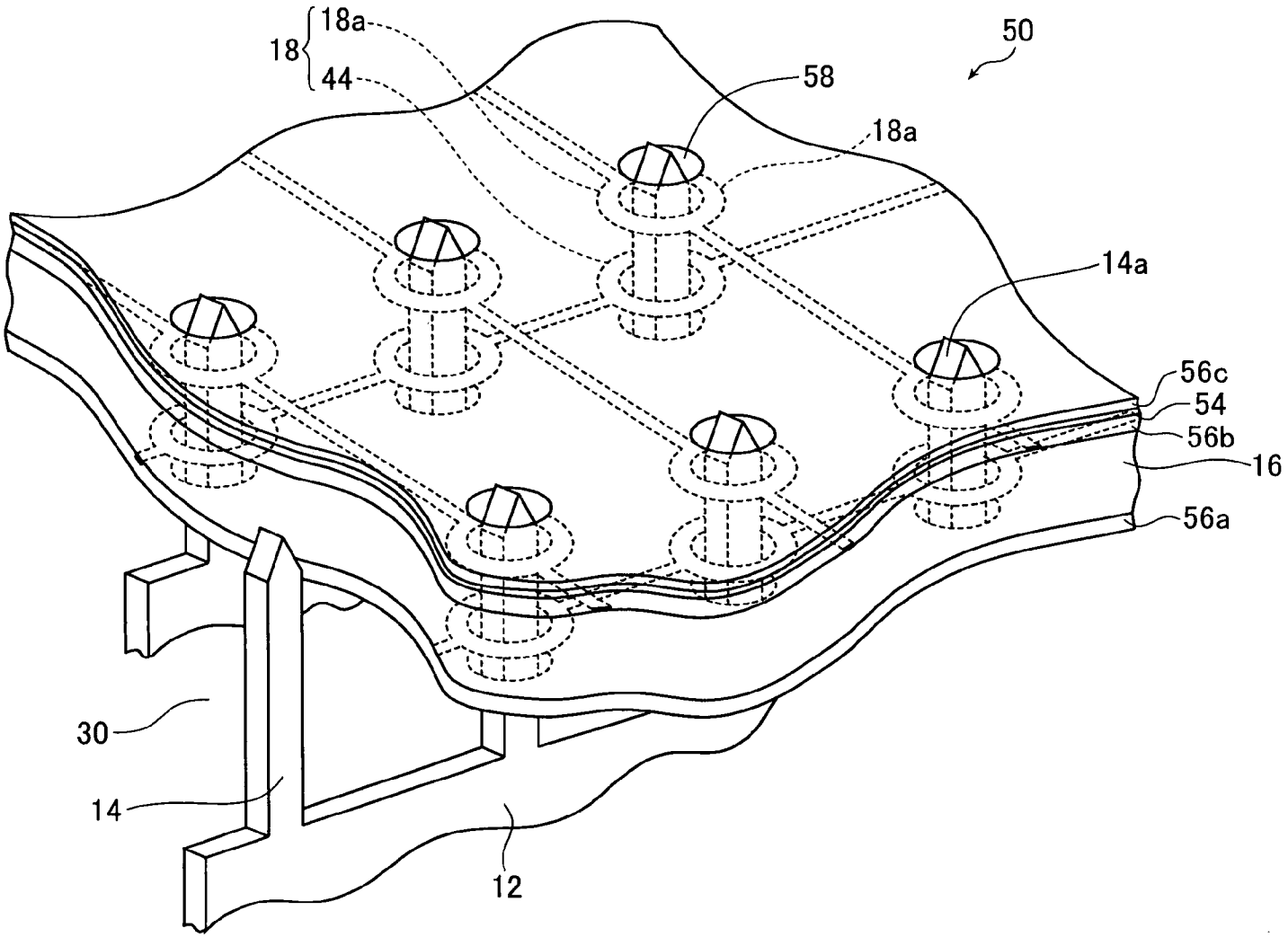
FIG. 9 is a schematic perspective view showing an outlined construction of another embodiment of the electrostatic ink jet head according to the present invention.

An outlined construction of an ink jet head 50 that is still another embodiment of the present invention, in which the guard electrode described above is provided for ejection electrodes forming a two-layered electrode structure, will be described with reference to FIGS. 9, 10A, and 10B. FIG. 9 is a schematic perspective view of an example of the ink jet head of this embodiment, FIG. 10A is a schematic cross-sectional view of the ink jet head shown in FIG. 9, and FIG. 10B is the arrow view taken along the line VII-VII of FIG. 10A.

The ink jet head 50 shown in FIGS. 9, 10A, and 10B has the same construction as the ink jet head 41 shown in FIG. 8A except that an insulation layer 56*a* is provided below second drive electrodes 44 arranged on the lower surface of an insulating substrate 16 in the drawings, an insulating layer 56*b* is provided above first drive electrodes 18*a* arranged on the upper surface of the insulating substrate 16 in the drawings, and a guard electrode 54 and an insulation layer 56*c* are provided on the insulating layer 56*b* in this order. Therefore, the same construction elements are given the same reference numerals and the description thereof is omitted in this embodiment. That is, differences will be mainly described in this embodiment.

Figure 10A:
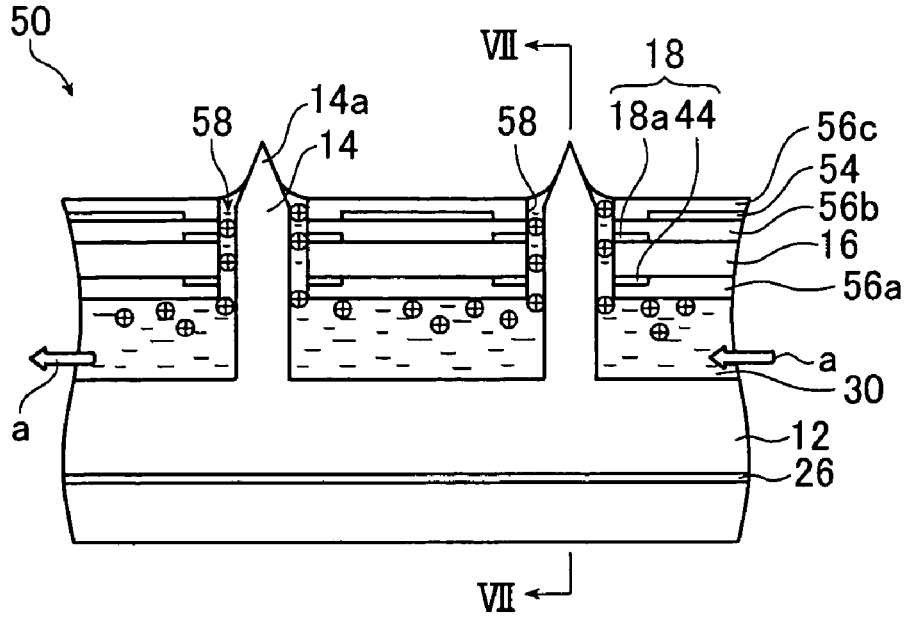
FIG. 10A is a schematic cross-sectional view showing an outlined construction of the ink jet head shown in FIG. 9.
Figure 10B:
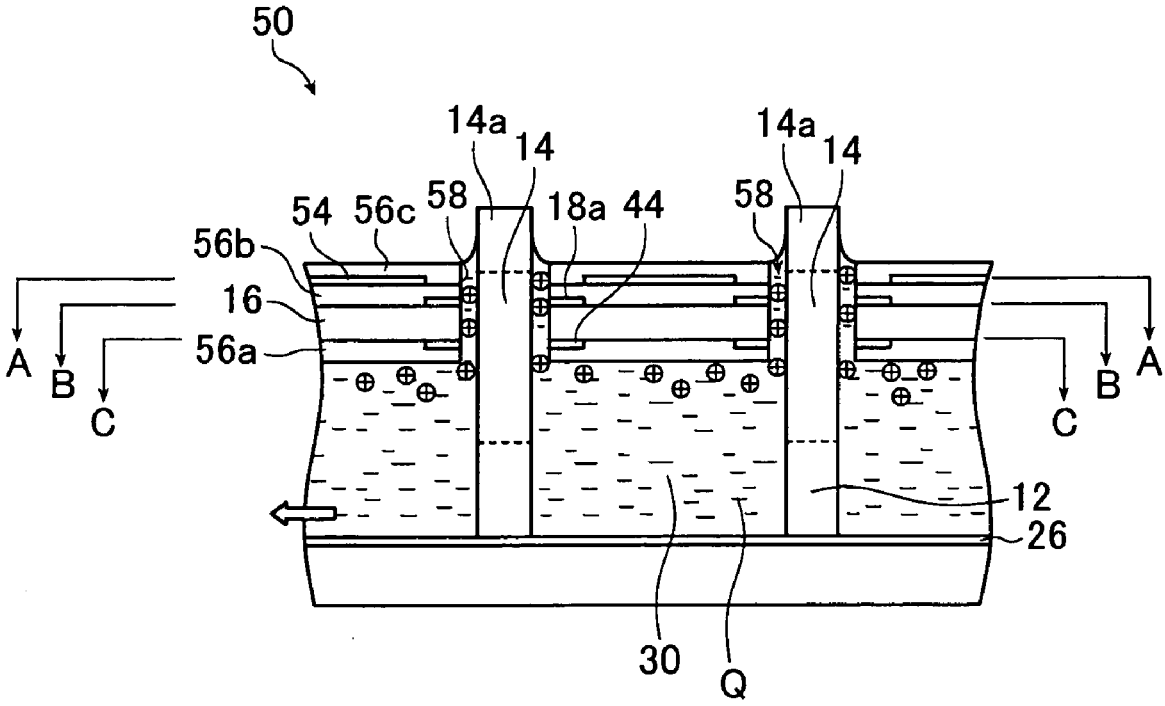
FIG. 10B is a cross-sectional view taken along a line VII-VII in FIG. 10A.

In the ink jet head 50 shown in FIGS. 9, 10A, and 10B, in addition to ejection electrodes 18 forming the two-layered structure including the first drive electrodes 18*a* that are each a circular electrode arranged on the upper surface of the insulating substrate 16 in the drawings in a ring shape for each individual electrode so as to surround a through hole 58 formed in the insulating substrate 16 and the second drive electrodes 44 that are each a circular electrode arranged on the lower surface of the insulating substrate 16 in the drawings in a ring shape for each individual electrode so as to surround the through hole 58 formed in the insulating substrate 16, there are provided the insulation layer 56*a* covering the lower side (lower surface) of the second drive electrodes 44, the sheet-like guard electrode 54 arranged above the first drive electrodes 18*a* with the insulation layer 56*b* in-between, and the insulation layer 56*c* covering the upper surface of the guard electrode 54. Here, the multiple first drive electrodes 18*a* are connected to each other in a row direction (main scanning direction) and the multiple second drive electrodes 44 are connected to each other in a column direction (sub-scanning direction).

The through holes 58 are formed so as to also pass through the insulation layer 56*a* below the insulating substrate 16 and the insulation layers 56*b* and 56*c* above the insulating substrate 16. That is, the through holes 58 are formed so as to pass through a layered product of the insulation layer 56*a*, the insulating substrate 16, and the insulation layers 56*b* and 56*c*. Ink guides 14 are inserted into the through holes 58 from an insulation layer 56*a* side so that tip end portions 14*a* of the ink guides 14 protrude from the insulation layer 56*c*. Note that in the illustrated example, no ink guide groove is formed in the tip end portions 14*a* of the ink guides 14, but ink guide grooves may be formed in order to promote concentration of the ink Q and the charged fine particle component in the ink Q to the tip end portions 14*a*.

Here, the ratio between the protrusion amount (projection amount) H of the tip end portions 14*a* of the ink guides 14 from the first drive electrodes 18*a* and the inside diameter (Da) of the first drive electrodes 18*a* exposed to the through holes 58 is set in the range of 0.5 to 2, preferably in the range of 0.7 to 1.7. Note that it is preferable that the ratio between the projection amount H of the ink guides 14 and the inside diameter (Da) of the second drive electrodes 44 is also set so as to satisfy the condition described above.

Figure 11A:
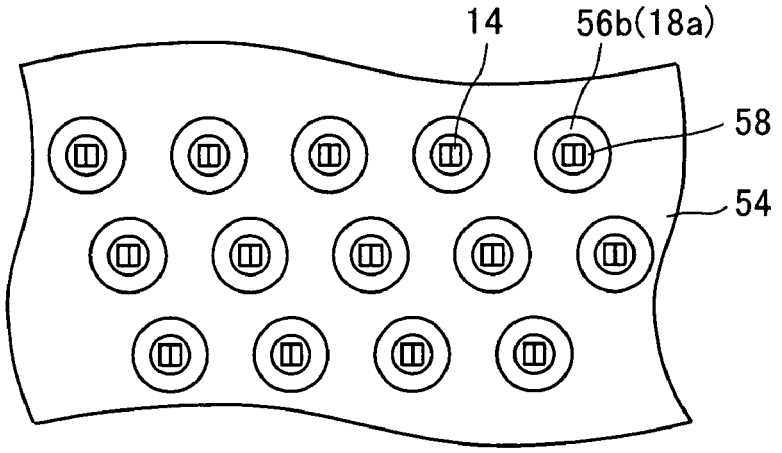
FIG. 11A is an arrow view taken along a line A-A of FIG. 10B.

In this embodiment, the guard electrode 54 is arranged between the first drive electrodes 18*a* of adjacent individual electrodes and suppresses electric field interferences occurring between the ink guides 14 serving as ejection portions of the adjacent individual electrodes. As shown in FIG. 11A, the guard electrode 54 is a sheet-like electrode, such as a metal plate, that is common among all individual electrodes, and holes are formed in the guard electrode 54 in portions corresponding to the first drive electrodes 18*a* formed around the through holes 58 for respective individual electrodes two-dimensionally arranged (see FIGS. 10A and 10B). Note that in this embodiment, the reason why the guard electrode 54 is provided is that if the individual electrodes are arranged at a high density, there is a case where an electric field generated by an individual electrode is influenced by the states of electric fields generated by its adjacent individual electrodes and therefore dot sizes and dot drawing positions fluctuate and recording quality is adversely affected.

By the way, the upper side of the guard electrode 54 in the drawings is covered with the insulation layer 56*c* except for the through holes 58 and the insulation layer 56*b* is disposed between the guard electrode 54 and the first drive electrodes 18*a*, thereby insulating the electrodes 54 and 18*a* from each other. That is, the guard electrode 54 is arranged between the insulation layer 56*c* and the insulation layer 56*b* and the first drive electrodes 18*a* are arranged between the insulation layer 56*b* and the insulating substrate 16.

Figure 11B:
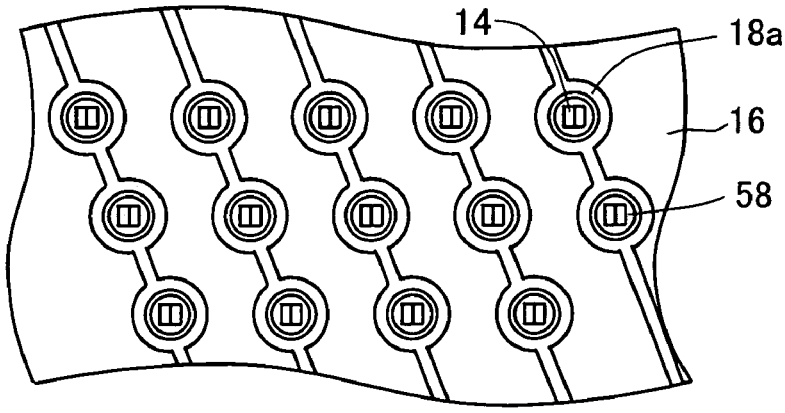
FIG. 11B is an arrow view taken along a line B-B of FIG. 10B.

That is, as shown in FIG. 11B, on the upper surface of the insulating substrate 16, that is, between the insulation layer 56*b* and the insulating substrate 16 (see FIGS. 10A and 10B), the first drive electrodes 18*a* formed around the through holes 58 for the respective individual electrodes are two-dimensionally arranged and the multiple first drive electrodes 18*a* are connected to each other in the column direction.

Figure 11C:
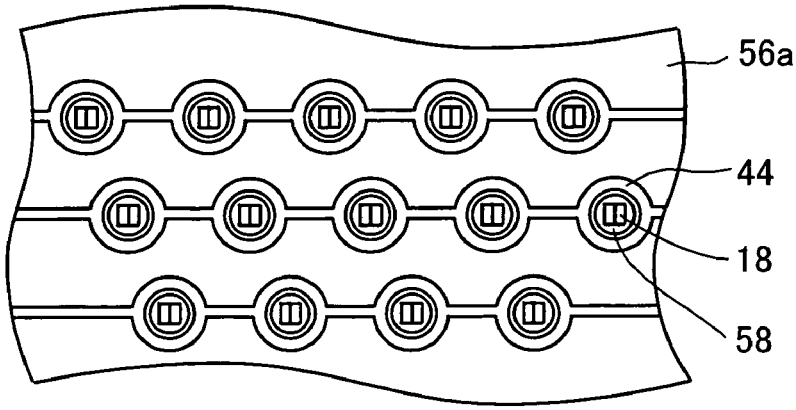
FIG. 11C is an arrow view taken along a line C-C of FIG. 10B.

Also, as shown in FIG. 11C, on the upper surface of the insulation layer 56*a* (that is, on the lower surface of the insulating substrate 16), that is, between the insulation layer 56*a* and the insulating substrate 16 (see FIGS. 10A and 10B), the second drive electrodes 44 formed around the through holes 58 for the respective individual electrodes are two-dimensionally arranged and multiple second drive electrodes 44 are connected to each other in the row direction.

Further, in this embodiment, in order to shield a repulsive electric field from the ejection electrode (drive electrode) 18 of each individual electrode (from the first and second drive electrodes 18*a* and 44, for instance) toward the ink flow path 30, a shield electrode may be provided on a flow path side with respect to the first and second drive electrodes 18*a* and 44.

In this embodiment, like in the case of the embodiment shown in FIGS. 8A and 8B, at the time of recording, only one first drive electrode 18*a* is set at a high-voltage level or under a high-impedance state (ON state) and all other first drive electrodes 18*a* are driven to a ground level (ground state: OFF state). On the other hand, all second drive electrodes 44 are driven to a high-voltage level or a ground level in accordance with image data. Note that as a modification, the first and second drive electrodes 18*a* and 44 may be driven in a reversed manner.

As described above, the first and second drive electrodes 18*a* and 44 are arranged in a matrix manner so as to form a two-layered electrode structure. By the first and second drive electrodes 18*a* and 44, ink ejection/non-ejection at respective individual electrodes is controlled. That is, when the first drive electrodes 18*a* are set at the high-voltage level or under a floating state and the second drive electrodes 44 are set at the high-voltage level, the ink will be ejected. When one of the first drive electrodes 18*a* and the second drive electrodes 44 are set at the ground level, the ink will not be ejected.

It should be noted here that in this embodiment, pulse voltages may be applied to the first and second drive electrodes 18*a* and 44 in accordance with image signals and the ink ejection may be performed when both of these electrodes are set at the high-voltage level.

Figure 12:
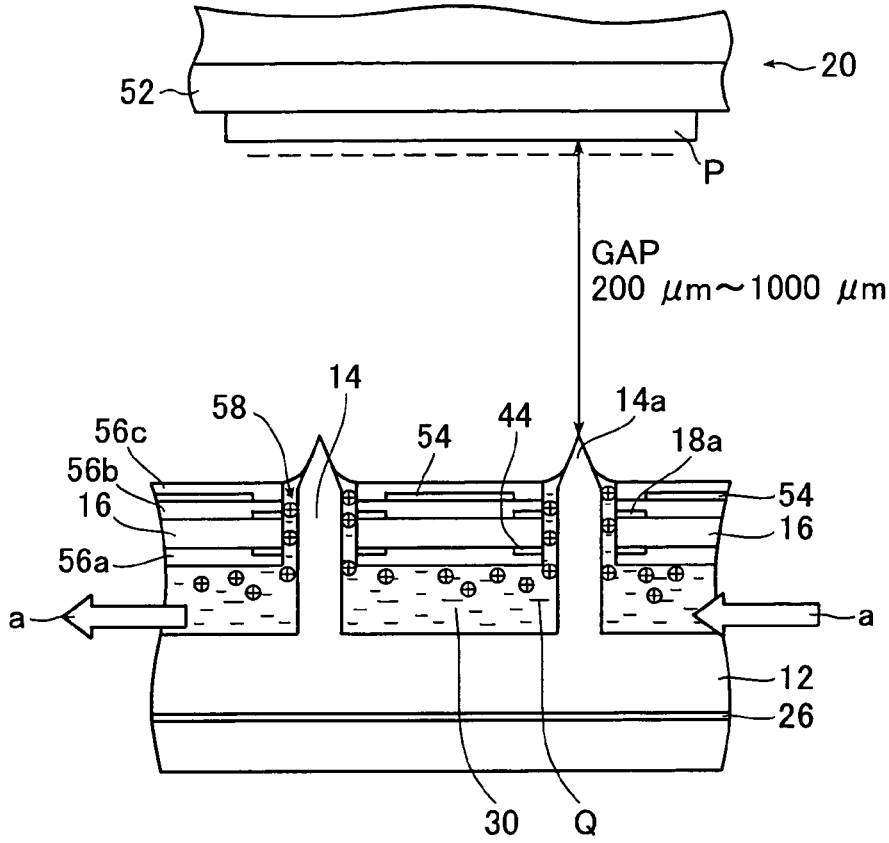
FIG. 12 is a conceptual diagram illustrating an operation of the ink jet head shown in FIG. 9.

For instance, in an ink jet head 50 shown in FIG. 12, when a fine particle component in the ink Q is positively (+) charged, that is, when the ink Q contains positively charged particles, for instance, an electric field with which the ink Q is circulated in a direction of the arrow "a" in an ink flow path 30 of the ink jet head 50 and the positively charged particles in the ink Q (ink droplet) ejected from a tip end portion 14*a* of an ink guide 14 of an individual electrode are attracted by a recording medium P, that is, a flying electric field is formed between first and second drive electrodes 18*a* and 44 and the recording medium P. A distance (gap) between the tip end portion 14*a* of the ink guide 14 and the recording medium P is set in a range of 200 to 1000 μm, for instance. When the gap is set at 500 μm, the flying electric field is formed by providing a potential difference in a range of 1 kV to 2.5 kV.

Also, by an average voltage applied to the first or second drive electrode 18*a* or 44, an induced voltage that is lower than the average voltage is almost constantly generated in a floating conduction plate 26, so that an electric field (hereinafter referred to as the "migration electric field", for instance) is formed with which the positively charged particles in the ink Q in the ink flow path 30 functioning as an ink reservoir are attracted upward and the positively charged particles in the ink Q gather in the upper portion of the ink flow path 30. By providing a potential difference of around several hundred V with respect to a thickness of the ink flow path 30 of several mm, for instance, the migration electric field is formed.

For instance, in the ink jet head 50 shown in FIG. 12, the recording medium P is charged to a negative high voltage of −1.5 kV (or a counter electrode formed by a transport member 52 that transports the recording medium P is biased to −1.5 kV) and the first and second drive electrodes 18*a* and 44 are both set at 0 V (ground state), thereby forming the flying electric field. Then, the guard electrode 54 is set at 0 V (ground state).

Under this state, the ink Q moves upward from the ink flow path 30 to a space between the through hole 58 and the ink guide 14 and gathers in the tip end portion 14*a* by electrophoretic action and capillary action. The ink Q gathering in the tip end portion 14*a* is retained in the tip end portion 14*a* by the surface tension or the like of the ink Q and the concentration of the positively charged particles in the ink Q is increased to a high level.

Figure 13:
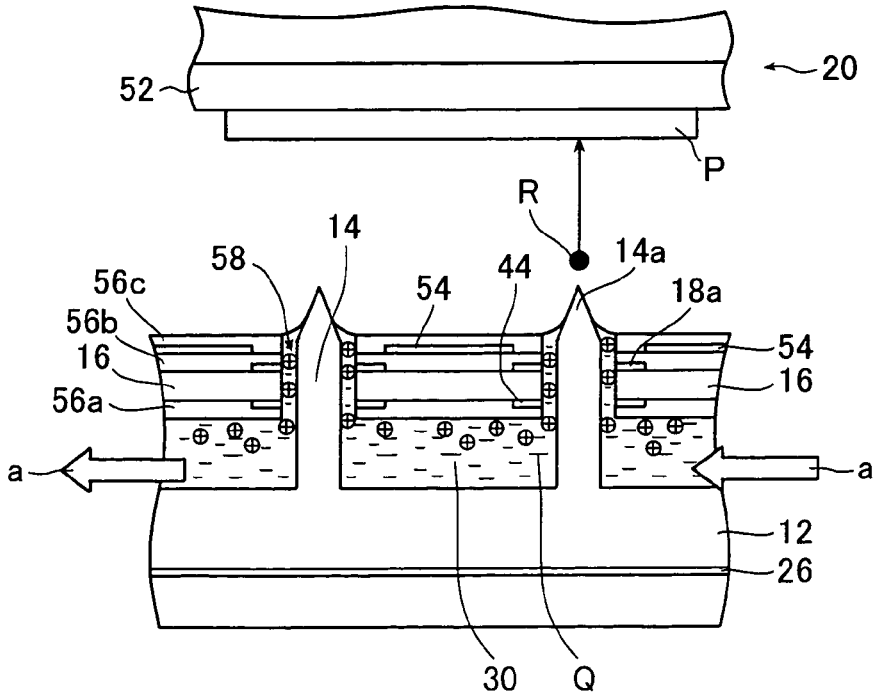
FIG. 13 is a conceptual diagram illustrating a recording operation of the ink jet head shown in FIG. 9.

Next, as shown in FIG. 13, pulse voltages (that are both in the range of +400 to 600 V, for instance) are applied to the first and second drive electrodes 18*a* and 44 in accordance with an image signal and an ink droplet R having highly concentrated positively charged particles is ejected from the tip end portion 14*a* of the ink guide 14. For instance, when the initial particle concentration is in a range of 3 to 15%, it is preferable that the particle concentration in the ejected ink droplet R is 30% or higher. Note that the pulse widths of the pulse voltages are not specifically limited, but it is possible to set the pulse widths in the range of several tens of μs to several hundred μs, for instance. Also, the sizes of dots recorded on the recording medium P depend on the magnitudes or application time lengths of the pulse voltages, so that it is possible to adjust the dot sizes by adjusting the pulse voltage magnitudes or application time lengths.

In this embodiment, like in the embodiments described above, the ratio between the projection amount of the tip end portion 14*a* of the ink guide 14 and the inside diameter of the first drive electrode 18*a* is set so as to fall within the aforementioned appropriate limit range. Therefore, it becomes possible to appropriately adjust the flying electric field between the first and second drive electrodes 18*a* and 44 and the recording medium P and to cause ink ejection with reliability and stability only when appropriate pulse voltages are applied to the first and second drive electrodes 18*a* and 44. Also, in the illustrated example, the first and second drive electrodes 18*a* and 44 are matrix-driven, so that it becomes possible to reduce the number of drivers.

That is, an attraction electric field toward the recording medium is set so as to fall within a range of $1.5\times10^7$ V/m or lower, more preferably $1.0\times10^7$ V/m or lower under a state where the ink droplet ejection is not caused, and to fall within a range of $2.0\times10^7$ V/m or higher, more preferably $2.5\times10^7$ V/m or higher under a state where the ejection is caused.

It should be noted here that in the ink jet head 50 of this embodiment, it is not specifically limited whether the ink ejection/non-ejection is controlled using one or both of the first drive electrodes 18*a* and the second drive electrodes 44. However, it is preferable that the ejection of the ink Q is not performed when one of the first drive electrodes 18*a* and the second drive electrodes 44 are set at the ground level and the ink ejection is performed only when the first drive electrodes 18*a* are set under the high-impedance state or at the high-voltage level and the second drive electrodes 44 are set at the high-voltage level.

By the way, as in the illustrated example, the guard electrode 54 is provided between adjacent first drive electrodes 18*a* in the ink jet head 50 of this embodiment, but the present invention is not limited to this. For instance, when the first and second drive electrodes 18*a* and 44 are matrix-driven, that is, when the second drive electrodes 44 of the lower layer are sequentially driven in units of columns and the first drive electrodes 18*a* of the upper layer are driven in accordance with image data, the guard electrode may be provided only in spaces between the rows of the first drive electrodes 18*a*. Even in this case, by biasing the guard electrode to a predetermined guard potential (ground level, for instance) at the time of recording, it becomes possible to eliminate the influence of adjacent individual electrodes.

Also, in this embodiment, when the rows of the first drive electrodes 18*a* of the upper layer are sequentially turned on and the second drive electrodes 44 of the lower layer are turned on/off in accordance with image data at the time of driving of the ejection electrodes 18 of the individual electrodes like in the embodiment shown in FIGS. 8A and 8B, that is, when the arrangement of the rows and columns is interchanged, the second drive electrodes 44 are driven in accordance with the image data. Therefore, the individual electrodes on both sides of each individual electrode in the column direction are frequently switched between the high-voltage level and the ground level.

In the row direction, however, the first drive electrodes 18*a* are driven in units of rows and the first drive electrodes 18*a* of the individual electrodes on both sides of a currently driven row are constantly set at the ground level. Consequently, the rows of the individual electrodes on the both sides play the role of a guard electrode. As described above, when each row of the first drive electrodes 18*a* of the upper layer are sequentially turned on and the second drive electrodes 44 of the lower layer are driven in accordance with image data, it becomes possible to eliminate the influence of adjacent individual electrodes and to improve recording quality without providing a guard electrode.

Needless to say, in any of the embodiments described above, it is possible to eliminate the influence of adjacent individual electrodes by providing a guard electrode.

Further, in the ink jet head 50 of this embodiment, the floating conduction plate 26 is provided which constitutes the undersurface of the ink flow path 30 and causes the positively charged ink particles (charged particles, that is, charged fine particle component) in the ink flow path 30 to migrate upwardly (that is, toward the recording medium P side) by means of induced voltages generated by pulse-like ejection voltages applied to the first drive electrodes 18*a* and the second drive electrodes 44. Also, an electrically insulative coating film (not shown) is formed on a surface of the floating conduction plate 26, thereby preventing a situation where the physical properties and components of the ink are destabilized due to charge injection into the ink or the like. It is preferable that the electric resistance of the insulative coating film is set at $10^{12}$ Ω·cm or higher, more preferably at $10^{13}$ Ω·cm or higher. Also, it is preferable that the insulative coating film is corrosion resistant to the ink, thereby preventing a situation where the floating conduction plate 26 is corroded by the ink. Further, the floating conduction plate 26 is covered with an insulation member from its bottom side. With this construction, the floating conduction plate 26 is completely electrically insulated and floated.

Here, at least one floating conduction plate 26 is provided for each head. That is, in the heads for C, M, Y, and K, each head is provided with at least one floating conduction plate and the heads for C and M will never share the same floating conduction plate.

In the respective embodiments of the ink jet heads having the ejection electrodes of the two-layered electrode structure as described above, the counter electrode (recording medium P) may be charged to −1.6 kV, for instance, and the ink ejection may be controlled so that the ink will not be ejected when at least one of the first drive electrodes and the second drive electrodes are set at a negative high voltage (−600 V, for instance) and the ink will be ejected only when both of the first drive electrodes and the second drive electrodes are set at the ground level (0V).

It should be noted that the ink Q used to supply to the ink flow path 30 in the present invention contains charged color particles (charged color fine particle component) whose particle size is around 0.1 to 5 μm and which are dispersed in a carrier liquid. Note that dispersion resin particles for improving fixability of an image after printing may be contained in the ink as appropriate together with the charged color particles. It is required that the carrier liquid is a dielectric liquid (non-aqueous solvent) having a high electric resistivity that is $10^9$ Ω·cm or higher, preferably $10^{10}$ Ω·cm or higher. If a carrier liquid having a low electric resistivity is used, the carrier liquid itself is charged by charge injection by the voltages applied from the ejection electrodes, so that it becomes difficult to increase the concentration of the charged particles (charged fine particle component) and therefore concentration does not occur. Also, the carrier liquid having a low electric resistivity is not suited for the present form because there is apprehension that electrical breakdown or continuity may occur between adjacent recording electrodes.

It is preferable that the relative permittivity of the dielectric liquid used as the carrier liquid is 5 or lower, more preferably 4 or lower, and still more preferably 3.5 or lower. By setting the relative permittivity in such a range, an electric field effectively acts on the charged particles in the dielectric liquid and migration easily occurs.

It should be noted here that it is preferable that the upper limit value of the inherent electric resistance of the dielectric liquid is around $10^{16}$ Ω·cm, and the lower limit value of the relative permittivity thereof is around 1.9.

The reason why it is preferable that the electric resistance of the dielectric liquid is in the range described above is that if the electric resistance is lowered, it becomes impossible to perform ejection of the ink under a low electric field with stability. On the other hand, the reason why it is preferable that the relative permittivity is in the range described above is that if the dielectric constant is increased, the electric field is weakened due to polarization of the solvent and therefore colors of dots formed are thinned or blurring occurs.

Preferred examples of the dielectric liquid of the present invention include straight-chain or branched aliphatic hydrocarbons, alicylic hydrocarbons, aromatic hydrocarbons, or halogen substituents of the hydrocarbons. For example, hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of American Mineral Spirits Company), a silicone oil (such as KF-96L, manufactured by Shin-Etsu Silicones), etc. may be used singly or as a mixture of those.

As to the color particles dispersed in the dielectric liquid (non-aqueous solvent), a colorant itself or the colorant contained in dispersion resin particles for improving fixability may be used. In the latter case, the color particles with pigments or the like are generally formed as resin-coated particles by coating pigments or the like with the resin material of the dispersion resin particles, or the color particles with dyes or the like are generally obtained as color particles by coloring the dispersion resin particles with dyes. As the colorant, it is possible to use any of pigments and dyes conventionally used in an ink jet ink composition, a printing (oil-based) ink composition, and an electro-photographic liquid developer.

The content of the ink particles (total content, of the color particles and/or the resin particles) dispersed in the ink is preferably in a range of 0.5 to 30 wt % based on the total weight of the ink, more preferably in a range of 1.5 to 25 wt %, and still more preferably in a range of 3 to 20 wt %. If the content of the ink particles is lowered, there easily occurs a problem that, for instance, shortage of the density of a printed image occurs or affinity of the ink with the recording medium surface is hardly obtained and therefore it becomes difficult to obtain a firmly fixed image. On the other hand, if the content of the ink particles is increased, there occurs a problem that, for instance, it becomes difficult to obtain a uniform dispersion liquid or clogging of the ink easily occurs in the ejection head and therefore it becomes difficult to achieve stable ink ejection.

Pigments to be used as colorants may be inorganic pigments or organic pigments commonly employed in the field of printing technology. Specific examples thereof include, but are not particularly limited to, well-known pigments such as Carbon Black, Cadmium Red, Molybdenum Red, Chrome Yellow, Cadmium Yellow, Titanium Yellow, chromium oxide, Viridian, Cobalt Green, Ultramarine Blue, Prussian Blue, Cobalt Blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes to be used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Also, the average particle size of the ink particles, such as the color particles and/or resin particles, dispersed in the dielectric solvent is preferably in a range of 0.1 μm to 5 μm, more preferably in a range of 0.2 μm to 1.5 μm, and still more preferably in a range of 0.4 μm to 1.0 μm. The particle size was obtained using CAPA-500 (manufactured by HORIBA, Ltd.).

Here, it is preferable that the ink particles (dispersion resin particles and/or color particles or colorant particles) in the ink Q are positively or negatively charged particles.

It is possible to impart charge to the ink particles by appropriately using a technique of electro-photographic developer. In more detail, it is possible to impart the charge to the ink particles using charge detection agent and/or other additives described in "Latest Systems for Electro-photographic Development, and Development and Application of Toner Materials" (pp. 139 to 148), "Fundamentals and Applications of Electro-photographic Techniques" (edited by Electro-photographic Society, pp. 497 to 505, CORONA PUBLISHING CO., LTD., 1988), "Electro-photography" (Yuji Harasaki, Vol. 16 (No.2), p. 44, 1977), and the like.

Also, the viscosity of the ink composition is preferably in a range of 0.5 to 5 mPa·s, more preferably in a range of 0.6 to 3.0 mPa·s, and still more preferably in a range of 0.7 to 2.0 mPa·s. The color particles have electric charges and it is possible to use various charge control materials used for electro-photographic liquid developer as necessary. The charge amount thereof is preferably in a range of 5 to 200 μC/g, more preferably in a range of 10 to 150 μC/g, and still more preferably in a range of 15 to 100 μC/g. Also, there is a case where the electric resistance of the dielectric solvent changes due to addition of the charge control material. The charge detection agent is added so that the distribution factor P defined below becomes preferably 50% or higher, more preferably 60% or higher, and still more preferably 70% or higher.

$$P=100\times(\sigma1-\sigma2)/\sigma1$$

Here, σ1 is the electric conductivity of the ink composition and σ2 is the electric conductivity of a supernatant of the ink composition obtained with a centrifugal separator. The electric conductivity is a value measured using an LCR meter (AG-4311 manufactured by Ando Electric Co., Ltd.) and an electrode for liquid (LP-05 manufactured by Kawaguchi Electric Works Co., Ltd.) by applying a voltage of 5 V at a frequency of 1 kHz. Also, the centrifugation was performed using a high speed refrigerated microcentrifuge (SRX-201 manufactured by TOMY SEIKO CO., LTD.) for 30 minutes at a rotation speed of 14500 rpm under a temperature of 23° C.

With the ink composition described above, migration of the charged particles easily occurs and concentration is facilitated.

On the other hand, the electric conductivity σ1 of the ink composition is preferably in a range of 100 to 3000 pS/cm, more preferably in a range of 150 to 2500 pS/cm, and still more preferably in a range of 200 to 2000 pS/cm. By setting the electric conductivity in this range, voltages applied to the ejection electrodes are prevented from becoming extremely high and therefore there is eliminated apprehension that electrical breakdown or continuity may occur between adjacent ejection electrodes. Also, the surface tension of the ink composition is preferably in a range of 15 to 50 mN/m, more preferably in a range of 15.5 to 45 mN/m, and still more preferably in a range of 16 to 40 mN/m. By setting the surface tension in this range, the voltages applied to the ejection electrodes are prevented from becoming extremely high and therefore there is prevented a situation where the head is soiled with ink leaking and spreading around the head.

In a conventional ink jet system, ink is caused to fly toward a recording medium by applying a force to the whole of the ink. In the present invention, however, the charged fine particle component (charged toner particles) that is a solid component dispersed in the carrier liquid mainly receives a force and is caused to fly toward the recording medium. As a result, it becomes possible to record an image on various recording media, such as a nonabsorbable film like a PET film, as well as plain paper. Also, it becomes possible to obtain an image having high image quality on various recording media by preventing blurring or flowing of the ink on the recording media.

Next, the electrostatic ink jet recording apparatus according to the third aspect of the present invention which uses the ink jet heads according to the first and second aspects of the present invention as well as the electrostatic ink jet recording method according to the fourth aspect of the present invention performed by using these ink jet heads will be described.

Figure 14:
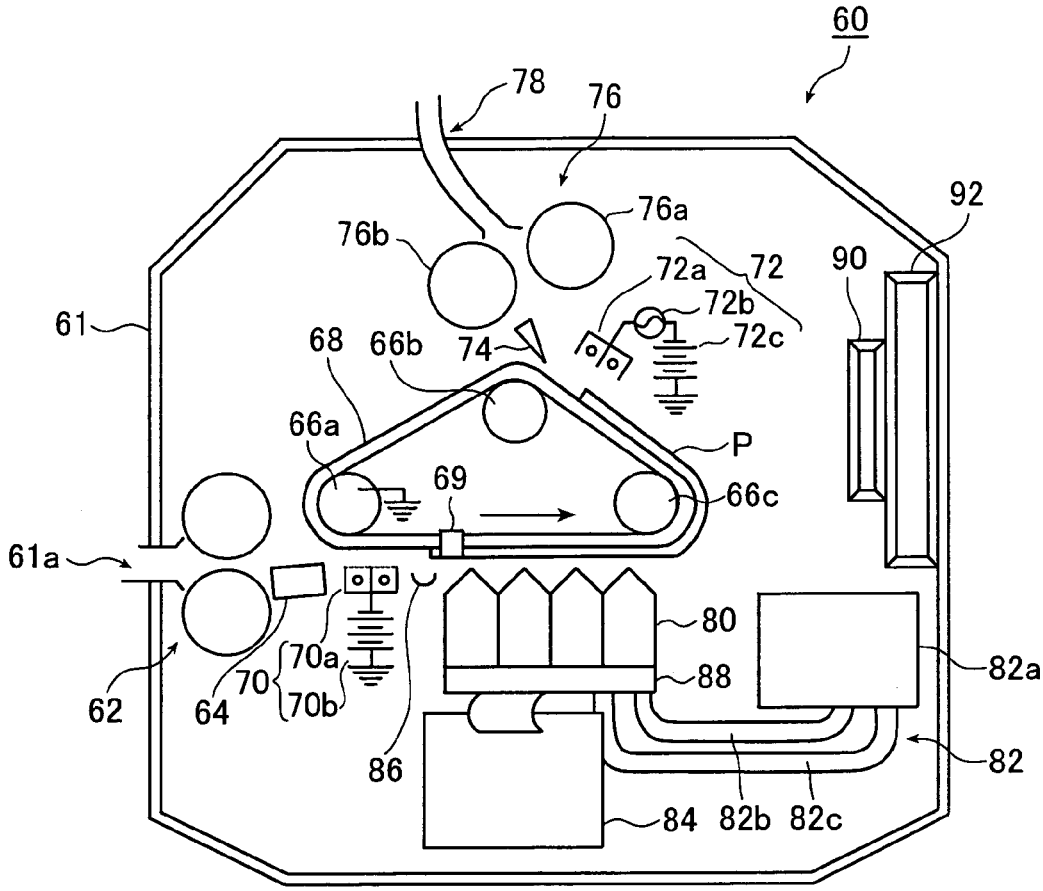
FIG. 14 is a schematic construction diagram showing the ink jet recording apparatus according to an embodiment of the present invention.

FIG. 14 is a schematic diagram showing an overall construction of an embodiment of the electrostatic ink jet recording apparatus according to the third aspect of the present invention.

The electrostatic ink jet recording apparatus (hereinafter referred to as the "ink jet printer") and the electrostatic ink jet recording method of the present invention are used to record a full-color image by forming an image of ink particles through ejection of ink droplets in four colors in accordance with inputted image data using an image forming means onto a recording medium P transported by a transport means and fixing the image of ink particles formed on the recording medium P.

An ink jet printer 60 shown in FIG. 14 is an apparatus that performs one-sided four-color printing on the recording medium P. For this purpose, as a means for transporting the recording medium P, the ink jet printer 60 includes a feed roller pair 62, a guide 64, rollers 66*a*, 66*b*, and 66*c*, a transport belt 68, a transport belt position detection means 69, an electrostatic adsorption means 70, a discharge means 72, a peeling means 74, a fixing/transporting means 76, and a guide 78. Also, as the image forming means, the ink jet printer 60 includes an ejection head unit 80, an ink circulation system 82, a head driver 84, a recording medium position detection means 86, and a recording position control means 88. Further, the ink jet printer 60 includes a discharge fan 90 and a solvent collecting device 92 as the solvent collecting means. These construction elements are provided in an enclosure 61.

First, the transport means for the recording medium P in the ink jet printer 60 will be described.

The feed roller pair 62 is provided adjacent to an inlet 61*a* provided on a side surface of the enclosure 61 and is composed of a pair of rollers that feed the recording medium P from a not-shown stocker to the transport belt 68 (portion supported by the roller 66*a*) provided in the enclosure 61. The guide 64 is provided between the feed roller pair 62 and the roller 66*a* supporting the transport belt 68, and guides the recording medium P to the transport belt 68.

Although not illustrated, it is preferable that a foreign matter removing means for removing foreign matters, such as dust or paper waste, adhering to the recording medium P is provided in proximity to the feed roller pair 62. As the foreign matter removing means, a means based on a known non-contact method, such as suction removal, blowing-off removal, or electrostatic removal, or a means based on a contact method using a brush, a roller, or the like may be used alone or in combination. Also, the feed roller pair 62 may be constructed using slightly adhesive rollers and a cleaner may be provided in the feed roller pair 62, which removes foreign matters, such as dust or paper waste, at the time of feeding of the recording medium P by the feed roller pair 62.

The rollers 66*a*, 66*b*, and 66*c* stretch and move the transport belt 68, and at least one of the rollers 66*a*, 66*b*, and 66*c* is connected to a not-shown drive source.

The transport belt 68 functions as a platen for holding the recording medium P and moves the recording medium P at the time of image formation by ink ejected from the ejection head unit 80, and transports the recording medium P to the fixing/transporting means 76 after the image formation. Consequently, an endless belt made of a material that has superior dimensional stability and high endurance is used as the transport belt 68. As the material thereof, a metal, a polyimide resin, a fluororesin, another resin, or a complex thereof is used, for instance.

In the illustrated example, the recording medium P is held on the transport belt 68 through electrostatic adsorption, so that a side (front surface) of the transport belt 68 holding the recording medium P is insulative and a side (back surface) of the transport belt 68 contacting the rollers 66*a*, 66*b*, and 66*c* is conductive. In more detail, the transport belt 68 is a belt produced by applying a fluororesin coat to the front surface of a metallic belt. Also, in the illustrated example, the roller 66*a* is a conductive roller and the back surface (metallic surface) of the transport belt 68 is grounded through the roller 66*a*.

In other words, when holding the recording medium P, the transport belt 68 functions as the counter electrode 20 consisting of the conductive electrode substrate 20*a* and the insulation sheet 20*b* as shown in FIG. 1, and is an example of the transport member 52 for the transport of the recording medium P that constitutes the counter electrode 20 shown in FIG. 12.

It should be noted here that aside from this, a belt having a metallic layer produced with various methods, such as a method with which a metallic belt is coated with any one of the resin materials described above, a method with which a resin sheet and a metallic belt are bonded to each other using an adhesive or the like, or a method with which a metal is vapor-deposited on the back surface of a belt made of the above-mentioned resin, may be suitably used as the transport belt 68.

Also, it is preferable that the surface of the transport belt 68 contacting the recording medium P is made smooth, because with this construction, a favorable adsorption property is obtained for the recording medium P.

It should be noted here that it is preferable that meandering of the transport belt 68 is suppressed with a known method. For instance, the meandering of the transport belt 68 may be suppressed using a method with which tension at both ends in the widthwise direction of the transport belt is changed by setting the roller 66*c* as a tension roller and tilting the axis of the roller 66*c* with respect to the axes of the roller 66*a* and the roller 66*b* in accordance with an output from the transport belt position detection means 69, that is, a detected position of the transport belt 68 in the widthwise direction. Alternatively, the meandering may be suppressed by forming the rollers 66*a*, 66*b*, and 66*c* in a tapered shape or a crown shape, for instance.

The transport belt position detection means 69 detects the position in the widthwise direction of the transport belt 68. With reference to the detected position, the suppression of the meandering of the transport belt described above is performed. In addition, using the detection result, a position in the sub-scanning direction of the recording medium P at the time of image recording is regulated to a predetermined position. The transport belt position detection means 69 performs the detection using a known detection means such as a photosensor.

The electrostatic adsorption means 70 charges the recording medium P to a predetermined potential, as a result of which the recording medium P is adsorbed and held on the transport belt 68 by means of an electrostatic force and applied with a predetermined bias with respect to the ejection head unit 80 for image formation.

In this embodiment, the electrostatic adsorption means 70 includes a scorotron charger 70*a* for charging the recording medium P and a negative high voltage power supply 70*b* connected to the scorotron charger 70*a*. The recording medium P is charged to a negative high voltage by the scorotron charger 70*a* connected to the negative high voltage power supply 70*b* and is electrostatically adsorbed on the insulation layer of the transport belt 68.

It should be noted here that the electrostatic adsorption means 70 has substantially the same construction as the charge unit 22 shown in FIG. 1, and has the same function in that the recording medium P is charged to a predetermined potential.

The electrostatic adsorption means 70 is not limited to the scorotron charger 70*a* of the illustrated example, and it is also possible to use various other means and methods such as a corotron charger, a solid charger, a discharge needle, and the like. Also, as will be described in detail later, at least one of the rollers 66*a*, 66*b*, and 66*c* may be set as a conductive roller or a conductive platen may be arranged on the back surface side (side opposite to the recording medium P) of the transport belt 68 at a recording position to the recording medium P. In this case, the conductive roller or the conductive platen is connected to a negative high voltage power supply. Alternatively, the transport 68 may be set as an insulative belt, the conductive roller may be grounded, and the conductive platen may be connected to the negative high voltage power supply.

After the recording medium P is electrostatically adsorbed on the transport belt 68 by means of an electrostatic force so that no floating of the recording medium P occurs, the electrostatic adsorption means 70 uniformly charges a surface of the recording medium P transported by the transport belt 68. Here, the transport speed of the transport belt 68 at the time of the charge of the recording medium P need only be in a range in which the charge is performed with stability, and it does not matter whether this transport speed is the same as or is different from a transport speed at the time of image recording. Also, by circulating the recording medium P multiple times, the electrostatic adsorption means may charge the same recording medium P multiple times and achieve uniform charge.

It should be noted here that in this embodiment, the electrostatic adsorption and charge of the recording medium P are both performed using the electrostatic adsorption means 70. However, an charge means may be provided separately from the electrostatic adsorption means.

The recording medium P charged by the electrostatic adsorption means 70 is transported to the position of the ejection head unit 80 to be described later by the transport belt 68. In the image forming portion by the ejection head unit 80, a recording signal voltage is applied to the ejection head unit 80 by regarding the charge potential of the recording medium P as a bias. The recording signal voltage is thus superimposed on the bias charge potential thereby ejecting ink (droplets) and forming an image on the recording medium P. Here, by providing a means for heating the transport belt 68 and increasing the temperature of the recording medium, fixation of the ink droplets ejected from the ejection head unit 80 on the print medium may be accelerated. In this case, it becomes possible to further suppress blurring and improve image quality. An image recording method performed by using the ejection head unit 80 for implementing the recording method of the present invention will be described in detail later.

The recording medium P, on which an image has been formed, is discharged by the discharge means 72, is peeled off the transport belt 68 by the peeling means 74, and is transported to the fixing/transporting means 76.

In this embodiment, the discharge means 72 includes a corotron discharger 72*a*, an AC power supply 72*b* connected to the corotron discharger 72*a*, a DC high voltage power supply 72*c* connected to the AC power supply 72*b*, with a terminal of the DC high voltage power supply 72*c* on one side being grounded. The discharge means 72 of the illustrated case uses a so-called AC corotron discharger that uses the corotron discharger 72*a* and the AC power supply 72*b*, although it is possible to use various other means and methods such as a scorotron discharger, a solid discharger, and a discharge needle, for instance. In addition, a construction using a conductive roller or a conductive platen is suitably used like in the case of the electrostatic adsorption means 70 described above. Also, as the peeling means 74, it is possible to use various known techniques such as a peeling blade, a reverse rotation roller, and an air knife.

The recording medium P peeled off the transport belt 68 is sent to the fixing/transporting means 76, which then fixes the image formed by the ink. In this embodiment, as the fixing/transporting means 76, a roll pair composed of a heat roll 76*a* and a transport roll 76*b* is used. With this construction, during the transport of the recording medium P by the fixing/transporting means 76, fixing of the image formed on the recording medium P is achieved through contact heating. In the present invention, however, a fixing means may be provided separately from the transport means composed of the transport roll pair to perform fixing by another fixing means or fixing method.

In addition to the fixing using the heat rolls described above, commonly known heat-fixing means such as irradiation by an infrared ray lamp, a halogen lamp or a xenon flash lamp, or hot-air fixing using a heater can be used for the heat-fixing.

In the case of heat-fixing, when coated paper or laminated paper is used as the recording medium P, there occurs a phenomenon called "blister" where moisture in the paper is abruptly vaporized due to a sudden increase in temperature and projections and depressions occur to the paper surface. In order to prevent this phenomenon, it is preferable that the paper temperature is gradually increased by, for instance, arranging multiple fixing devices and changing at least one of the electric power supply to each fixing device and a distance from each fixing device to the recording medium P.

It is preferable that at least in a process from the image formation by the ink from the ejection head unit 80 to the fixing by the fixing/transporting means 76, the image forming surface of the recording medium P is maintained so as not to contact anything.

The moving speed of the recording medium P at the time of fixing by the fixing/transporting means 76 is not specifically limited and may be the same as or different from the transport speed by the transport belt 68 at the time of image formation. When the moving speed of the recording medium P is different from the transport speed at the time of image formation, it is also preferable that a speed buffer is provided for the recording medium P immediately before the fixing/transporting means 76.

The recording medium P, on which an image has been fixed, is discharged onto the not-shown discharged sheet stocker while being guided by the guide 78.

Next, an image forming (drawing) means in the ink jet printer 60 and an image recording method performed thereby will be described.

As described above, the image forming means of the ink jet printer 60 includes the ejection head unit 80 for ejecting ink, the ink circulation system 82 that supplies the ink to the ejection head unit 80 and recovers the ink from the ejection head unit 80, the head driver 84 that drives the ejection head unit 80 in accordance with an output image signal from a not-shown external apparatus such as a computer or a raster image processor (RIP), the recording medium position detection means 86 for detecting the recording medium P in order to determine an image formation (recording) position on the recording medium P, and the recording position control means 88 for controlling the position of the ejection head unit 80.

Figure 15:
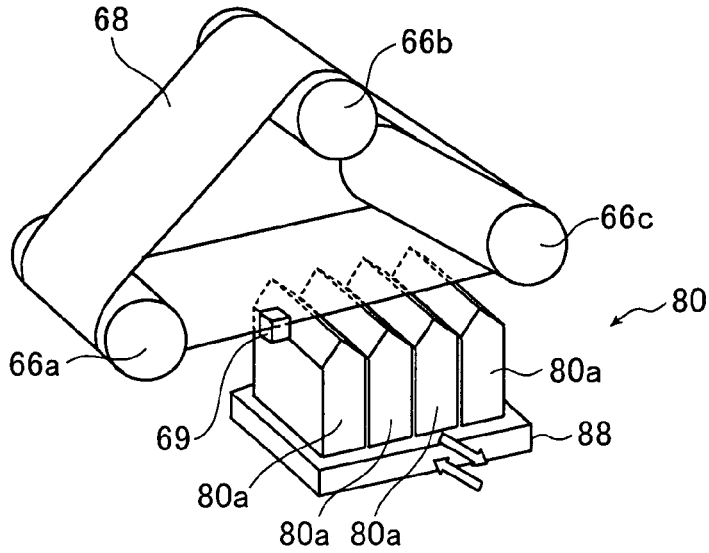
FIG. 15 is a schematic perspective view showing an ejection head and recording medium transport means on the periphery of the ejection head.

FIG. 15 is a schematic perspective view showing the ejection head unit 80, the recording position control means 88, and the transport means for the recording medium P on the periphery thereof.

The ejection head unit 80 includes ejection heads 80*a* for four colors of cyan (C), magenta (M), yellow (Y), and black (K) for recording a full-color image, and forms an image on the recording medium P transported by the transport belt 68 at a predetermined speed by ejecting ink supplied by the ink circulation system 82 as ink droplets in accordance with signals from the head driver 84. The ink jet heads for the respective colors are arranged along a traveling direction of the transport belt 68. The ejection heads 80*a* for the respective colors in the ejection head unit 80 are constructed of the ink jet heads of the present invention, to be more specific, various ink jet heads of various head structures as shown in FIG. 1 to FIG. 13, in particular the ink jet head 50 whose head structure is shown in FIG. 9 to FIG. 13.

As each ejection head 80*a* for each color of the ejection head unit 80, it is possible to use a multi-channel head in which multiple nozzles (each nozzle corresponds to one unit of the ejection head that ejects ink droplets) are arranged at predetermined intervals in a predetermined area in a direction (widthwise direction) orthogonal to the transport direction of the recording medium P. Alternatively, it is possible to use a full-line head in which nozzles for the respective colors are arranged in an entire area in the widthwise direction of the recording medium P.

The ink jet printer 60 of the illustrated case performs main scanning by transporting the recording medium P with respect to the ejection head unit 80 using the transport belt 68. With this construction, the ink jet printer 60 of the illustrated case becomes capable of performing image formation (drawing) at a higher speed as compared with a case of a commercially available ink jet printer that serially scans its ejection head.

When the multi-channel head is used as the ejection head unit 80 (the ejection head 80*a*), the main scanning is performed by transporting the recording medium P with respect to the ejection head unit 80 through rotation of the transport belt 68 under a state where the recording medium P is held on the transport belt 68. Also, sub-scanning is performed by continuously moving the ejection head unit 80 in the widthwise direction of the transport belt 68 or by sequentially (intermittently) moving the ejection head unit 80 in the widthwise direction each time the transport belt 68 makes one rotation. In this manner, an image is formed on the recording medium P. Consequently, in order to form an image on the entire area of the recording medium P, the transport belt 68 is rotated multiple times while holding the recording medium P, that is, the main scanning is performed multiple times. Note that an sub-scanning method of the ejection head unit 80 in this case may be selected as appropriate in accordance with the relation between the nozzle density of the ejection head unit 80 and drawing resolution, an interlace method, and the like.

On the other hand, when the full-line head is used as the ejection head unit 80, an image is formed on the entire area of the recording medium P merely by transporting the recording medium P held on the transport belt 68 with respect to the ejection head unit 80 and having the recording medium P pass by the ejection head unit 80 once, that is, by performing scanning only once.

After an image is formed on the entire area of the recording medium P by the ejection head unit 80 (the multi-channel head or the full-line head) in this manner, the recording medium P is nipped and transported by the fixing/transporting means 76, during which the formed image is fixed by the fixing/transporting means 76.

It should be noted here that in the above description, when the ejection head unit 80 uses the multi-channel head, the main scanning is performed by transporting the recording medium P in a transport direction of the transport belt 68 using the transport belt 68 and the sub-scanning is performed by moving the ejection head unit 80 in the widthwise direction of the transport belt 68, that is, in a direction approximately orthogonal to the main scanning direction. Also, when the ejection head unit 80 uses the full-line head, the entire surface of the recording medium P is scanned by transporting the recording medium P in the transport direction of the transport belt 68 using the transport belt 68. However, the present invention is not limited to this and any other scanning method may be used so long as it is possible to scan the entire surface of the recording medium P with the ejection head unit 80 by relatively moving the recording medium P and the ejection head unit 80. For instance, the main scanning may be performed by moving the ejection head unit 80 in the widthwise direction of the transport belt 68 and the sub-scanning may be performed by transporting the recording medium P using the transport belt 68. Alternatively, the main scanning and the sub-scanning may be performed by transporting the recording medium P in the transport direction of the transport belt 68 and moving the transport belt 68 in the widthwise direction of the transport belt 68 while fixing the ejection head unit 80. Still alternatively, the recording medium P may be held on a holding means at a predetermined position (for instance, the recording medium P is stationarily held on the transport belt 68 stopped at a predetermined position) and the entire surface of the recording medium P may be scanned by one-dimensionally moving the ejection head unit 80 (in the case of the full-line head) or by two-dimensionally moving the ejection head unit 80 (in the case of the multi-channel head).

Next, in order to have ink, whose amount is sufficient for ink ejection, flow through the ink flow path 30 (see FIG. 13, for instance) of the ink jet head 50 used in each ejection head 80*a* for each color of the ejection head unit 80, the ink circulation system 82 includes an ink circulation apparatus 82*a* including an ink tanks, a pump, a replenishing ink tank (not shown), and the like for each of four colors (C, M, Y, and K). The ink circulation system 82 also includes an ink supplying system 82*b* that includes ink supplying paths each composed of an ink distribution pipe system for each color for supplying the ink in each color from each ink tank of the ink circulation apparatus 82*a* to the ink flow path 30 (see FIG. 13, for instance) of the ink jet head 50 used in each ejection head 80*a* for each color of the ejection head unit 80 from the right side in FIG. 13. The ink circulation system 82 further includes an ink recovery system 82*c* that includes ink recovery paths each composed of an ink distribution pipe system for each color for recovering the ink from the ink flow path 30 (from the left side in FIG. 13) of the ink jet head 50 used in each ejection head 80*a* for each color of the ejection head unit 80 to the ink circulation apparatus 82*a*.

The ink circulation system 82 is not specifically limited so long as it is possible to circulate the ink by supplying the ink from the ink tanks of the ink circulation apparatus 82*a* to the ejection head unit 80 through the ink supplying system 82*b* independently of respective colors and recovering the ink from the ejection head unit 80 to the ink tanks through the ink recovery system 82*c* independently of respective colors. Each ink tank reserves the ink in a corresponding color for image recording, with the reserved ink being pumped up by a pump and sent to the ejection head unit 80. The ejection of the ink from the ejection head unit 80 lowers the concentration of the ink circulated by the ink circulation system 82, so that it is preferable that the ink circulation system 82 is constructed so that the ink concentration is detected using an ink concentration detector and the ink is refilled as appropriate from the replenishing ink tanks in accordance with the detected ink concentration. With this construction, it becomes possible to maintain the ink concentration in a predetermined range.

Also, it is preferable that the ink tanks are each provided with a stirring apparatus for suppressing deposition/coagulation of a solid component of the ink and an ink temperature management apparatus for suppressing changes in temperature of the ink. This is because if the temperature management is not performed, the ink temperature changes due to changes in environmental temperature or the like and therefore there occur changes in physical properties of the ink and in size of dots, so that there is a possibility that it may become impossible to form high-quality images with stability.

As the stirring apparatus, it is possible to use a rotary blade, an ultrasonic transducer, a circulation pump, or the like.

As the ink temperature control apparatus, it is possible to use various known methods such as a method with which a heat generation element or a cooling element, such as a heater or a Peltier element, is provided for the ejection head unit 80, the ink tanks, the ink distribution pipe systems, or the like and the ink temperature is controlled using a temperature sensor such as a thermostat. When the temperature control apparatus is arranged in the ink tanks, it is preferable that the temperature control apparatus is arranged together with a stirring apparatus, thereby making it possible to maintain a temperature uniform in the tank. The stirring apparatus, with which a density in each tank is maintained uniform, may be used also as the stirring apparatus that suppresses the deposition/coagulation of the solid component of the ink.

The head driver 84 receives image data from a system control portion (not shown) that receives image data from an external apparatus and performs various processing on the image data, and drives the ejection head unit 80 based on the image data. The system control portion color-separates the image data received from the external apparatus such as a computer, an RIP, an image scanner, a magnetic disk apparatus, or an image data transmission apparatus. The system control portion then performs division computation into an appropriate number of pixels and an appropriate number of gradations, performs screening processing, performs computation of a halftone dot area ratio on the color-separated data, and outputs head drive data corresponding to the image data to the head driver 84. The head driver 84 drives the ejection head unit 80 (ink jet head 50) in accordance with the head drive data.

Also, the system control portion controls movement of the ejection head unit 80 (recording position control means 88) and timings of ink ejection by the ejection head unit 80 in accordance with transport timings of the recording medium P by the transport belt 68. The ejection timings are controlled using an output from the recording medium position detection means 86 or an output signal from an encoder or a photo interpreter arranged for the transport belt 68 or a drive means of the transport belt 68.

The recording medium position detection means 86 detects the recording medium P transported to a position at which the ejection head unit 80 ejects ink droplets, and may be any known detection means such as a photosensor.

The recording position control means 88, on which the ejection head unit 80 is mounted/fixed, moves the ejection head unit 80 in the widthwise direction of the transport belt 68 and adjusts an image forming position onto the recording medium P in the widthwise direction. That is, in order to perform fine adjustment of image formation at a predetermined position on the recording medium P and to perform sub-scanning when the multi-channel head is used as the ejection head unit 80, the recording position control means 88 moves the ejection head unit 80 in accordance with the position of the transport belt 68 detected by the transport belt position detection means 69 and an image signal from the head driver 84.

The solvent collecting means in the ink jet printer 60 will now be described. The ink jet printer 60 includes the discharge fan 90 and the solvent collecting device 92 as the solvent collecting means to thereby collect a dispersion solvent that vaporizes from an ink droplet which was ejected from the ejection head 80*a* on the recording medium P and which includes a charged fine particle component and a dispersion solvent for dispersing the charged fine particle component therein, and in particular a dispersion solvent vaporizing from the recording medium P during the fixation of an image formed by the ink droplet.

The discharge fan 90 aspirates air in the enclosure 61 of the ink jet printer 60 and supplies it to the solvent collecting device 92.

The solvent collecting device 92 is provided with a solvent vapor adsorbent. The solvent component of a solvent vapor-containing gas aspirated by the discharge fan 90 is adsorbed on the solvent vapor adsorbent and the gas from which the solvent has been removed by adsorption is then discharged outside the enclosure 61 of the ink jet printer 60. Various kinds of activated carbon can be suitably used for the solvent vapor adsorbent.

In each embodiment described above, an electrostatic ink jet recording apparatus that records a color image using ink in four colors of C, M, Y, and K has been described, although the present invention is not limited to this. For instance, the present invention may be applied to a monochrome recording apparatus or a recording apparatus that also uses ink in other colors such as light colors or special colors. In these cases, one or more ejection heads 80*a* and ink circulation systems 82 whose number corresponds to the number of ink colors are used.

Also, in each embodiment described above, an ink jet recording apparatus has been described which performs image recording using ink ejected by positively charging color particles in ink and setting a recording medium or a counter electrode on the back surface of the recording medium at a negative high voltage. However, the present invention is not limited to this and may be applied to an apparatus that performs image recording using ink ejected by negatively charging color particles in ink and setting a recording medium or a counter electrode at a positive high voltage. When the polarity of the charged color particles are set opposite to that in the embodiments described above in this manner, the polarities of voltages applied to the electrostatic adsorption means, the counter electrode, and the drive electrodes of the ink jet head and the like are set opposite to those in the embodiments described above.

The electrostatic ink jet heads according to the first and second aspects, the electrostatic ink jet recording apparatus according to the third aspect, and the electrostatic ink jet recording method according to the fourth aspect of the present invention are basically as described above.

Next, an ink jet head according to a fifth aspect of the present invention, a recording apparatus according to a sixth aspect, and a recording method according to a seventh aspect will be described with reference to FIGS. 16 to 21.

First, an embodiment of the ink jet head according to the fifth aspect of the present invention will be described.

Figure 16:
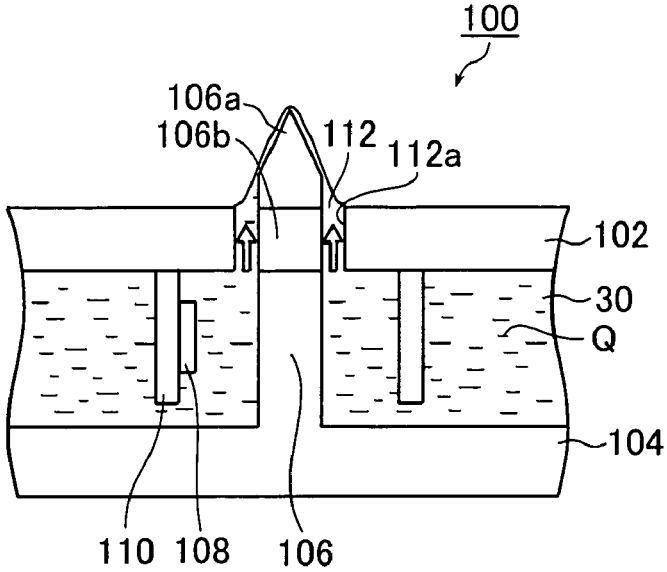
FIG. 16 is a schematic cross-sectional view showing an outlined construction of another embodiment of the ink jet head according to the present invention.

FIG. 16 is a schematic cross-sectional view showing an outlined construction of the embodiment of the ink jet head according to the fifth aspect of the present invention that is used in the ink jet recording apparatus according to the sixth aspect of the present invention.

An ink jet head 100 shown in FIG. 16 records an image on a recording medium in accordance with image data by ejecting ink Q containing a colorant component as ink droplets toward the recording medium using predetermined ejection means. More specifically, the ink jet head 100 shown in FIG. 16 includes an ejection port plate 102, a substrate 104, an ink guide 106, and an ejection means 108. The ink jet head 100 further includes partition walls 110 in accordance with a recording system adopted by the ejection means 108. The recording medium is arranged at a position (upper side in the drawing) opposing a tip end portion 106*a* of the ink guide 106. An ink droplet of the ink Q ejected from the tip end portion 106*a* flies toward the recording medium (not shown) in an upward direction in the drawing and impinges on the recording medium at a predetermined position, thereby forming a dot of an image.

It should be noted here that in the case shown in FIG. 16, only one ejection portion constituting the ink jet head 100 is conceptually illustrated. In the ink jet head 100 of the present invention, however, the number of ejection portions is not specifically limited so long as at least one ejection portion is provided. Also, no limitation is imposed on physical arrangement and the like of the ejection portions. For instance, it is also possible to construct a line head by one-dimensionally or two-dimensionally arranging multiple ejection portions. Also, by providing multiple ink jet heads 100 of the present invention whose number is equal to the number of ink colors used, it becomes possible to cope with color recording as well as monochrome recording.

In the ejection port plate 102, multiple opening portions that each have a predetermined shape and serve as an ejection port 112 are formed at predetermined intervals. Each ejection port 112 is one independent ejection portion and the ejection means 108 is provided for each ejection portion.

The substrate 104 is provided so as to be spaced apart from the ejection port plate 102 by a predetermined distance and an ink chamber (ink flow path) 30 is formed between the ejection port plate 102 and the substrate 104. The ink chamber 30 includes a not-shown ink supply port and ink recovery port as necessary and is connected to a not-shown ink supply system. Also, in the ink chamber 30, the partition walls 110 that divide the ink chamber 30 into sections for respective ejection portions while maintaining a flow path of the ink Q are provided in accordance with the recording system adopted by the ejection means 108. In the illustrated case, the partition walls 110 are provided for the ejection port plate 102 and a substrate 104 side is set as the ink flow path communicating with each ejection portion.

The ink guide 106 guides the ink Q in the ink chamber 30 to an ejection position and is provided on the substrate 104 at a position corresponding to each ejection port 112. The ink guide 106 is arranged so as to pass through substantially the center of the ejection port 112, with its tip end protruding from a surface (upper surface in the drawing) on the recording medium P side of the ejection port plate 102. In the illustrated case, the ink guide 106 is provided on the substrate 104, although the present invention is not limited to this so long as the ink guide 106 is provided in substantially the center of the ejection port 112. For instance, there may be used a form in which the ink guide 106 itself is not be provided on the substrate 104 or the like but a member for supporting the ink guide 106 is attached to the substrate 104, the ejection port plate 102, or the partition wall 110 and fixedly supports the ink guide 106.

Also, the ink guide 106 includes an ink-repellent portion 106*b* (having ink-repellent property) in its region existing inside the ejection port 112, that is, in a region surrounded by an inner wall surface 112*a* of the ejection port 112. A contact angle of the surface of the ink-repellent portion 106*b* with respect to the ink Q is set larger than a contact angle of the inner wall surface 112*a* of the ejection port 112 with respect to the ink Q. Also, the ink-repellent portion 106*b* has an ink-repellent surface. A preferable range of the contact angle of the ink-repellent portion 106*b* with respect to the ink Q will be described later.

The ink-repellent portion 106*b* is configured with an ink-repellent member, made of an ink-repellent material or processed with the ink-repellent material, for example, formed by performing surface treatment such as coating of a predetermined region of the ink guide 106 with the ink-repellent material. The ink-repellent material used to obtain the ink-repellent portion 106*b* is selected in accordance with the ink Q used in the ink jet head 100.

Also, when the supporting member or the like of the ink guide 106 exists inside the ejection port 112, a region of the supporting member or the like existing inside the ejection port 112 need only be constructed so as to have the same contact angle as the ink-repellent portion 106*b*.

The ejection means 108 is known ejection means that causes ejection of an ink droplet of the ink Q from the ink jet head 100 and is provided for each ejection portion. When the ink jet head 100 is used in an electrostatic ink jet recording apparatus, for instance, an ejection electrode or the like is provided for each ejection port 112 as the ejection means 108. Also, in the case of a thermal or bubble-jet (registered trademark) ink jet recording apparatus, a heating element or the like is provided for each ejection portion. Further, in the case of a piezoelectric ink jet recording apparatus, a piezoelectric element or the like is provided for each ejection portion. The ejection means 108 is controlled by not-shown control means in accordance with an image to be recorded on the recording medium.

It should be noted here that the ink jet recording apparatus of the present invention equipped with the ink jet head 100 further includes an ink supply system that is connected to the ink jet head 100 and supplies the ink Q to the ink chamber 30 at a predetermined speed. For the above operation, the ink supply system includes an ink tank, a supply pipe that connects the ink tank to the supply port of the ink chamber 30, a pump, various measuring instruments, and the like. Also, the ink jet recording apparatus may include an ink recovery system for recovering the ink Q from the ink chamber 30 as necessary.

Plural sets of the ink jet head 100, the ink supply system, and the like are prepared in a number corresponding to the requisite number of ink colors in accordance with a recording form of the ink jet recording apparatus in which these elements are implemented.

The ink jet head 100 having the construction described above includes a structural member in the ejection port 112, that is, the ink-repellent portion 106*b* of the ink guide 106 or an ink-repellent portion of the supporting member of the ink guide 106, so that it becomes possible to reduce an ejection force required to supply the ink Q to the tip end portion 106*a* and to eject the ink Q from the tip end portion 106*a*.

In the ink jet head 100, a predetermined amount of the ink Q is supplied from the ink chamber 30 to the tip end portion 106*a* and an ink droplet having a predetermined size is ejected from the tip end portion 106*a* by the ejection means 108. Here, in the ejection port 112, a narrow ink supply path from the ink chamber 30 to the tip end portion 106*a* is formed between the inner wall surface 112*a* and the ink guide 106. By providing the ink-repellent portion 106*b* in a region of the ink guide 106 constituting this narrow ink supply path, an ink-pulling-out resistance is reduced in the ink-repellent portion 106*b*, which makes it possible to reduce a force required to pull out or push out the ink Q from the narrow ink supply path and to reduce an ejection force. Also, ink supply to the tip end portion 106*a* is performed swiftly, so that it becomes possible to prevent drawing failures, ejection delays, and the like due to insufficient supply of the ink Q.

Also, the ink Q will never adhere to the ink-repellent portion 106*b* provided, so that an effect is achieved in that clogging of the ejection port 112 can be prevented.

Also, in order to sufficiently reduce the ink-pulling-out resistance in the ink-repellent portion 106*b*, the contact angle of the ink-repellent portion 106*b* with respect to the ink Q is preferably set at 20° or larger, more preferably at 30° or larger.

However, if the contact angle of the ink-repellent portion 106*b* is increased too much, the ink Q is repelled by the ink-repellent portion 106*b*, which makes it impossible for the ink Q to pass through the ejection port 112 and to be supplied to the tip end portion 106*a*. Consequently, it is preferable that the contact angle of the ink-repellent portion 106*b* with respect to the ink Q is set at 90° or smaller.

On the other hand, it is preferable that the contact angle of the inner wall surface 112*a* of the ejection port 112 with respect to the ink Q is set small so that it is possible to maintain a pulled-out state of the ink Q to the peripheries of the ejection portion with stability and to preserve an end portion of an ink meniscus M contacting the ejection port plate 102 even before and after ejection.

As described above, the contact angle of the inner wall surface 112*a* of the ejection port 112 with respect to the ink Q is kept small, so that it becomes possible to pull out the ink Q to the ejection portion with stability and to fix the end portion of the ink meniscus M to a rim portion on the recording medium P side of the inner wall surface 112*a*. In addition, the contact angle of the ink-repellent portion 106*b* with respect to the ink Q is set larger than that of the inner wall surface 112*a*, so that it becomes possible to swiftly supply the ink Q to the ejection portion (tip end portion 106*a*) with a low ejection force each time ejection is performed.

The contact angle of the ink-repellent portion 106*b* with respect to the ink Q is set larger than the contact angle of the inner wall surface 112*a* with respect to the ink Q, as described above. Here, it is preferable that the difference between these contact angles is set at 10° or larger. As a result, it is possible to obtain the effects described above.

It should be noted here that the ink-repellent portion 106*b* need only be provided in at least a region of the ink guide 106 existing inside the ejection port 112 of the ejection port plate 102. Therefore, it does not matter whether the ink-repellent portion 106*b* is provided only in a partial region of the ink guide 106 or in the entire region thereof. Also, the ink-repellent portion 106*b* may be provided so that a region of the ink guide 106 on the substrate 104 side or the tip end portion 106*a* side is included in the ink-repellent portion 106*b*. Further, the ink guide 106 may be formed using an ink-repellent material, thereby setting the whole of the ink guide 106 as the ink-repellent portion 106*b*. In this case, however, if the contact angle of the tip end portion 106*a* with respect to the ink Q is set large, the ink Q is easily released from the tip end portion 106*a*, which may result in an inconvenient situation where an amount of the ink Q ejected by the ejection means 108 exceeds a predetermined amount or the ink Q is ejected at the time of non-ejection. Therefore, it is preferable that the tip end portion 106*a* is set as a anti-ink-repellent portion having a predetermined small contact angle with respect to the ink Q (an affinity for the ink or ink-affinitive property) instead of the ink-repellent portion 106*b*. With this construction, it becomes possible to hold the ink Q after a tail portion of the ink Q ejected is cut.

With the construction described above, it becomes possible to reduce an ejection force while maintaining the ink meniscus M with stability. As a result, even if the ink Q used has a small surface tension or the distance between the inner wall surface 112*a* and the ink guide 106 is increased, for instance, there is prevented a situation where it is difficult to preserve the ink meniscus M and to obtain ejection stability.

Next, an operation of the ink jet head 100 in the ink jet recording apparatus equipped with the ink jet head 100 will be described.

When an apparatus power source of this ink jet recording apparatus is turned on, supply of the ink Q to the ink chamber 30 of the ink jet head 100 is started. The ink Q is pushed out or pulled out through a tight space between the inner wall surface 112*a* of the ejection port 112 and the ink guide 106 (ink-repellent portion 106*b*), and is supplied to the tip end portion 106*a* of the ink guide 106. Then, the ink meniscus M is formed at the tip end portion 106*a*. Here, the ink-repellent portion 106*b* is provided for the ink guide 106, so that even at the time of start of the recording apparatus, the ink Q is supplied to the tip end portion 106*a* without delay, which makes it possible to prevent drawing failures even at the time of start of recording and to perform favorable recording from the beginning.

When the ejection means 108 is operated in accordance with an image to be recorded on a recording medium, a predetermined amount of the ink Q is supplied to the tip end portion 106*a* from the ink chamber 30 through the ejection port 112 and a predetermined amount of the ink Q is ejected as an ink droplet from the tip end portion 106*a* toward the recording medium. Here, the ink-repellent portion 106*b* is provided for the ink guide 106, so that a resistance force at the time of passage of the ink Q through the tight space of the ejection port 112 is suppressed. Consequently, it becomes possible to reduce an ink ejection force that needs to be applied by the ejection means 108.

After a predetermined amount of the ink Q flies, the shape of the ink meniscus M is restored by the ink Q newly supplied. The contact angle of the inner wall surface 112*a* with respect to the ink Q is set small, so that there is prevented a situation where the ink Q easily slides. As a result, it becomes possible to fix an end portion of the ink meniscus M formed in proximity to the tip end portion 106*a* even before and after the ejection of the ink Q, which makes it possible to perform stabilized recording.

It should be noted here that in the present invention, ink where pigments or dyes are dispersed in a solvent is used as the ink Q contained in the ink chamber 30. As the solvent, it is possible to use various known solvents used for recording ink. Also, the pigments and dyes are not specifically limited and it is possible to use various conventionally known pigments and dyes.

It should be noted here that in this embodiment, a case has been described in which the tip end of the ink guide 106 protrudes from the surface on the recording medium P side of the ejection port plate 102, although the present invention is not limited to this. For instance, the tip end of the ink guide 106 may be provided at a position lower than the surface of the ejection port plate 102, that is, at a position inside the ejection port 112.

Also, the position of the ink guide 106 is not limited to the form where the ink guide 106 is arranged in substantially the center of the ejection port 112 and the ink guide 106 need only be arranged at a predetermined position at which it is possible to guide the ink Q for ejection.

Next, an embodiment of the recording apparatus according to the sixth aspect of the present invention and the recording method according to the seventh aspect will be described. In this embodiment, an electrostatic ink jet recording apparatus and recording method using the electrostatic ink jet head according to the above embodiment of the fifth aspect of the present invention will be described in detail with reference to FIGS. 17 and 18. Note that as the electrostatic ink jet recording apparatus according to this embodiment of the sixth aspect of the present invention, the electrostatic ink jet head according to the above embodiment of the fifth aspect need only be used as the ejection head 80*a* in the electrostatic ink jet recording apparatus 60 according to the above embodiment of the third aspect of the present invention shown in FIGS. 14 and 15. Therefore, although not illustrated, the present invention is not limited to this.

The electrostatic ink jet head records an image corresponding to image data on a recording medium by ejecting ink by means of an electrostatic force toward the recording medium held at a predetermined bias potential in a space with an ejection electrode or toward a counter electrode on the back of the recording medium through application of a predetermined voltage to each ejection electrode of the ink jet head in accordance with the image data.

Figure 17:
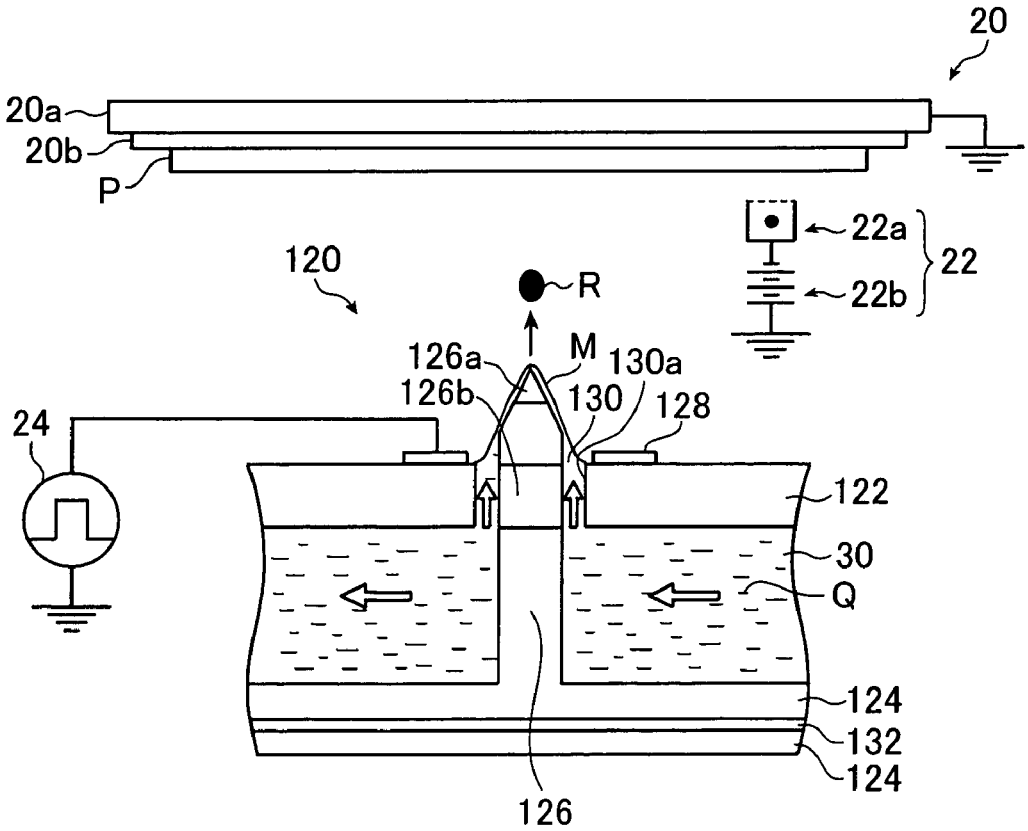
FIG. 17 is a schematic cross-sectional view showing an outlined construction of another embodiment of the ink jet head according to the present invention.
Figure 18:
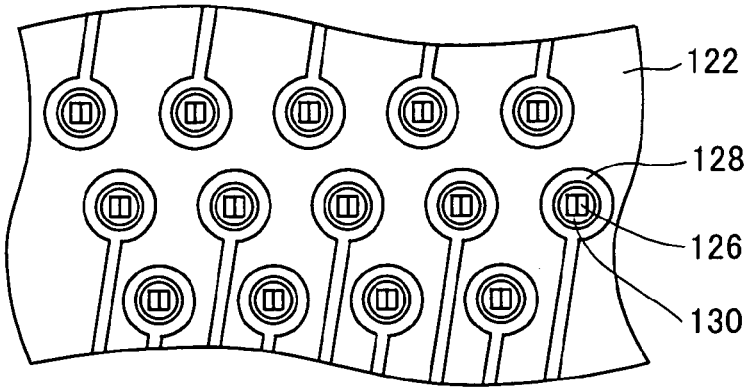
FIG. 18 is a top view of the ink jet head shown in FIG. 17.

FIG. 17 is a schematic cross-sectional view showing an outlined construction of another embodiment of the ink jet head of the present invention used in the ink jet recording apparatus of the present invention, and FIG. 18 is a top view of the ink jet head 120 shown in FIG. 17 as viewed from a recording medium P side.

An electrostatic ink jet head 120 shown in FIG. 17 records an image on a recording medium P in accordance with image data by ejecting ink Q containing an charged fine particle component like pigments (toner, for instance) by means of an electrostatic force. For the above operation, the electrostatic ink jet head 120 shown in FIG. 17 includes an insulating substrate 122, a head substrate 124, an ink guide 126, an ejection electrode 128, a signal voltage source 24, and a floating conduction plate 132. Also, a counter electrode 20 for supporting the recording medium P and an charge unit 22 for charging the recording medium P are provided at a position opposing an ejection portion of the ink jet head 120.

The counter electrode 20 and the recording medium charge unit 22 in this embodiment have the same construction as in the embodiment described above, so that the detailed description thereof is omitted in this embodiment.

It should be noted here that in the embodiment shown in FIG. 17, only one ejection electrode serving as ejection means constituting the ink jet head 120 having a multi-channel structure where multiple ejection portions are two-dimensionally arranged is conceptually illustrated. Like in the embodiment described above, it is possible to freely select the number of ejection electrodes, physical arrangement thereof, and the like in the ink jet head 120.

The insulating substrate 122 corresponds to the ejection port plate 102 of the ink jet head 100 shown in FIG. 16 and is made of a resin (such as polyimide), ceramic, or the like. In the insulating substrate 122, multiple ejection ports 130 are formed at predetermined intervals (see FIG. 18) and the ejection electrode 128 serving as the ejection means is provided for each ejection port 130.

Also, the head substrate 124 is provided so as to be spaced apart from the insulating substrate 122 by a predetermined distance. An ink flow path 30 functioning as an ink reservoir (ink chamber) for supplying the ink Q to the ejection portion is formed between the insulating substrate 122 and the head substrate 124.

The ink Q in the ink flow path 30 contains a fine particle component charged to the same polarity as a voltage applied to the ejection electrode 128. At the time of recording, the ink Q is circulated by a not-shown ink circulation mechanism in a predetermined direction (from the right to the left, in the illustrated case) in the ink flow path 30 at a predetermined speed (ink flow of 200 mm/s, for instance). Hereinafter, a case where the color particles in the ink are positively charged will be described as an example. Also, in the ink Q used in the ink jet head 120, Isoper (registered trademark) G is used as an ink solvent. Note that aside from this, it is possible to use various kinds of ink described above as the ink Q. The effects of the present invention are provided regardless of which kind of ink is used.

A contact angle of an inner wall surface 130*a* of the ejection port 130 formed in the insulating substrate 122 made of polyimide with respect to the ink Q is set small. When Isoper (registered trademark) G or the like is used as the ink solvent like in this embodiment, it is preferable that the contact angle of the inner wall surface 130*a* with respect to the ink Q is set at 20° or smaller.

The ink guide 126 includes a main body made of polyimide and an ink-repellent portion 126*b* made of a fluororesin. The ink guide 126 is a flat-plate-like member having a predetermined thickness and including a protrusion-like tip end portion 126*a*, and is arranged on the head substrate 124 at the position of each ejection port 130. The ink guide 126 passes through substantially the center of the ejection port 130 and the tip end portion 126*a* thereof protrudes upward from a surface on the recording medium P side of the insulating substrate 122. In the illustrated example, the ink-repellent portion 126*b* is provided in a region of the ink guide 126 existing inside the ejection port 130, that is, in substantially the whole of a region of the ink guide 126 surrounded by the inner wall surface 130*a* of the ejection port 130.

As the fluororesin used to form the ink-repellent portion 126*b*, it is possible to suitably use polytetrafluoroethylene (PTFE), tetrafluoroethylene-perfluoroalkoxy ethylene copolymer (PFA), tetrafluoroethylene-hexafluoropropylene copolymer (FEP), tetrafluoroethylene-ethylene copolymer (ETFE), polychlorotrifluoroethylene (PCTFE), chlorotrifluoroethylene-ethylene copolymer (ECTFE), polyvinylidene fluoride (PVDF), polyvinyl fluoride (PVF), or the like. The ink-repellent portion 126*b* made of any of these materials is set so as to have a large contact angle with respect to the ink Q that is in a range of 30 to 60°.

It should be noted here that the whole of the ink guide 126 may be made of polyimide and the ink-repellent portion 126*b* may be obtained by coating a predetermined region of the ink guide 126 with an ink-repellent material. In this case, as the ink-repellent material for coating, it is possible to suitably use an ink-repellent agent that is fluorine-containing copolymer such as Sitop (registered trademark), FTP, or PFA. The ink-repellent portion 126*b* formed using such a material is set so as to have a large contact angle with respect to the ink Q that is in a range of 30 to 60°.

Note that a slit serving as an ink guide groove that guides the ink Q into the tip end portion 126*a* by capillary action may be formed in a center portion of the ink guide 126 in a vertical direction in the drawing.

It should be noted here that the tip end portion 126*a* side of the ink guide 126 is formed to gradually taper into a substantially triangular shape (or a substantially trapezoidal shape) toward the counter electrode 20 side. Here, it is preferable that a metal has been vapor-deposited on the tip end portion (extreme tip end portion) 126*a* of the ink guide 126 from which the ink Q is to be ejected. Although it is not always necessary to carry out the metal vapor-deposition for the tip end portion 126*a* of the ink guide 126, it is preferable that the metal vapor-deposition is conducted because the effective dielectric constant of the tip end portion 126*a* of the ink guide 126 becomes large as a result of the metal vapor-deposition and an effect of easily generating a strong electric field is obtained. Also, the shape of the ink guide 126 is not specifically limited so long as it is possible to concentrate the ink Q, in particular, the charged fine particle component in the ink Q in the tip end portion 126*a* through the ejection port 130 in the insulating substrate 122. For instance, the shape of the tip end portion 126*a* may be changed as appropriate into a shape other than the protrusion, such as a conventionally known shape.

Also, each ejection electrode 128 is arranged in a ring shape, that is, as a circular electrode on the upper surface of the insulating substrate 122 in the drawing, that is, on a surface thereof on a recording medium P side so as to surround the ejection port 130 formed in the insulating substrate 122. Each ejection electrode 128 is connected to the signal voltage source 24 that generates a pulse signal (predetermined pulse voltage) corresponding to ejection data (ejection signal) such as image data or print data. For instance, the signal voltage source 24 generates a pulse signal of 0 V at a low-voltage level and generates a pulse signal of 800 to 1000 V at a high-voltage level. The ejection electrodes 128 are two-dimensionally arranged as shown in FIG. 18.

It should be noted here that the ejection electrode 128 is not limited to the ring-like circular electrode. That is, no specific limitation is imposed on the ejection electrode 128 so long as the electrode is a surrounding electrode arranged so as to surround the outer periphery of the ink guide 126 with a distance.

The floating conduction plate 132 is arranged below the ink flow path 30 and is electrically insulated (in high-impedance state). In the illustrated case, the floating conduction plate 132 is arranged inside the head substrate 124, although the present invention is not limited to this and the position of the floating conduction plate 132 may be changed so long as this plate 132 is arranged below the ink flow path 30. For instance, the floating conduction plate 132 may be arranged below the head substrate 124 or arranged inside the head substrate 124 on an upstream side of the ink flow path 30 with respect to the position of the ejection electrode.

At the time of recording of an image, the floating conduction plate 132 generates an induced voltage in accordance with the value of a voltage applied to the ejection electrode and causes the fine particle component in the ink Q in the ink flow path 30 to migrate to the insulating substrate 122 side and to be concentrated. Consequently, it is required that the floating conduction plate 132 is arranged on the head substrate 124 side with respect to the ink flow path 30. Also, it is preferable that the floating conduction plate 132 is arranged on an upstream side of the ink flow path 30 with respect to the position of the ejection electrode. With this floating conduction plate 132, the concentration of the charged fine particle component in an upper layer in the ink flow path 30 is increased. As a result, it becomes possible to increase the concentration of the charged fine particle component in the ink Q passing through the ejection port 130 of the insulating substrate 122 to a predetermined level, to cause the charged fine particle component to be concentrated in the tip end portion 126*a* of the ink guide 126, and to maintain the concentration of the charged fine particle component in the ink Q ejected as an ink droplet R at a predetermined level.

Also, the induced voltage generated by the floating conduction plate changes in accordance with the number of operating channels, so that even if a voltage to the floating conduction plate is not controlled, charged particles required for ejection is supplied, which makes it possible to prevent clogging. Note that a power source may be connected to the floating conduction plate and a predetermined voltage may be applied thereto.

Because of the two-dimensional arrangement as shown in FIG. 18, the ink jet head 120 may have a guard electrode for suppressing an electric filed interference that may occur between adjacent ejection electrodes. This guard electrode need only be arranged between the adjacent ejection electrodes, on the same surface as the ejection electrodes 128 or on the recording medium P side thereof so as to shield against other electric fields than those required for the respective ejection portions.

In the ink jet head 120 constructed in the manner described above, the ink Q is supplied to the tip end portion 126*a* from the ink flow path 30 by passing through the ejection port 130 and forms an ink meniscus M at the tip end portion 126*a* by means of an electrostatic field generated between the proximity of the tip end portion 126*a* and the negatively charged recording medium P. Here, the ink-repellent portion 126*b* is provided in the region of the ink guide 126 inside the ejection port 130, so that the ink Q passes through the ejection port 130 speedily and is supplied to the tip end portion 126*a* swiftly. Then, in proximity to the tip end portion 126*a*, the positively charged color fine particles in the ink Q are concentrated by means of the electrostatic force.

When a predetermined positive voltage is applied to the ejection electrode 128 by the signal voltage source 24 in accordance with an image, the ink Q where the positively charged fine particles are concentrated at the tip end portion 126*a* is ejected as an ink droplet R having a predetermined size, is attracted by the recording medium P, and impinges on the recording medium P at a predetermined position. In this manner, a dot of an image is formed on the recording medium P. Here, the ink-repellent portion 126*b* is provided as described above, so that it becomes possible to reduce a force required to pull out the ink Q to the tip end portion 126*a* from the ink flow path 30, which makes it possible to reduce a force required to eject the ink droplet R, that is, a voltage applied to the ejection electrode 128. Also, the inner wall surface 130*a* of the ejection port 130 preserves the end portion of the ink meniscus M even before and after ejection, so that it becomes possible to maintain the size of the ink droplet R and the shape of the ink meniscus M with stability, which makes it possible to perform stabilized recording.

Here, the inventor of the present invention measured the recording performance of the ink jet head 120 of the present invention by performing actual recording using an electrostatic ink jet recording apparatus that uses the electrostatic ink jet head 120 shown in FIG. 17 described above that is an embodiment of the ink jet head of the present invention.

In the electrostatic ink jet head 120 shown in FIG. 17, the diameter of the ejection port 130 was set at 130 μm. Also, the ink guide 126 having a thickness (depth in the drawing) of 75 μm and a width of 75 μm was arranged at substantially the center of the ejection port 130, with the tip end thereof protruding from the surface of the insulating substrate 122 by 150 μm. The ejection electrodes 128 were each a circular electrode having an inside diameter of 150 μm and an external diameter of 250 μm, and were arranged on a surface on the recording medium P side of the insulating substrate 122 so as to be substantially concentric with the respective ejection ports 130. Ink produced by dispersing positively charged fine particle component in a solvent (Isoper (registered trademark) G) was used as the ink Q and was circulated in the ink flow path 30 at a flow rate of around 200 mm/s. Also, the counter electrode 20 was arranged so that the recording medium P was spaced apart from the tip end of the ink guide 126 by 500 μm. The recording medium P was negatively charged by the charge unit 22 and a voltage applied to the ejection electrode 128 was changed in a range of 800 to 1000 V.

Also, the insulating substrate 122 was made of polyimide and the contact angle of the inner wall surface 130*a* of the ejection port 130 with respect to the ink Q was set at 5°.

Further, the ink guide 126 was made of polyimide and the ink-repellent portion 126*b* was provided for the whole of a region of the ink guide 126 surrounded by the inner wall surface 130*a* of the ejection port 130. This ink-repellent portion 126*b* was formed by coating the surrounded region with Sitop (registered trademark) and the contact angle of the surface thereof with respect to the ink Q was set larger than the contact angle of the inner wall surface 130*a* by 35°, that is, was set at 40°.

A pulse voltage required for ink ejection in the recording apparatus equipped with this ink jet head 120 was measured. In the case of an ink jet head where the ink guide 126 was not provided with the ink-repellent portion 126*b* and a contact angle of the whole of the ink guide 126 was set at 5°, in order to eject the ink droplet R, it was required to apply a pulse voltage of 1000 V and a bias voltage of −1.5 kV to the ejection electrode 128. On the other hand, in the case of the ink jet head 120 of this embodiment provided with the ink-repellent portion 126*b*, the pulse voltage and bias voltage required for ejection were reduced to 800 V and −1.3 kV, respectively.

Also, in the case of the ink jet head using the ink guide 126 without the ink-repellent portion 126*b*, at the time of image drawing at 5 kHz, dot sizes of the first three dots from the start of recording were reduced. On the other hand, in the case of the ink jet head 120 of this embodiment provided with the ink-repellent portion 126*b*, it was possible to perform drawing with a predetermined dot size from the first dot.

The electrostatic ink jet head 120 as described above has the ejection electrodes 128 such as the circular electrodes arranged on the upper surface of the insulating substrate 122 in the drawing as a mono-layered electrode structure. However, this is not the sole case of the present invention and the ejection electrodes 128 may be arranged on the upper and lower surfaces of the insulating substrate 122 as a two-layered electrode structure.

Figure 19A:
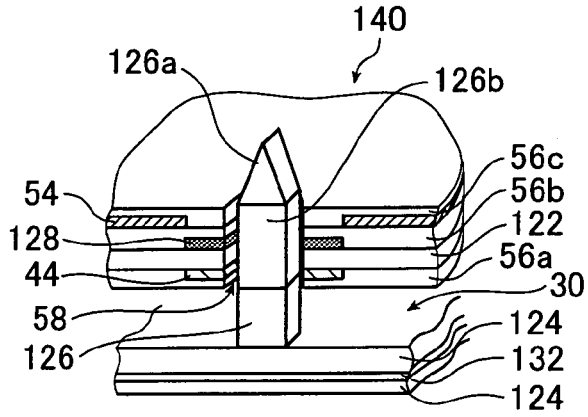
FIG. 19A is a schematic perspective view showing an outlined construction of another embodiment of the ejection electrode of the electrostatic ink jet head according to the present invention.
Figure 19B:
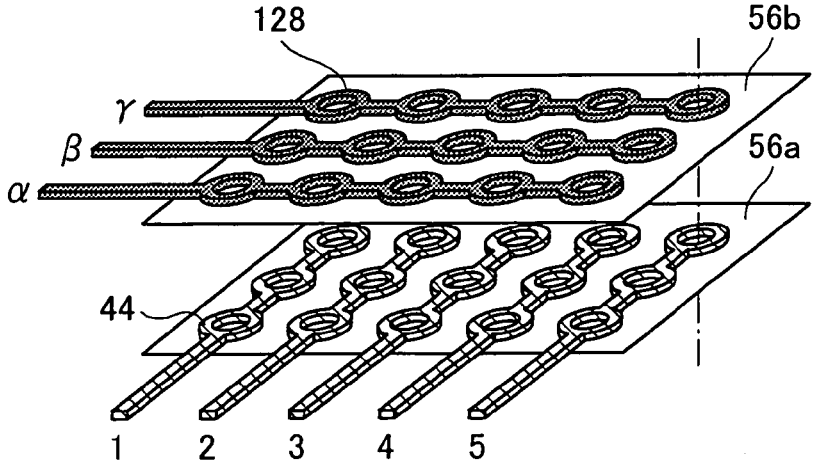
FIG. 19B is a schematic perspective view showing an embodiment of arrangement of first and second drive electrodes used as the individual electrode shown in FIG. 19A.

FIG. 19A and FIG. 19B schematically show an electrostatic ink jet head 140 having ejection electrodes of a two-layered electrode structure according to still another embodiment of the present invention. Note that the inkjet head 140 shown in these drawings has the same construction as the ink jet head 120 shown in FIG. 17 except that the ink jet head 140 shown in FIG. 19A and FIG. 19B includes second drive electrodes 44 provided on the lower surface of the insulating substrate 122 in the drawings, an insulation layer 56*a* provided below the second drive electrodes 44 as well as an insulating layer 56*b*, a guard electrode 54 and an insulation layer 56*c* provided in this order above the ejection electrodes (first drive electrodes) 128 arranged on the upper surface of the insulating substrate 122 in the drawings. Therefore, the same construction elements are given the same reference numerals and the description thereof is omitted in this embodiment. That is, differences will be mainly described in this embodiment.

The ink jet head 140 shown in FIG. 19A adopts the two-layered electrode structure in which the ejection electrodes 128 include the ejection electrodes arranged as the first drive electrodes on the upper surface of the insulating substrate 122 in the drawing (these ejection electrodes being hereinafter referred to as the "first drive electrodes") 128 and the second drive electrodes 44 arranged on the lower surface of the insulating substrate 122 in the drawing. The first drive electrodes 128 and the second drive electrodes 44 are circular electrodes arranged in the respective ejection portions in a ring shape on the upper surface and the lower surface of the insulating substrate 122 so as to surround through holes 58 formed in the insulating substrate 122. The ink jet head 140 also includes the insulation layer 56*a* covering the lower side (lower surface) of the second drive electrodes 44, the sheet-like guard electrode 54 arranged above the first drive electrodes 128 with the insulation layer 56*b* in-between, and the insulation layer 56*c* covering the upper surface of the guard electrode 54. As shown in FIG. 19B, the multiple first drive electrodes 128 are connected to each other in a row direction (main scanning direction) and the multiple second drive electrodes 44 are connected to each other in a column direction (sub-scanning direction).

The through holes 58 are formed so as to also pass through the insulation layer 56*a* below the insulating substrate 122 and the insulation layers 56*b* and 56*c* above the insulating substrate 16. That is, the through holes 58 are formed so as to pass through a layered product of the insulation layer 56*a*, the insulating substrate 122, and the insulation layers 56*b* and 56*c*. Ink guides 126 are inserted into the through holes 58 from an insulation layer 56*a* side so that tip end portions 126*a* of the ink guides 126 protrude from the insulation layer 56*c*. Note that in the illustrated example, no ink guide groove is formed in the tip end portions 126*a* of the ink guides 126, but ink guide grooves may be formed in order to promote concentration of the ink Q and the charged fine particle component in the ink Q to the tip end portions 126*a*. The ink-repellent portion 126 is provided in the portion of the ink guide 126 corresponding to the inside of the through hole 58.

The guard electrode 54 is arranged between the first drive electrodes 128 of adjacent ejection portions and suppresses electric field interferences occurring between the ink guides 126 in adjacent ejection portions. The guard electrode 54 is arranged on the recording medium P side of the ejection electrodes 128 in a predetermined region between adjacent ejection electrodes 128 so as to shield against other electric field than those required for the respective ejection portions.

In this embodiment, at the time of recording, the first drive electrodes 128 are sequentially set at a high-voltage level or under a high-impedance state (ON state) for each row and all of the other first drive electrodes 128 are driven to a ground level (ground state: OFF state). Also, all second drive electrodes 44 are driven to a high-voltage level or a ground level on a column basis in accordance with the image data. Note that as a modification, the first and second drive electrodes 128 and 44 may be driven in a reversed manner.

As shown in FIGS. 19A and 19B, the first and second drive electrodes 128 and 44 are arranged in a matrix manner so as to form the two-layered electrode structure. By the first and second drive electrodes 128 and 44, ink ejection/non-ejection at respective ejection portions is controlled. That is, when the first drive electrodes 128 are set at the high-voltage level or under a floating state and the second drive electrodes 44 are set at the high-voltage level, the ink will be ejected. When one of the first drive electrodes 128 and the second drive electrodes 44 are set at the ground level, the ink will not be ejected.

FIG. 19B is a conceptual diagram showing an exemplary arrangement of the first and second drive electrodes 128 and 44. As shown in this drawing, when the ink jet head 140 includes 15 ejection electrodes (individual electrodes), for instance, five individual electrodes (1, 2, 3, 4, and 5) are arranged on each row in the main scanning direction and three individual electrodes (α, β, and γ) are arranged on each column in the sub-scanning direction. At the time of recording, the five first drive electrodes 128 arranged on the same row are simultaneously driven to the same voltage level. In the same manner, the three second drive electrodes 44 arranged on the same column are simultaneously driven to the same voltage level.

Accordingly, in the electrostatic ink jet head 128 of this embodiment, it is possible to arrange multiple individual electrodes in a two-dimensional manner with respect to the row direction and the column direction.

In the case of the ink jet head shown in FIG. 19B, for instance, the five individual electrodes (first drive electrodes 128) on the row α are arranged at predetermined intervals with respect to the row direction. The same applies to the row β and the row γ. Also, the five individual electrodes on the row β are spaced apart from the row α by a predetermined distance in the column direction and are respectively arranged between the five individual electrodes on the row α and the five individual electrodes on the row γ with respect to the row direction. In the same manner, the five individual electrodes on the row γ are spaced apart from the row β by a predetermined distance in the column direction and are respectively arranged between the five drive electrodes on the row β and the five drive electrodes on the row α with respect to the row direction.

In this manner, the individual electrodes (first drive electrodes 128) on each row are arranged so as to be displaced from the individual electrodes on other rows in the row direction. With this arrangement, one line to be recorded on the recording medium P is divided into three groups in the row direction.

That is, one line to be recorded on the recording medium P is divided into multiple groups, whose number is equal to the number of rows of the first drive electrodes 128 with respect to the row direction and sequential recording is performed in a time-division manner. In the case of the example shown in FIG. 19B, for instance, sequential recording is performed for the rows α, β, and γ of the first drive electrodes 128, thereby recording one line of an image on the recording medium P. In this case, as described above, one line to be recorded on the recording medium P is divided into three groups in the row direction and sequential recording is performed in a time-division manner.

This embodiment can adopt the same construction as that of the ink jet head 50 shown in FIGS. 9, 10A, 10B and 11A to 11C. In this case, this embodiment has the same construction as the previous embodiment for the ink jet head 50 except for the construction of the ink guide 14 which includes the ink-repellent portion 126*b*. Therefore, the detailed description thereof is omitted in this embodiment.

The operation of this embodiment will now be described as to the case where the same construction as that of the ink jet head 50 shown in FIGS. 9, 10A, 10B and 11A to 11C is adopted.

As described above, the first and second drive electrodes 128 and 44 are arranged in a matrix manner so as to form the two-layered electrode structure. By the first and second drive electrodes 128 and 44, ink ejection/non-ejection at respective ejection portions is controlled. That is, when the first drive electrodes 128 are driven on a row basis to be set at the high-voltage level or under a floating state and the second drive electrodes 44 are driven on a column basis in accordance with image data to be set at the high-voltage level, the ink will be ejected from the ejection portions. When one of the first drive electrodes 128 and the second drive electrodes 44 are set at the ground level, the ink will not be ejected.

It should be noted here that in this embodiment, pulse voltages may be applied to the first and second drive electrodes 128 and 44 in accordance with image signals and the ink ejection may be performed when both of these electrodes are set at the high-voltage level.

Figure 20:
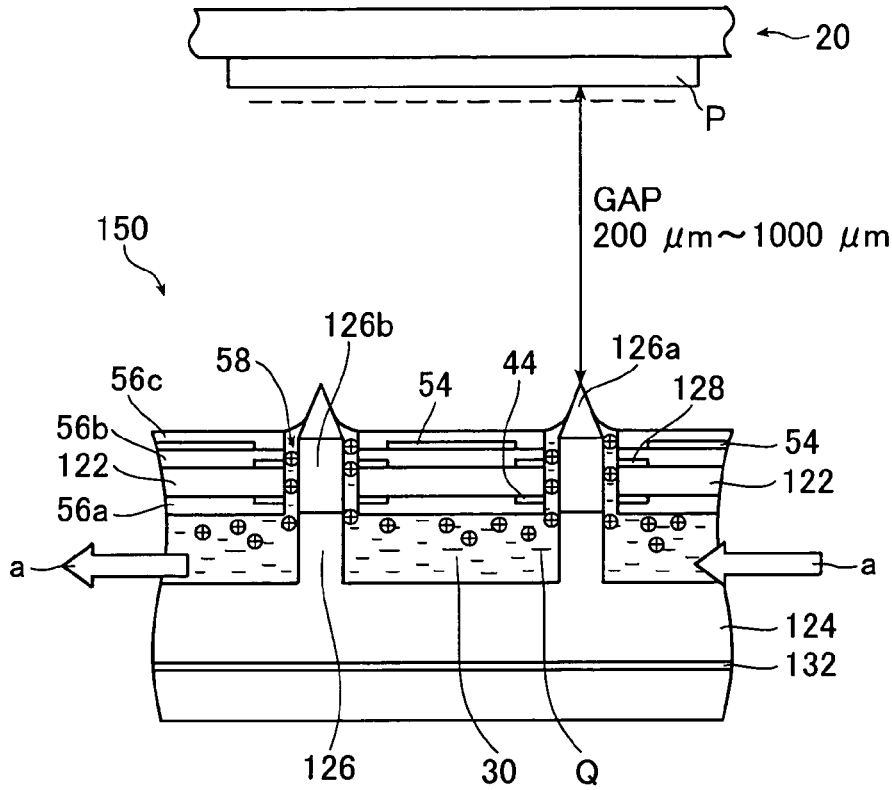
FIG. 20 is a conceptual diagram illustrating an operation of an ink jet head according to another embodiment of the present invention.

For instance, in an ink jet head 150 shown in FIG. 20, when a fine particle component in the ink Q is positively (+) charged, that is, when the ink Q contains positively charged particles, for instance, an electric field with which the ink Q is circulated in a direction of the arrow "a" in an ink flow path 30 of the ink jet head 150 and the positively charged particles in the ink Q (ink droplet) ejected from a tip end portion 126*a* of an ink guide 126 of an ejection portion are attracted by a recording medium P, that is, a flying electric field is formed between first and second drive electrodes 128 and 44 and the recording medium P. A distance (gap) between the tip end portion 126*a* of the ink guide 126 and the recording medium P is set in a range of 200 to 1000 μm, for instance. When the gap is set at 500 μm, the flying electric field is formed by providing a potential difference in a range of 1 kV to 2.5 kV.

Also, by an average voltage applied to the first or second drive electrode 128 or 44, an induced voltage that is lower than the average voltage is almost constantly generated in a floating conduction plate 132, so that an electric field (hereinafter referred to as the "migration electric field", for instance) is formed with which the positively charged particles in the ink Q in the ink flow path 30 functioning as an ink reservoir are attracted upward and the positively charged particles in the ink Q gather in the upper portion of the ink flow path 30. By providing a potential difference of around several hundred V with respect to a thickness of the ink flow path 30 of several mm, for instance, the migration electric field is formed.

For instance, in the ink jet head 150 shown in FIG. 20, the recording medium P is charged to a predetermined negative high voltage (or a counter electrode 48 is biased to a predetermined high voltage) and the first and second drive electrodes 128 and 44 are both set at 0 V (ground state), thereby forming the flying electric field. Then, the guard electrode 54 is set at 0 V (ground state).

Under this state, the ink Q moves upward from the ink flow path 30 to a space between the through hole 58 and the ink guide 126 and gathers in the tip end portion 126*a* by electrophoretic action and capillary action. The ink Q gathering in the tip end portion 126*a* is retained in the tip end portion 126*a* by the surface tension or the like of the ink Q and the concentration of the positively charged particles in the ink Q is increased to a high level.

Figure 21:
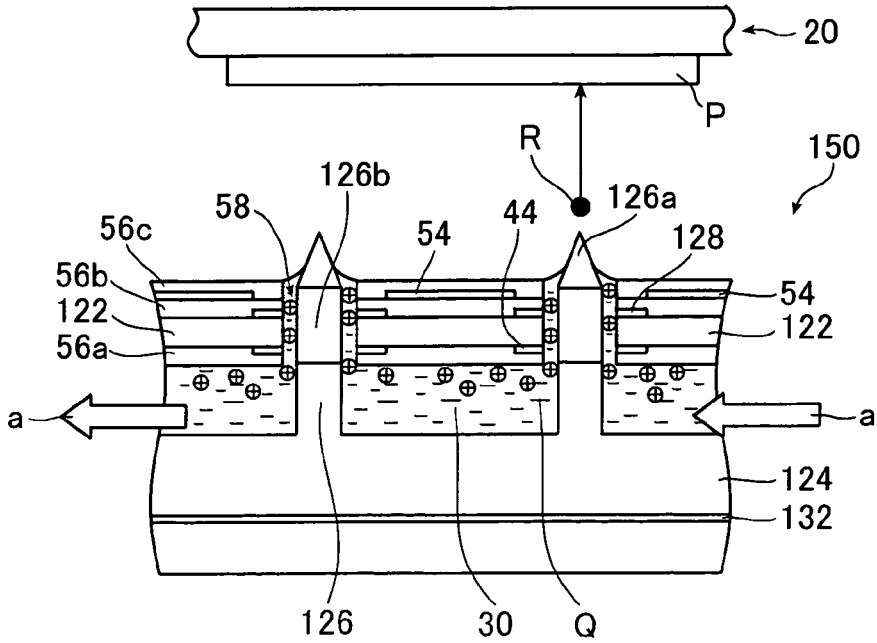
FIG. 21 is a conceptual diagram illustrating a recording operation of the ink jet head shown in FIG. 20.
Figure 22:
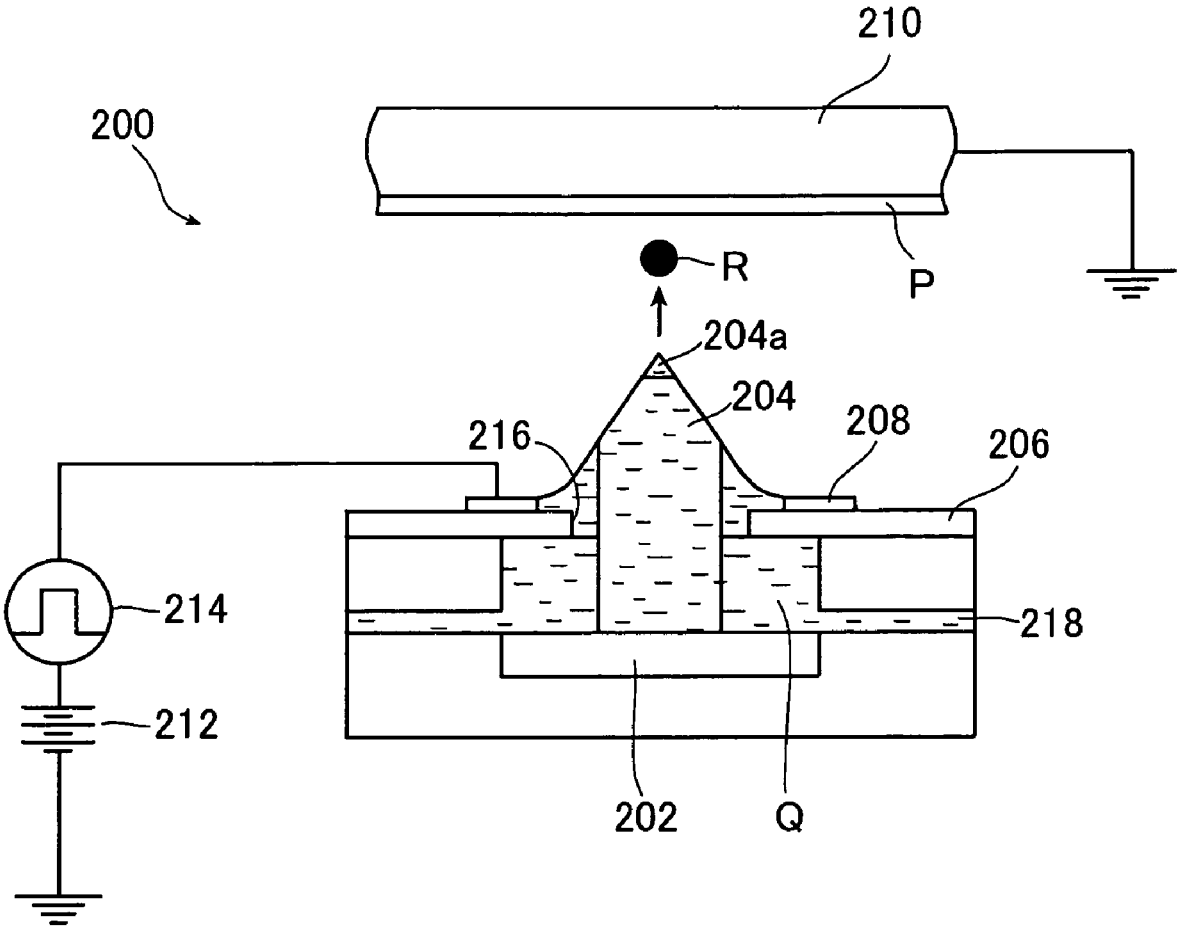
FIG.22 PRIOR ART
FIG. 22 is a conceptual diagram showing an example construction of a conventional electrostatic ink jet head.

Next, as shown in FIG. 21, pulse voltages are applied to the first and second drive electrodes 128 and 44 in accordance with an image signal and an ink droplet R having highly concentrated positively charged particles is ejected from the tip end portion 126*a* of the ink guide 126. For instance, when the initial particle concentration is in a range of 3 to 15%, it is preferable that the particle concentration in the ejected ink droplet R is 30% or higher. Note that the pulse widths of the pulse voltages are not specifically limited, but it is possible to set the pulse widths in the range of several tens of μs to several hundred ps, for instance. Also, the sizes of dots recorded on the recording medium P depend on the magnitudes or application time lengths of the pulse voltages, so that it is possible to adjust the dot sizes by adjusting the pulse voltage magnitudes or application time lengths.

Here, in the ink jet head 150 of this embodiment, the ink guide 126 is provided with the ink-repellent portion 126*b*, so that it is possible to reduce an charge voltage value of the recording medium P (or a bias voltage value of the counter electrode 20) required to suitably eject the ink droplet R as compared with the case of the ink guide without the ink-repellent portion 126*b*. For instance, in the case of the ink guide without the ink-repellent portion 126*b*, it was required to set the bias voltage at −1.5 kV. However, by providing the ink-repellent portion 126*b*, it was possible to reduce the bias voltage to −1.3 kV.

Also, with the ink-repellent portion 126*b*, it becomes possible to reduce the pulse voltages applied to the first and second drive electrodes 128 and 44. For instance, in the case of the ink guide without the ink-repellent portion 126*b*, it was required to apply a pulse voltage of 500 V to each of the first and second drive electrodes 128 and 44. However, with the ink-repellent portion 126*b*, it was possible to suitably perform ink ejection even if each pulse voltage was reduced to 400 V.

It should be noted here that in the ink jet head 150 of this embodiment, it is not specifically limited whether the ink ejection/non-ejection is controlled using one or both of the first drive electrodes 128 and the second drive electrodes 44. However, it is preferable that the ejection of the ink Q is not performed when one of the first drive electrodes 128 and the second drive electrodes 44 are set at the ground level and the ink ejection is performed only when the first drive electrodes 128 are set under the high-impedance state or at the high-voltage level and the second drive electrodes 44 are set at the high-voltage level.

By the way, as in the illustrated example, the guard electrode 54 is provided between adjacent first drive electrodes 128 in the ink jet head 150 of this embodiment, but the present invention is not limited to this. For instance, when the first and second drive electrodes 128 and 44 are matrix-driven, that is, when the second drive electrodes 44 of the lower layer are sequentially driven in units of columns and the first drive electrodes 128 of the upper layer are driven in accordance with image data, the guard electrode may be provided only in spaces between the rows of the first drive electrodes 128. Even in this case, by biasing the guard electrode 54 to a predetermined guard potential (ground level, for instance) at the time of recording, it becomes possible to eliminate the influence of adjacent ejection portions.

Also, when the rows of the first drive electrodes 128 of the upper layer are sequentially turned on and the second drive electrodes 44 of the lower layer are turned on/off in accordance with image data at the time of driving of the ejection electrodes 128, that is, when the arrangement of the rows and columns is interchanged, the second drive electrodes 44 are driven in accordance with the image data. Therefore, the ejection electrodes on both sides of each ejection electrode in the column direction are frequently switched between the high-voltage level and the ground level.

In the row direction, however, the first drive electrodes 128 are driven in units of rows and the first drive electrodes 128 of the ejection electrodes on both sides of a currently driven row are constantly set at the ground level. Consequently, the rows of the ejection electrodes on the both sides play the role of a guard electrode. As described above, when each row of the first drive electrodes 128 of the upper layer are sequentially turned on and the second drive electrodes 44 of the lower layer are driven in accordance with image data, it becomes possible to eliminate the influence of adjacent ejection electrodes and to improve recording quality without providing a guard electrode.

Further, in the ink jet head 150 of this embodiment, the floating conduction plate 132 is provided which constitutes the undersurface of the ink flow path 30 and causes the positively charged ink particles (charged particles, that is, charged fine particle component) in the ink flow path 30 to migrate upwardly (that is, toward the recording medium P side) by means of induced voltages generated by pulse-like ejection voltages applied to the first drive electrodes 128 and the second drive electrodes 44. Also, an electrically insulative coating film (not shown) is formed on a surface of the floating conduction plate 132, thereby preventing a situation where the physical properties and components of the ink are destabilized due to charge injection into the ink or the like. It is preferable that the electric resistance of the insulative coating film is set at $10^{12}$ Ω·cm or higher, more preferably at $10^{13}$ Ω·cm or higher. Also, it is preferable that the insulative coating film is corrosion resistant to the ink, thereby preventing a situation where the floating conduction plate 132 is corroded by the ink. Further, the floating conduction plate 132 is covered with an insulation member from its bottom side. With this construction, the floating conduction plate 132 is completely electrically insulated and floated.

Here, at least one floating conduction plate 132 is provided for each head. That is, in the heads for C, M, Y, and K, each head is provided with at least one floating conduction plate and the heads for C and M will never share the same floating conduction plate.

In the respective embodiments of the electrostatic ink jet heads having the ejection electrodes of the two-layered electrode structure as described above, the counter electrode (recording medium P) may be charged to −2.1 kV, for instance, and the ink ejection may be controlled so that the ink will not be ejected when at least one of the first drive electrodes and the second drive electrodes are set at a negative high voltage (−400 V, for instance) and the ink will be ejected only when both of the first drive electrodes and the second drive electrodes are set at the ground level (0V).

In the respective embodiments described above, the shape of the ejection electrodes 128 (first drive electrode 128, second drive electrode 44) are not limited to be circular but the ejection electrodes 128 may have each a substantially circular shape or a divided circular shape. Alternatively, the ejection electrodes 128 may also be parallel or substantially parallel electrodes.

Further, the ink jet head and the recording apparatus according to the present invention are not limited to the case where ink containing a charged colorant component is ejected. There is no particular limitation as far as the present invention is applied to a liquid ejection head that ejects liquid containing charged particles. For instance, in addition to the electrostatic ink jet recording apparatus as described above, the present invention can be applied to an application apparatus that applies liquid by ejecting droplets using charged particles.

The ink jet head, and the recording apparatus and the recording method using the ink jet head according to the present invention have been described in detail above with reference to various embodiments, although the present invention is not limited to the embodiments described above. That is, it is of course possible to make various modifications and changes without departing from the gist of the present invention.

As described in detail above, according to the first and second aspects of the present invention, it becomes possible to provide an ink jet head that is capable of achieving an ejection voltage reduction, widening the choice of ink guide materials (low dielectric constant material becomes usable, for instance), and widening the choice of ink guide tip end structures (not-pointed shape becomes usable, for instance).

Also, according to the third and fourth aspects of the present invention, it becomes possible to provide a safe, low-cost, and widely applicable electrostatic ink jet recording apparatus and recording method that are capable of recording an image on a recording medium with stability by using the ink jet head providing the effects described above.

Further, according to the fifth, sixth, and seventh aspects of the present invention, it becomes possible to provide an ink jet head that is capable of achieving energy saving by reducing an ejection force required to supply ink to an ejection portion and to eject the ink from the ejection portion, shortening a delay time from exertion of an ejection force to ejection of an ink droplet having a correct size, preserving an ink meniscus with stability, and performing precise image recording through stabilized ink ejection. Also, it becomes possible to provide a recording apparatus and a recording method using the ink jet head.

A ink jet head combining the feature of the first or second aspect of the present invention with the feature of the fifth aspect of the present invention may of course achieve synergistic effects of both effects, and a recording apparatus and a recording method combining the features of the third and fourth aspects of the present invention with the features of the sixth and seventh aspects of the present invention, respectively, may of course achieve synergistic effects of both effects.

What is claimed is:

1. An ink jet head for recording an image on a recording medium by ejecting ink containing charged fine particles by means of an electrostatic force, comprising:

an ink guide whose tip end portion is directed toward a side of said recording medium;

an ink flow path that supplies the ink to said ink guide; and an ejection electrode that comprises a surrounding electrode arranged so as to surround an outer periphery of said ink guide with a predetermined spacing, and ejects the ink guided from said ink flow path to the tip end portion of said ink guide by means of the electrostatic force, wherein a ratio between an effective inside diameter of said surrounding electrode and a distance from said surrounding electrode to a tip end of said ink guide protruding on the side of said recording medium is set in a range of 1:0.5 to 1:2.

2. The ink jet head according to claim 1, wherein said surrounding electrode is a substantially circular electrode, and said effective inside diameter is an average inside diameter.

3. The ink jet head according to claim 1, wherein:

said ink guide is arranged on a head substrate;

said ink flow path is formed between said head substrate and an insulating substrate arranged so as to be spaced apart from said head substrate by a predetermined distance;

through holes are formed in said insulating substrate; and said ink guide has said tip end portion protruding on the side of said recording medium from one of the through holes formed in said insulating substrate and guides the ink flowing in said ink flow path from said ink flow path to said tip end portion.

4. The ink jet head according to claim 3, wherein a contact angle of a surface of said ink guide in at least a portion existing in said through hole with respect to the ink is set larger than a contact angle of an inner wall surface of said through hole with respect to the ink.

5. The ink jet head according to claim 4, wherein said surface of said ink guide in at least the portion existing in said through hole has ink-repellent property.

6. The ink jet head according to claim 3, wherein said ink contains charged fine particles which are dispersed in a solvent, and said ejection electrode is provided on a side of said insulating substrate in said ink flow path.

7. The ink jet head according to claim 4, wherein a difference between said contact angle of said surface of said ink guide in at least the portion existing in said through hole with respect to the ink and said contact angle of said inner wall surface of said though hole with respect to the ink is set at not less than 10 degree.

8. The ink jet head according to claim 4, wherein said contact angle of said surface of said ink guide in at least the portion existing in said through hole with respect to the ink is set at not less than 20 degree.

9. The ink jet head according to claim 4, wherein said ink guide in at least the portion existing in said through hole is configured with a ink-repellent member, and said surface of said ink guide in at least the portion existing in said through hole is processed with a ink repellent material.

10. The ink jet head according to claim 1, wherein said tip end portion of said ink guide has an affinity for the ink.

11. The ink jet head according to claim 1, further comprising:

a guard electrode which is provided between adjacent ejection electrodes and suppresses electric field interferences occurring between the adjacent ejection electrodes.

12. The ink jet head according to claim 11, further comprising:

ink guides comprising said ink guide and are arranged two-dimensionally on a head substrate;

wherein said ink flow path is formed between said head substrate and an insulating substrate arranged so as to be spaced apart from said head substrate by a predetermined distance;

wherein through holes are formed in said insulating substrate and are arranged two-dimensionally;

said ink guides having respective tip end portions protruding on the side of said recording medium from each of the through holes formed in said insulating substrate and guides the ink flowing in said ink flow path from said ink flow path to said respective tip end portions; and said guard electrode is a sheet-like electrode that is common among said ejection electrodes, with holes formed in portions corresponding to said ejection electrodes formed around said through holes, arranged on a side of said insulating substrate facing said recording medium, and insulated from said ejection electrodes.

13. An ink jet head for recording an image on a recording medium by ejecting ink containing charged fine particles by means of an electrostatic force, comprising:

an ink guide whose tip end portion is directed toward a side of said recording medium;

an ink flow path that supplies the ink to said ink guide; and an ejection electrode that comprises side-by-side electrodes arranged on both sides of said ink guide so as to oppose each other with a predetermined spacing, and ejects the ink guided from said ink flow path to the tip end portion of said ink guide by means of the electrostatic force, wherein a ratio between an effective spacing between said side-by-side electrodes and a distance from said side-by-side electrodes to a tip end of said ink guide protruding on the side of said recording medium is set in a range of 1:0.7 to 1:2.8.

14. The ink jet head according to claim 13, wherein said side-by-side electrodes are substantially parallel electrodes, and said effective spacing is an average electrode spacing.

15. An ink jet recording apparatus, including an ink jet head for recording an image on a recording medium by ejecting ink containing charged fine particles by means of an electrostatic force, said ink jet head comprising:

two or more ink guides, a tip end portion of each ink guide being directed toward a side of said recording medium;

one or more ink flow paths that supply the ink to said two or more ink guides; and two or more ejection electrodes, each ejection electrode comprising a surrounding electrode arranged so as to surround an outer periphery of said ink guide with a distance, and ejecting the ink guided from said ink flow path to the tip end portion of said ink guide by means of the electrostatic force, wherein a ratio between an effective inside diameter of said surrounding electrode and a distance from said surrounding electrode to a tip end of said ink guide protruding on the side of said recording medium is set in a range of 1:0.5 to 1:2.

16. The ink jet recording apparatus according to claim 15, further comprising:

means for holding said recording medium;

means for relatively moving said ink jet head and said recording medium;

means for applying a predetermined bias voltage between said ejection electrode and said recording medium; and means for applying a predetermined ejection voltage to said ejection electrode in accordance with said image to be recorded on said recording medium.

17. An ink jet recording apparatus, including an ink jet head for recording an image on a recording medium by ejecting ink containing charged fine particles by means of an electrostatic force, said ink jet head comprising:

two or more ink guides, a tip end portion of each ink guide being directed toward a side of said recording medium;

one or more ink flow paths that supply the ink to said two or more ink guides; and two or more ejection electrodes, each ejection electrode comprising side-by-side electrodes arranged on both sides of said ink guide so as to oppose each other with a distance, and ejecting the ink guided from said ink flow path to the tip end portion of said ink guide by means of the electrostatic force, wherein a ratio between an effective distance between said side-by-side electrodes and a distance from said side-by-side electrodes to a tip end of said ink guide protruding on the side of said recording medium is set in a range of 1:0.7 to 1:2.8.

18. The ink jet recording apparatus according to claim 17, further comprising:

means for holding said recording medium;

means for relatively moving said ink jet head and said recording medium;

means for applying a predetermined bias voltage between said ejection electrode and said recording medium; and means for applying a predetermined ejection voltage to said ejection electrode in accordance with said image to be recorded on said recording medium.

* * * * *